US008970131B2

(12) United States Patent
Brandes et al.

(10) Patent No.: US 8,970,131 B2
(45) Date of Patent: Mar. 3, 2015

(54) SOLID STATE LIGHTING APPARATUSES AND RELATED METHODS

(71) Applicant: Cree, Inc., Durham, NC (US)

(72) Inventors: George R. Brandes, Raleigh, NC (US); Robert D. Underwood, Santa Barbara, CA (US); Bernd P. Keller, Santa Barbara, CA (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/769,273

(22) Filed: Feb. 15, 2013

(65) Prior Publication Data

US 2014/0232288 A1 Aug. 21, 2014

(51) Int. Cl.

| | |
|---|---|
| ***H05B 37/02*** | (2006.01) |
| ***H05B 37/00*** | (2006.01) |
| ***H05B 33/08*** | (2006.01) |

(52) U.S. Cl.

CPC ..... *H05B 37/00* (2013.01); *H05B 33/0803* (2013.01); *H05B 33/083* (2013.01); *H05B 33/086* (2013.01)

USPC ... 315/299; 315/185 R; 362/231; 362/249.02; 362/341

(58) Field of Classification Search

USPC ..... 362/227, 230, 231, 249.01, 249.02, 362/249.05, 341; 315/185 R, 186, 226, 291, 315/299

See application file for complete search history.

(56) References Cited

U.S. PATENT DOCUMENTS

| | | | | |
|---|---|---|---|---|
| 5,941,626 | A | 8/1999 | Yamuro | |
| 6,498,440 | B2 * | 12/2002 | Stam et al. | 315/291 |
| 6,580,228 | B1 | 6/2003 | Chen et al. | |
| 6,636,003 | B2 | 10/2003 | Rahm et al. | |
| 6,936,855 | B1 | 8/2005 | Harrah | |
| 7,072,096 | B2 | 7/2006 | Holman et al. | |
| 7,400,439 | B2 | 7/2008 | Holman | |
| 7,791,285 | B2 | 9/2010 | Wu | |
| 7,829,899 | B2 | 11/2010 | Hutchins | |
| 7,918,581 | B2 | 4/2011 | van de Ven et al. | |

(Continued)

FOREIGN PATENT DOCUMENTS

| | | | |
|---|---|---|---|
| JP | 2004119631 | A | 4/2004 |
| KR | 1020120103781 | A | 9/2012 |

(Continued)

OTHER PUBLICATIONS

Co-pending U.S. Appl. No. 13/769,277, filed Feb. 15, 2013.

(Continued)

*Primary Examiner* — Thuy Vinh Tran

(74) *Attorney, Agent, or Firm* — Withrow & Terranova, P.L.L.C.; Vincent K. Gustafson

(57) ABSTRACT

Solid state lighting apparatuses are adapted to operate with alternating current (AC) received directly from an AC power source. An exemplary apparatus includes a substrate and multiple sets of one or more solid state light emitters disposed over the substrate. Multiple sets of solid state light emitters are configured to be activated and/or deactivated at different times relevant to one another during portions of an AC cycle, and optionally have different duty cycles. Emitter configurations, color combinations, and/or circuit components reduce perceivable flicker, color shifts, and/or spatial variations in luminous flux. Color temperature and/or beam pattern are adjustable. Multiple emitters are arranged along non-coplanar substrate portions.

45 Claims, 22 Drawing Sheets

(56) References Cited

U.S. PATENT DOCUMENTS

| | | | | |
|---|---|---|---|---|
| 8,029,155 | B2 | 10/2011 | van de Ven et al. | |
| 8,314,571 | B2 * | 11/2012 | Jonsson | 315/291 |
| 8,382,315 | B2 | 2/2013 | Lee et al. | |
| 8,491,140 | B2 | 7/2013 | van de Ven et al. | |
| 2004/0046510 | A1 | 3/2004 | Allen | |
| 2004/0130518 | A1 | 7/2004 | De Krijger et al. | |
| 2008/0211416 | A1 | 9/2008 | Negley et al. | |
| 2009/0161356 | A1 * | 6/2009 | Negley et al. | 362/231 |
| 2009/0167202 | A1 | 7/2009 | Miskin et al. | |
| 2009/0283779 | A1 | 11/2009 | Negley et al. | |
| 2009/0316393 | A1 | 12/2009 | Vissenberg et al. | |
| 2010/0103660 | A1 * | 4/2010 | van de Ven et al. | 362/231 |
| 2010/0103678 | A1 | 4/2010 | van de Ven et al. | |
| 2010/0127283 | A1 | 5/2010 | van de Ven et al. | |
| 2010/0176743 | A1 | 7/2010 | Lee et al. | |
| 2010/0207851 | A1 | 8/2010 | Cok et al. | |
| 2010/0283072 | A1 | 11/2010 | Kazlas et al. | |
| 2011/0037413 | A1 * | 2/2011 | Negley et al. | 315/294 |
| 2011/0068701 | A1 | 3/2011 | van de Ven et al. | |
| 2011/0176289 | A1 * | 7/2011 | Ramer et al. | 362/84 |
| 2011/0182065 | A1 | 7/2011 | Negley et al. | |
| 2011/0193487 | A1 | 8/2011 | Janik | |
| 2011/0273102 | A1 | 11/2011 | van de Ven et al. | |
| 2011/0298371 | A1 | 12/2011 | Brandes et al. | |
| 2012/0091920 | A1 | 4/2012 | Yang | |
| 2012/0092865 | A1 | 4/2012 | Farmer | |
| 2012/0099084 | A1 | 4/2012 | Toyooka et al. | |
| 2012/0099321 | A1 | 4/2012 | Scott et al. | |
| 2012/0120655 | A1 | 5/2012 | Scott et al. | |
| 2012/0201022 | A1 | 8/2012 | van de Ven et al. | |
| 2012/0201024 | A1 | 8/2012 | van de Ven | |
| 2012/0217885 | A1 | 8/2012 | Lee et al. | |
| 2013/0026923 | A1 | 1/2013 | Athalye et al. | |
| 2013/0026925 | A1 | 1/2013 | Ven et al. | |
| 2013/0043799 | A1 | 2/2013 | Siu et al. | |
| 2013/0049602 | A1 | 2/2013 | Raj et al. | |
| 2013/0069535 | A1 | 3/2013 | Athalye | |
| 2013/0069536 | A1 | 3/2013 | Ni | |
| 2013/0088848 | A1 | 4/2013 | Lee et al. | |
| 2013/0169159 | A1 | 7/2013 | Lys | |
| 2014/0078715 | A1 * | 3/2014 | Pickard et al. | 362/84 |
| 2014/0125229 | A1 * | 5/2014 | Ni | 315/122 |

FOREIGN PATENT DOCUMENTS

| | | | |
|---|---|---|---|
| WO | WO-2011/108876 | A2 | 9/2011 |
| WO | WO-2013/052403 | A1 | 4/2013 |

OTHER PUBLICATIONS

Non-final Office Action for U.S. Appl. No. 13/769,277 mailed Jun. 6, 2014, 20 pages.

International Search Report and Written Opinion for International Patent Application No. PCT/US2014/014217 mailed May 22, 2014, 23 pages.

* cited by examiner

1900A

1916A

| | | | | |
|---|---|---|---|---|
| $2_{A1}$ | $1_{B1}$ | $3_{C1}$ | $1_{D1}$ | $2_{E1}$ |
| $1_{A2}$ | $3_{B2}$ | $2_{C2}$ | $3_{D2}$ | $1_{E2}$ |
| $3_{A3}$ | $2_{B3}$ | $1_{C3}$ | $2_{D3}$ | $3_{E3}$ |
| $1_{A4}$ | $3_{B4}$ | $2_{C4}$ | $3_{D4}$ | $1_{E4}$ |
| $2_{A5}$ | $1_{B5}$ | $3_{C5}$ | $1_{D5}$ | $2_{E5}$ |

FIG._19A

1900C

1916C

| | | | | |
|---|---|---|---|---|
| $3_{A1}$ | $3_{B1}$ | $1_{C1}$ | $3_{D1}$ | $3_{E1}$ |
| $3_{A2}$ | $2_{B2}$ | $2_{C2}$ | $2_{D2}$ | $3_{E2}$ |
| $1_{A3}$ | $2_{B3}$ | $1_{C3}$ | $2_{D3}$ | $1_{E3}$ |
| $3_{A4}$ | $2_{B4}$ | $2_{C4}$ | $2_{D4}$ | $3_{E4}$ |
| $3_{A5}$ | $3_{B5}$ | $1_{C5}$ | $3_{D5}$ | $3_{E5}$ |

FIG._19C

1900B

1916C

| | | | | |
|---|---|---|---|---|
| $2_{A1}$ | $3_{B1}$ | $1_{C1}$ | $3_{D1}$ | $2_{E1}$ |
| $3_{A2}$ | $1_{B2}$ | $2_{C2}$ | $1_{D2}$ | $3_{E2}$ |
| $1_{A3}$ | $2_{B3}$ | $3_{C3}$ | $2_{D3}$ | $1_{E3}$ |
| $3_{A4}$ | $1_{B4}$ | $2_{C4}$ | $1_{D4}$ | $3_{E4}$ |
| $2_{A5}$ | $3_{B5}$ | $1_{C5}$ | $3_{D5}$ | $2_{E5}$ |

FIG._19B

SOLID STATE LIGHTING APPARATUSES AND RELATED METHODS

STATEMENT OF RELATED APPLICATIONS

Subject matter disclosed herein relates at least in part to U.S. Pat. No. 8,742,671 [P1364], U.S. Patent Application Publication No. 2013/0169159 [P1454], U.S. Patent Application Publication No. 2013/0069535 [P1459], U.S. Patent Application Publication No. 2013/0069536 [P1461], and U.S. Patent Application Publication No. 2013/0026923 [P1556]. The disclosures of the foregoing patent and published patent applications are hereby incorporated by reference as if set forth fully herein.

TECHNICAL FIELD

The present subject matter generally relates to lighting apparatuses and related methods and, more particularly, to solid state lighting apparatuses and related methods.

BACKGROUND

Solid state lighting arrays are used for a number of lighting applications. For example, lighting panels including arrays of solid state light emitting devices have been used as direct illumination sources in applications including architectural and/or accent lighting. A solid state light emitting device may include, for example, a packaged light emitting device including one or more light emitting diodes (LEDs), which may include inorganic LED chips and/or organic LED chips (OLEDs). Typically, solid state light emitting devices generate light through the recombination of electronic carriers (electrons and holes) in a light emitting layer or region of a LED chip. LEDs have significantly longer lifetimes and typically have significantly greater luminous efficiency than conventional incandescent and fluorescent light sources; however, LEDs are narrow-band emitters, and it can be challenging to simultaneously provide good color rendering in combination with high luminous efficacy.

Aspects relating to the subject matter disclosed herein may be better understood with reference to the 1931 CIE (Commission International de l'Eclairage) Chromaticity Diagram, which is well-known and readily available to those of ordinary skill in the art. The 1931 CIE Chromaticity Diagram maps out the human color perception in terms of two CIE parameters x and y. The spectral colors are distributed around the edge of the outlined space, which includes all of the hues perceived by the human eye. The boundary line represents maximum saturation for the spectral colors. The chromaticity coordinates (i.e., color points) that lie along the blackbody locus obey Planck's equation: $E(\lambda)=A\lambda^{-5}/(e^{B/T}-1)$ where E is the emission intensity, $\lambda$ is the emission wavelength, T the color temperature of the blackbody, and A and B are constants. Color coordinates that lie on or near the blackbody locus yield pleasing white light to a human observer. The 1931 CIE Diagram includes temperature listings along the blackbody locus (embodying a curved line emanating from the right corner). These temperature listings show the color path of a blackbody radiator that is caused to increase to such temperatures. As a heated object becomes incandescent, it first glows reddish, then yellowish, then white, and finally bluish. This occurs because the wavelength associated with the peak radiation of the blackbody radiator becomes progressively shorter with increased temperature, consistent with the Wien Displacement Law. Illuminants which produce light that is on or near the blackbody locus can thus be described in terms of their color temperature.

LEDs typically receive a direct current (DC) input signal or a modulated square wave input signal so that a constant current flows through the LEDs when in an "on" state. A current value is typically set to provide high conversion efficiency. LED light sources with variable intensity may be controlled by changing duty factor of a modulated square wave input signal.

Conventional lighting systems for use in buildings are powered by an alternating current (AC) source; accordingly, a LED-based light source for use in buildings typically includes an AC-DC power converter. An AC-DC power converter often represents a significant fraction of the overall cost of a LED-based light source, and power losses inherent to such a power converter reduces overall efficiency of the light source. Additionally, AC-DC power converters are generally not as reliable as LEDs, and therefore can limit the operating lifetime of a LED light source.

To avoid disadvantages associated with use of AC-DC power converters, it has been proposed to operate a LED light source directly from an AC power source without AC-DC conversion. Multiple groups or sets of series-connected LEDs may be powered by different portions of an AC waveform. For instance, one group may be powered on when the amplitude of the AC waveform is positive, and another group may be powered on when the amplitude of the AC waveform is negative; however, this simple driving scheme typically suffers from flicker and reduced efficiency. To provide somewhat improved efficiency, a full-wave rectifier may be used; however, the resulting light source still has limited efficiency and may exhibit flicker.

Since LEDs emit light with narrow wavelength spectrum, it is often necessary to utilize LEDs having different peak wavelengths (e.g., different colors) in a single LED light source in order to generate light with desirably high color rendering characteristics. If multiple groups of LEDs including LEDs having different peak wavelengths are utilized in a light source lacking an AC-DC power converter, however, then it may be challenging to avoid perceptible variations in color of light (e.g., with respect to area) output by such a light source, particularly if multiple LEDs having different peak wavelengths are distributed over a large area. Whether or not LEDs have different peak wavelengths, another challenge with utilizing multiple groups of LEDs in a light source lacking an AC-DC power converter (particularly when multiple LEDs distributed over a large area) is avoiding perceptible variations in intensity of light (e.g., with respect to area) output by such a light source.

Still another challenge associated with utilizing multiple groups of LEDs in a light source lacking an AC-DC power converter is thermal management—including efficiently dissipating heat generated by LEDs without overheating individual LEDs (which would shorten LED lifetime) and without needlessly increasing heatsink area (which would increase cost and size of a light source).

Another challenge associated with solid state lighting apparatuses includes providing the ability to vary beam patterns while avoiding use of mechanical elements that would require periodic maintenance and/or would be subject to failure long before the service life of solid state light emitters. Still another challenge associated with solid state light apparatuses includes providing the ability to vary color temperature without unduly increasing cost or complexity of a lighting apparatus.

Accordingly, a need exists for improved solid state lighting apparatuses and/or improved methods including use of solid state lighting apparatuses that can be directly coupled to an AC voltage signal, without requiring use of an on-board switched mode power supply. Desirable solid state lighting apparatuses and methods would exhibit reduced flicker, reduced variation in color with respect to area, reduced variation in light intensity with respect to area, and/or improved thermal management.

SUMMARY

Solid state lighting apparatuses adapted to operate with alternating current (AC) received directly from an AC power source and related methods are disclosed. In one aspect, an exemplary solid state lighting apparatus can comprise a substrate and multiple sets of one or more solid state light emitters arranged on or supported by the substrate. At least first and second sets of the multiple sets of solid state light emitters can be configured to be activated and/or deactivated at different times relevant to one another during a portion of an AC cycle. The first and second sets of the multiple sets of solid state light emitters can also comprise different duty cycles.

Notably, solid state lighting apparatuses described herein can comprise various emitter configurations, color combinations, and/or circuit components adapted to reduce perceivable flicker, perceivable color shifts, and/or perceivable spatial variations in luminous flux that could potentially occur during activation and/or deactivation of multiple sets of different solid state light emitters. Solid state lighting apparatus described herein may also permit color temperature and/or beam pattern to be adjusted.

In one aspect, a solid state lighting apparatus is adapted to operate with alternating current (AC) received from an AC power source, the lighting apparatus comprising: a substrate; and multiple sets of one or more solid state light emitters arranged on or supported by the substrate, wherein at least first and second sets of the multiple sets of solid state light emitters are configured to be activated and/or deactivated at different times relative to one another during a portion of an AC cycle, and wherein the first and second sets of the multiple sets of solid state light emitters comprise different duty cycles; wherein at least one solid state light emitter of the first set of solid state light emitters comprises a largest duty cycle of the different duty cycles and is arranged closer in proximity to at least one solid state emitter of the second solid state light emitter set comprising a smallest duty cycle of the different duty cycles than in proximity to any other solid state light emitter of the multiple sets of solid state light emitters.

In another aspect, a solid state lighting apparatus is adapted to operate with alternating current (AC) received from an AC power source, the lighting apparatus comprising: a substrate; and an array of solid state light emitters arranged on or supported by the substrate, wherein the array includes a plurality of solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; wherein, within the array of solid state light emitters, at least one solid state light emitter of a first solid state light emitter set is arranged closer to at least one solid state emitter of a second solid state light emitter set than to any other solid state light emitter of the first solid state light emitter set.

In another aspect, a solid state lighting apparatus is adapted to operate with alternating current (AC) received from an AC power source, the lighting apparatus comprising: an array of solid state light emitters arranged on or supported by a substrate, the array comprising a plurality of mutually exclusive solid state light emitter sets each comprising multiple solid state light emitters, wherein at least two different solid state light emitter sets of the plurality sets are adapted to be activated and/or deactivated at different times relative to one another during a portion of an AC cycle, and wherein the at least two different solid state light emitter sets comprise different duty cycles; wherein the array comprises multiple solid state light emitters distributed across a central portion of the substrate, and comprises multiple solid state light emitters distributed across a peripheral portion of the substrate; and wherein the central portion comprises more solid state light emitters than the peripheral portion.

In yet another aspect, a lighting apparatus adapted to operate with alternating current (AC) received from an AC power source, the lighting apparatus comprising: an array of solid state light emitters arranged on or supported by a common substrate and including a plurality of solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; wherein the array is distributed across a region of the substrate; and wherein, for each set of the solid state light emitter sets, the multiple solid state light emitters are symmetrically arranged within or along the region.

In still another aspect, lighting apparatus is adapted to operate with alternating current (AC) received from an AC power source, the lighting apparatus comprising: an array of solid state light emitters arranged on or supported by a common substrate and including a plurality of solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; wherein the lighting device comprises at least one of the following features (a) and (b): (a) at least one solid state light emitter set of the plurality of solid state light emitter sets is arranged to emit at least one peak wavelength that differs by at least 30 nm from at least one peak wavelength emitted by at least one other solid state light emitter set of the plurality of solid state light emitter sets; and (b) at least one solid state light emitter set of the plurality of solid state light emitter sets is arranged to emit a first peak wavelength and to emit a second peak wavelength that differs from the first peak wavelength by at least 30 nm.

In another aspect, a lighting apparatus adapted to operate with alternating current (AC) received from an AC power source, the lighting apparatus comprising: an array of solid state light emitters arranged on or supported by a common substrate and including a plurality of solid state light emitter sets each comprising multiple solid state light emitters, wherein at least three different solid state light emitter sets of the plurality of solid state light emitter sets are arranged to be activated and/or deactivated at different times relative to one another during a portion of an AC cycle; and wherein each solid state light emitter set of the at least three different solid state light emitter sets is independently arranged to emit light having x, y color coordinates within four MacAdam step ellipses of a reference point on the blackbody locus of a 1931 CIE Chromaticity Diagram and having a color temperature that differs by at least 400 K relative to a color temperature of each other solid state light emitter set of the at least three different solid state light emitter sets.

In yet another aspect, a lighting apparatus is adapted to operate with alternating current (AC) received from an AC power source, and the lighting apparatus comprises: an array of solid state light emitters arranged on or supported by a body structure and including a plurality of solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; at least one reflector and/or at least one optical element arranged to receive emissions from the plurality of solid state light emitter sets, and arranged to affect a beam pattern generated by the lighting device; and a control element arranged to permit adjustment of duty cycle of each solid state light emitter set of the at least two solid state light emitter sets, and thereby permit adjustment of said beam pattern.

In yet another aspect, a lighting apparatus is adapted to operate with alternating current (AC) received from an AC power source, and the lighting apparatus comprises: a first array of solid state light emitters arranged on or supported by a first substrate and including a first plurality of solid state light emitter sets each comprising multiple solid state light emitters, wherein at least two different solid state light emitter sets of the first plurality of solid state light emitter sets are arranged to be activated and/or deactivated at different times relative to one another during a portion of an AC cycle; a second array of solid state light emitters arranged on or supported by a second substrate and including a second plurality of solid state light emitter sets each comprising multiple solid state light emitters, wherein at least two different solid state light emitter sets of the second plurality of solid state light emitter sets are arranged to be activated and/or deactivated at different times relative to one another during a portion of an AC cycle; and a support plate comprising a plurality of substrate mounting regions including a first substrate mounting region arranged to receive the first substrate and including a second substrate mounting region arranged to receive the second substrate.

In another aspect, the invention relates to a solid state lighting apparatus adapted to operate with alternating current (AC) received from an AC power source, the lighting apparatus including: a substrate; and multiple sets of solid state light emitters, each including multiple solid state light emitters, arranged on or supported by the substrate, wherein at least first and second sets of the multiple sets of solid state light emitters are configured to be activated and/or deactivated at different times relative to one another during a portion of an AC cycle, and wherein the at least first and second sets of the multiple sets of solid state light emitters comprise different duty cycles; the apparatus comprising at least one of the following features (i) and (ii): the first set of solid state light emitters comprises a largest duty cycle of the different duty cycles and consists of a greater number of solid state light emitters than any other set of the multiple sets of solid state light emitters; and the second set of solid state light emitters comprises a smallest duty cycle of the different duty cycles and consists of a smaller number of solid state light emitters of the multiple sets of solid state light emitters.

In yet another aspect, the invention relates to a solid state lighting apparatus adapted to operate with alternating current (AC) received from an AC power source, the lighting apparatus including: multiple substrate regions; and multiple sets of one or more solid state light emitters arranged on or supported by the multiple substrate regions, wherein at least first and second sets of the multiple sets of solid state light emitters are configured to be activated and/or deactivated at different times relative to one another during a portion of an AC cycle, wherein the first and second sets of the multiple sets of solid state light emitters comprise different duty cycles; and wherein the lighting apparatus comprises at least one of the following features (i) to (iii): (i) a first substrate region of the multiple substrate regions includes one or more solid state light emitters of the first set of solid state light emitters and includes one or more solid state light emitters of the second set of solid state light emitters; and a second substrate region of the multiple substrate regions is non-coplanar with the first substrate region and includes one or more solid state light emitters of the first set of solid state light emitters and includes one or more solid state light emitters of the second set of solid state light emitters; (ii) at least one first solid state light emitter of the first set of solid state light emitters is arranged on a first substrate region of the multiple substrate regions that is substantially parallel to a first plane, at least one second solid state light emitter of the second set of solid state light emitters is arranged on a second substrate region of the multiple substrate regions that is substantially parallel to a second plane that is non-coplanar with the first plane but oriented less than 30 degrees apart from the first plane, and at least a portion of emissions of the at least one first solid state emitter are arranged to mix or overlap with at least a portion of emissions of the at least one second solid state emitter; and (iii) at least one first solid state light emitter of the first set of solid state light emitters is arranged on a first substrate region of the multiple substrate regions and is arranged to output a first beam centered in a first direction, and at least one second solid state light emitter of the second set of solid state light emitters is arranged on a second substrate region of the multiple substrate regions and is arranged to output a second beam centered in a second direction that is non-parallel to the first direction but oriented less than 30 degrees apart from the first direction.

In another aspect, the invention relates to a method comprising illuminating an object, a space, or an environment, utilizing at least one lighting apparatus as described herein.

In another aspect, any of the foregoing aspects, and/or various separate aspects and features as described herein, may be combined for additional advantage. Any of the various features and elements as disclosed herein may be combined with one or more other disclosed features and elements unless indicated to the contrary herein.

Other aspects, features and embodiments of the invention will be more fully apparent from the ensuing disclosure and appended claims.

BRIEF DESCRIPTION OF DRAWINGS

A full and enabling disclosure of the present subject matter is set forth more particularly in the remainder of the specification, including reference to the accompanying figures relating to one or more embodiments, in which:

FIGS. 19A-19C are schematic diagrams illustrating placement of solid state emitters on substrates of solid state lighting apparatuses according to certain embodiments;

DETAILED DESCRIPTION

Figure 1:
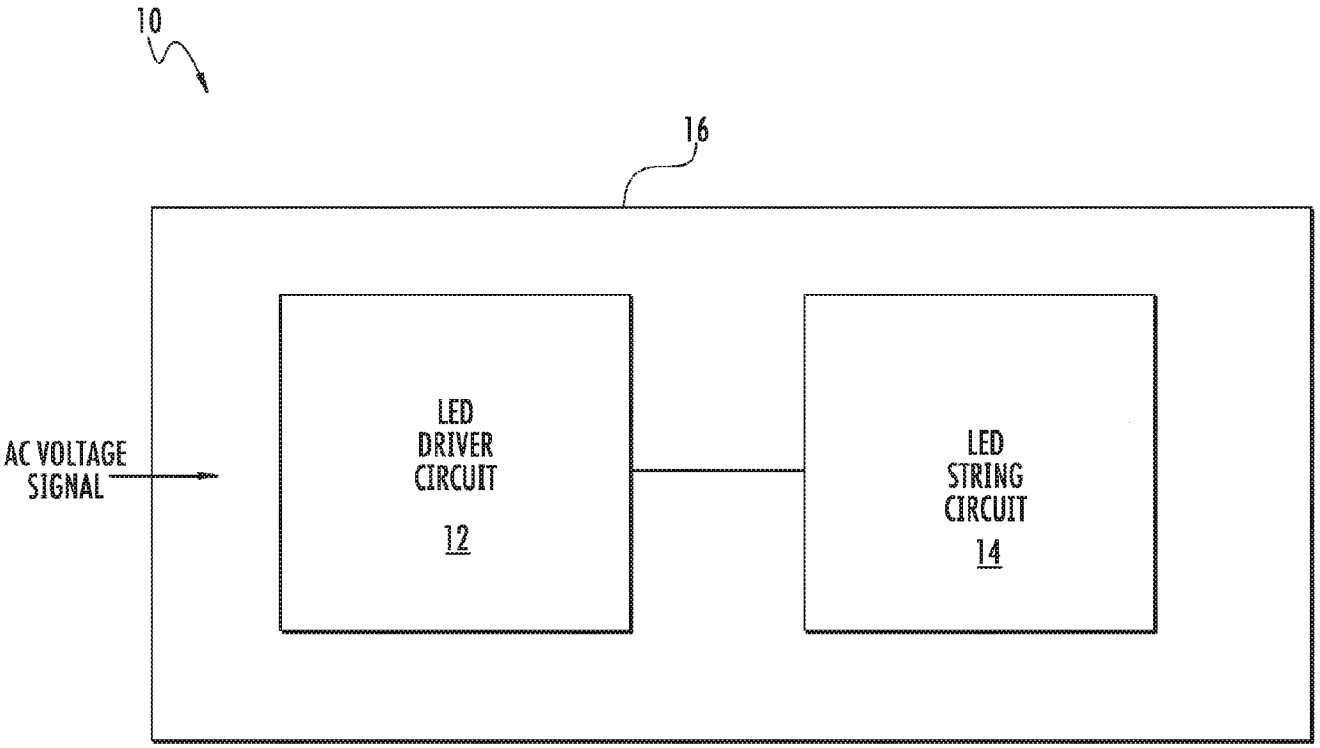
FIG. 1 is a schematic block diagram illustrating a solid state lighting apparatus including a light emitting diode (LED) driver circuit and a LED string circuit according to certain embodiments.

The present invention relates in certain aspects to solid state lighting apparatuses adapted to operate with alternating current (AC) received directly from an AC power source and related methods. Exemplary solid state lighting apparatuses can comprise a substrate and multiple sets of one or more solid state light emitters arranged on or supported by the substrate. At least first and second sets of the multiple sets of solid state light emitters can be configured to be activated and/or deactivated at different times relevant to one another during a portion of an AC cycle. More than two sets of solid state light emitters may be provided, and different sets of solid state light emitters may also comprise different duty cycles. Notably, solid state lighting apparatuses described herein can comprise various emitter configurations, color combinations, and/or circuit components adapted to reduce perceivable flicker, perceivable color shifts, and/or perceivable spatial variations in luminous flux that could potentially occur during activation and/or deactivation of multiple sets of different solid state light emitters. Solid state lighting apparatus described herein may also permit color temperature and/or beam pattern to be adjusted.

Unless otherwise defined, terms used herein should be construed to have the same meaning as commonly understood by one of ordinary skill in the art to which this invention belongs. It will be further understood that terms used herein should be interpreted as having a meaning that is consistent with their meaning in the context of this specification and the relevant art, and should not be interpreted in an idealized or overly formal sense unless expressly so defined herein.

Embodiments of the invention are described herein with reference to cross-sectional, perspective, elevation, and/or plan view illustrations that are schematic illustrations of idealized embodiments of the invention. Variations from the shapes of the illustrations as a result, for example, of manufacturing techniques and/or tolerances, are to be expected, such that embodiments of the invention should not be construed as limited to particular shapes illustrated herein. This invention may be embodied in different forms and should not be construed as limited to the specific embodiments set forth herein. In the drawings, the size and relative sizes of layers and regions may be exaggerated for clarity.

Unless the absence of one or more elements is specifically recited, the terms "comprising," "including," and "having" as used herein should be interpreted as open-ended terms that do not preclude the presence of one or more elements.

The terms "LEDs" and "LED chips" are synonymous and refer to solid state light emitting devices or solid state light emitters as described hereinbelow.

It will be understood that when an element such as a layer, region, or substrate is referred to as being "on" another element, it can be directly on the other element or intervening elements may be present. Moreover, relative terms such as "on", "above", "upper", "top", "lower", or "bottom" are used herein to describe one structure's or portion's relationship to another structure or portion as illustrated in the figures. It will be understood that relative terms such as "on", "above", "upper", "top", "lower" or "bottom" are intended to encompass different orientations of the device in addition to the orientation depicted in the figures. For example, if the device in the figures is turned over, structure or portion described as "above" other structures or portions would now be oriented "below" the other structures or portions.

The terms "electrically activated emitter" and "emitter" as used herein refers to any device capable of producing visible or near visible (e.g., from infrared to ultraviolet) wavelength radiation, including but not limited to, xenon lamps, mercury lamps, sodium lamps, incandescent lamps, and solid state emitters, including diodes (LEDs), organic light emitting diodes (OLEDs), and lasers.

The terms "solid state light emitter" or "solid state emitter" may include a light emitting diode, laser diode, organic light emitting diode, and/or other semiconductor device preferably arranged as a semiconductor chip that includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials.

It will be understood that the terms "groups", "segments", or "sets" as used herein are synonymous terms. As used herein, these terms generally describe how multiple LED chips can be electrically connected in series, in parallel, or in mixed series/parallel configurations among mutually exclusive groups/segments/sets.

The term "substrate" as used herein in connection with lighting apparatuses refers to a mounting element on which, in which, or over which multiple solid state light emitters (e.g., emitter chips) may be arranged or supported (e.g., mounted). Exemplary substrates useful with lighting apparatuses as described herein include printed circuit boards (including but not limited to metal core printed circuit boards, flexible circuit boards, dielectric laminates, and the like) having electrical traces arranged on one or multiple surfaces thereof, support panels, and mounting elements of various materials and conformations arranged to receive, support, and/or conduct electrical power to solid state emitters. A unitary substrate may be used to support multiple groups of solid state emitter components, and may further be used to support related circuits and/or circuit elements, such as driver circuit elements, rectifier circuit elements (e.g., a rectifier bridge), current limiting circuit elements, current diverting circuit elements, and/or dimmer circuit elements. In certain embodiments, a substrate may include multiple emitter mounting regions each arranged to receive one or more solid state light emitters or sets of solid state light emitters. In certain embodiments, substrates may include conductive regions arranged to conduct power to solid state light emitters or solid state light emitter groups arranged thereon or thereover. In other embodiments, substrates may be insulating in character, and electrical connections to solid state emitters may be provided by other means (e.g., via conductors not associated with substrates).

Solid state light emitting devices according to embodiments of the invention may include III-V nitride (e.g., gallium nitride) based LED chips or laser chips fabricated on a silicon, silicon carbide, sapphire, or III-V nitride growth substrate, including (for example) devices manufactured and sold by Cree, Inc. of Durham, N.C. Such LEDs and/or lasers may be configured to operate such that light emission occurs through the substrate in a so-called "flip chip" orientation. Such LED and/or laser chips may also be devoid of growth substrates (e.g., following growth substrate removal).

LED chips useable with lighting devices as disclosed herein may include horizontal devices (with both electrical contacts on a same side of the LED) and/or vertical devices (with electrical contacts on opposite sides of the LED). A horizontal device (with or without the growth substrate), for example, may be flip chip bonded (e.g., using solder) to a carrier substrate or printed circuit board (PCB), or wire bonded. A vertical device (without or without the growth substrate) may have a first terminal solder bonded to a carrier substrate, mounting pad, or printed circuit board (PCB), and have a second terminal wire bonded to the carrier substrate, electrical element, or PCB.

Electrically activated light emitters (including solid state light emitters) may be used individually or in groups to emit one or more beams to stimulate emissions of one or more lumiphoric materials (e.g., phosphors, scintillators, lumiphoric inks, quantum dots) to generate light at one or more peak wavelength, or of at least one desired perceived color (including combinations of colors that may be perceived as white). Inclusion of lumiphoric (also called 'luminescent') materials in lighting devices as described herein may be accomplished by direct coating on lumiphor support elements or lumiphor support surfaces (e.g., by powder coating, inkjet printing, or the like), adding such materials to lenses, and/or by embedding or dispersing such materials within lumiphor support elements or surfaces. Other materials, such as light scattering elements (e.g., particles) and/or index matching materials may be associated with a lumiphoric material-containing element or surface. In certain embodiments, one or more lumiphoric materials may be located remotely from (e.g., spatially segregated from) multiple sets of one or more solid state emitters and supported by a lumiphor support element (e.g., transparent or other light transmissive support), with the at least one lumiphoric material being arranged to be stimulated by emissions of at least some solid state light emitters of multiple sets of solid state light emitters. LED devices and methods as disclosed herein may include have multiple LEDs of different colors, one or more of which may be white emitting (e.g., including at least one LED with one or more lumiphoric materials).

In certain embodiments, one or more short wavelength solid state emitters (e.g., blue and/or cyan LED) may be used to stimulate emissions from a mixture of lumiphoric materials, or discrete layers of lumiphoric material, including red, yellow, and green lumiphoric materials. In certain embodiments, multiple groups of solid state emitters may include at least three independently controlled short wavelength (e.g., blue or cyan) LEDs, with a first short wavelength LED arranged to stimulate emissions of a first red lumiphor, a second short wavelength LED arranged to stimulate emissions of a second yellow lumiphor, and a third short wavelength LED arranged to stimulate emissions of a third red lumiphor. Such LEDs of different wavelengths may be present in the same group of solid state emitters, or may be provided in different groups of solid state emitters.

The expression "peak wavelength", as used herein, means (1) in the case of a solid state light emitter, to the peak wavelength of light that the solid state light emitter emits if it is illuminated, and (2) in the case of a lumiphoric material, the peak wavelength of light that the lumiphoric material emits if it is excited.

A wide variety of wavelength conversion materials (e.g., luminescent materials, also known as lumiphors or luminophoric media, e.g., as disclosed in U.S. Pat. No. 6,600,175 and U.S. Patent Application Publication No. 2009/0184616), are well-known and available to persons of skill in the art. Examples of luminescent materials (lumiphors) include phosphors, scintillators, day glow tapes, nanophosphors, quantum dots (e.g., such as provided by NNCrystal US Corp. (Fayetteville, Ark.)), and inks that glow in the visible spectrum upon illumination with (e.g., ultraviolet) light. One or more luminescent materials useable in devices as described herein may be down-converting or up-converting, or can include a combination of both types.

Some embodiments of the present invention may use solid state emitters, emitter packages, fixtures, luminescent materials/elements, power supply elements, control elements, and/or methods such as described in U.S. Pat. Nos. 7,564,180; 7,456,499; 7,213,940; 7,095,056; 6,958,497; 6,853,010; 6,791,119; 6,600,175, 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, and/or 2006/0221272; with the disclosures of the foregoing patents and published patent applications being hereby incorporated by reference as if set forth fully herein.

The expression "lighting device" or "lighting apparatus," as used herein, is not limited, except that it is capable of emitting light. That is, a lighting device or lighting apparatus can be a device or apparatus that illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or backlighting (e.g., backlight poster, signage, LCD displays), light bulbs, bulb replacements (e.g., for replacing AC incandescent lights, low voltage lights, fluorescent lights, etc.), outdoor lighting, security lighting, exterior residential lighting (wall mounts, post/column mounts), ceiling fixtures/wall sconces, under cabinet lighting, lamps (floor and/or table and/or desk), landscape lighting, track lighting, task lighting, specialty lighting, rope lights, ceiling fan lighting, archival/art display lighting, high vibration/impact lighting-work lights, etc., mirrors/vanity lighting, or any other light emitting device. In certain embodiments, lighting devices or lighting apparatuses as disclosed herein are self-ballasted.

The inventive subject matter further relates in certain embodiments to an illuminated enclosure (the volume of which can be illuminated uniformly or non-uniformly), comprising an enclosed space and at least one lighting device or lighting apparatus as disclosed herein, wherein the lighting device or apparatus illuminates at least a portion of the enclosure (uniformly or non-uniformly). The inventive subject matter further relates to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, a LCD display, a cave, a tunnel, a yard, a lamppost, etc., having mounted therein or thereon at least one lighting device or apparatus as described herein. Methods include illuminating an object, a space, or an environment, utilizing one or more lighting devices or apparatuses as disclosed herein.

In certain embodiments, lighting devices as described herein including multiple groups of one electrically activated (e.g., solid state) light emitters with peak wavelengths in the visible range. In certain embodiments, multiple electrically activated (e.g., solid state) emitters are provided, with groups of emitters being separately controllable relative to one another. In certain embodiments, one or more groups of solid state emitters as described herein may include at least a first LED comprising a first LED peak wavelength, and include at least a second LED comprising a second LED peak wavelength that differs from the first LED peak wavelength by at least 20 nm, or by at least 30 nm. In such a case, each of the first wavelength and the second wavelength is preferably within the visible range.

In certain embodiments, control of one or more solid state emitter groups or sets may be responsive to a control signal (optionally including at least one sensor arranged to sense electrical, optical, and/or thermal properties and/or environmental conditions), and a control system may be configured to selectively provide one or more control signals to at least one current supply circuit. In various embodiments, current to different circuits or circuit portions may be pre-set, user-defined, or responsive to one or more inputs or other control parameters.

In certain embodiments, each set of solid state light emitters comprises at least one electrostatic discharge protection element in electrical communication therewith.

In certain embodiments, multiple solid state emitters (e.g., LEDs) arranged to emit similar or different peak wavelengths are arranged on a common substrate, with different individual emitters or sets of emitters being separately controllable from other individual emitters or sets of emitters. Emitters having similar output wavelengths may be selected from targeted wavelength bins. Emitters having different output wavelengths may be selected from different wavelength bins, with peak wavelengths differing from one another by a desired threshold (e.g., at least 20 nm, at least 30 nm, at least 50 nm, or another desired threshold).

In certain embodiments, one or more sets of solid state emitter includes at least one BSY or white emitter component (including a blue solid state emitter arranged to stimulate emissions of a yellow lumiphor) and at least one red emitter (e.g., a red LED and/or a LED (e.g., UV, blue, cyan, green, etc.) arranged to stimulate emissions of a red lumiphor). Addition of at least one red emitter may be useful to enhance warmth of the BSY or white emissions and improve color rendering, with the resulting combination being termed BSY+R or warm white. In certain embodiments, red and BSY components may be separately controlled, as may be useful to adjust color temperature and/or to maintain a desired color point as temperature increases. In various embodiments, BSY components and red components may be controlled together in a single group or set, or may be aggregated into separate groups or sets that are separately controlled. One or more supplemental solid state emitters and/or lumiphors of any suitable color (or peak wavelength) may be substituted for one or more red light-emitting components, or may be provided in addition to one or more red light-emitting components. In certain embodiments, a blue LED may be arranged to stimulate emissions of both yellow and red phosphors, to yield a BS(Y+R) emitter.

In certain embodiments, a solid state lighting device may include one or more groups or sets of BSY light emitting components supplemented with one or more supplemental emitters, such as long wavelength blue, cyan, green, yellow, amber, orange, red or any other desired colors. Presence of a cyan solid state emitter (which is preferably independently controllable) is particularly desirable in certain embodiments to permit adjustment or tuning of color temperature of a lighting device, since the tie line for a solid state emitter having a ~487 nm peak wavelength is substantially parallel to the blackbody locus for a color temperature of less than 3000K to about 4000K. Different groups of solid state light emitters are preferably controlled separately, such as may be useful to adjust intensity, adjust beam pattern, permit tuning of output color, permit tuning of color temperature, and/or affect dissipation of heat generated by the light emitting components.

In certain embodiments, solid state light emitters comprising a larger duty cycle may be positioned close to solid state emitters comprising a smaller duty cycle (e.g., with emitters comprising the largest duty cycle positioned closer to emitters comprising the smallest duty cycle than to any other emitters of a lighting device), such as may be beneficial to avoid perceptible spatial variations in light intensity and/or color, and/or may be beneficial for managing heat dissipation from a lighting device. In certain embodiments, a set of solid state light emitters having a smallest duty cycle of multiple sets of solid state light emitters is disposed proximate to a center of a substrate on or over which multiple sets of solid state emitters are arranged.

In one embodiments, a solid state lighting apparatus adapted to operate with alternating current (AC) received from an AC power source may include: multiple sets of one or more solid state light emitters arranged on or supported by a substrate, wherein at least first and second sets of the multiple sets of solid state light emitters are configured to be activated and/or deactivated at different times relative to one another during a portion of an AC cycle, and wherein the first and second sets of the multiple sets of solid state light emitters comprise different duty cycles; and wherein at least one solid state light emitter of the first set of solid state light emitters comprises a largest duty cycle of the different duty cycles and is arranged closer in proximity to at least one solid state emitter of the second solid state light emitter set comprising a smallest duty cycle of the different duty cycles than in proximity to any other solid state light emitter of the multiple sets of solid state light emitters. In certain embodiments, the multiple sets of solid state light emitters may include at least three different sets of solid state light emitters adapted to be activated and/or deactivated at different times relative to one another.

In certain embodiments, multiple sets of solid state light emitters that are configured to be activated and/or deactivated at different times relative to one another during a portion of an AC cycle are configured to operate preferably within 15 percent, more preferably within 10 percent, more preferably within 5 percent, and more preferably within 3 percent, of a root mean square (RMS) voltage of the AC power source. In certain embodiments, the AC power source has frequency of 16.7 Hz, 50 Hz, 60 Hz, or 400 Hz, or any intermediate value between two or more of the foregoing frequency values. In certain embodiments, the AC cycle comprises a substantially sinusoidal waveform cycling between positive and negative voltages. In certain embodiments, the AC power source has a nominal RMS voltage of at least about 100V, such as including approximate values of 40V, 90V, 110V, 120V, 170V, 220V, 230V, 240V, 277V, 300V, 480V, 600V higher voltages, or any approximate or subset of voltage as previously recited. Operation of solid state light emitters at elevated voltages contradicts the traditional practice of converting power received from an AC source to substantially lower voltage DC power using an AC/DC converter in order to power solid state emitters (e.g., LEDs).

In certain embodiments, an AC voltage signal supplied to a lighting apparatus as described herein may include single phase AC voltage signal. In other embodiments the AC voltage signal may be obtained from multiple leads of a three phase AC voltage signal. Accordingly, the AC voltage signal can be provided from higher voltage AC voltage signals, regardless of the phase type. For example, in some embodiments of the present subject matter, the AC voltage signal can be provided from a three phase 600 VAC signal. In still further embodiments of the present subject matter, the AC voltage signal can be a relatively low voltage signal, such as approximately 12 VAC.

In certain embodiments, a lighting apparatus as described herein receives an AC input signal from an AC power source via an AC power cord arranged to plug into a conventional wall receptacle, with one end of the power cord comprising a two- or three-conductor male plug, and the other end of the power cord terminating in or on the lighting apparatus.

In certain embodiments, a lighting apparatus as described herein is devoid of any AC-to-DC converter in electrical communication between the AC power source and multiple sets (e.g., disposed in an array) of solid state light emitters. In certain embodiments, a lighting apparatus as described herein comprises at least one current diversion circuit (or multiple current diversion circuits in certain embodiments) arranged in electrical communication between an AC source and multiple sets of solid state light emitters. In certain embodiments, a lighting apparatus as described herein comprises at least one current limiting circuit (or multiple current limiting circuits in certain embodiments) arranged in electrical communication between an AC source and multiple sets of solid state light emitters. In certain embodiments, a lighting apparatus as described herein comprises at least one driving circuit (or multiple driving circuits in certain embodiments) arranged in electrical communication between an AC source and multiple sets of solid state light emitters. In certain embodiments, a lighting apparatus as described herein comprises at least one rectifier bridge (or multiple rectifier bridges in certain embodiments) arranged in electrical communication between an AC source and multiple sets of solid state light emitters.

In certain embodiments, a lighting apparatus as described herein includes multiple sets of solid state light emitters that are configured to be activated and/or deactivated at different times relative to one another during a portion of an AC cycle, and each set of the multiple sets comprises at least a first solid state light emitter of a first color and at least a second solid state light emitter of a second color that is different than the first color. In certain embodiments, each set of the multiple sets comprises at least two solid state light emitters of a first color. In certain embodiments, each set of the multiple sets of solid state emitters is adapted to emit one or more of the same color(s) of light (e.g., to emit one or more peak wavelengths that coincide among multiple sets of emitters). In certain embodiments, each set of the multiple sets of solid state emitters is adapted to emit one or more color(s) of light that differ relative to one another. (e.g., with each set of solid state emitters emitting at least one peak wavelength that is not emitted by another set of solid state emitters).

In certain embodiments, a lighting apparatus as described herein includes multiple sets of solid state light emitters that are configured to be activated and/or deactivated at different times relative to one another during a portion of an AC cycle, and the lighting apparatus comprises an output of preferably at least about 70 lumens per watt (LPW), more preferably at least about 80 LPW, more preferably at least about 90 LPW, and still more preferably at least about 100 LPW. Preferably, one or more of the foregoing LPW thresholds are attained for emissions having at least one of a cool white color temperature and a warm white color temperature. Preferably, white emissions have x, y color coordinates within four MacAdam step ellipses of a reference point on the blackbody locus of a 1931 CIE Chromaticity Diagram. In certain embodiments, such a reference point on the blackbody locus may have a color temperature of preferably less than or equal to 5000 K, more preferably less than or equal to 4000 K, more preferably less than or equal to 3500 K, or more preferably less than or equal to 3000 K. In certain embodiments, combined emissions from a lighting apparatus as described herein embody at least one of (a) a color rendering index (CRI Ra) value of at least 85, and (b) a color quality scale (CQS) value of at least 85.

In certain embodiments, a lighting apparatus as described herein includes an array of solid state light emitters arranged on or supported by a substrate, with the array including a plurality of solid state light emitter sets each comprising multiple solid state emitters, wherein multiple sets of solid state light emitters are configured to be activated and/or deactivated at different times relative to one another during a portion of an AC cycle, and within the array, at least one solid state light emitter of a first solid state light emitter set is arranged closer to at least one solid state emitter of a second solid state light emitter set than to any other solid state light emitter of the first solid state light emitter set. Such placement may be beneficial to avoid or reduce perceptible spatial variations in light intensity and/or color, and/or may be beneficial for managing heat dissipation from a lighting device. In certain embodiments, the multiple sets of solid state light emitters include at least two sets having different duty cycles (e.g., including a largest duty cycle and a smallest duty cycle). In certain embodiments, at least a majority of solid state light emitters comprising the smallest duty cycle are arranged in a central region of a substrate, and at least a majority of solid state light emitters comprising the largest duty cycle are arranged in a peripheral region of the substrate.

In certain embodiments, a lighting apparatus as described herein includes multiple sets of solid state light emitters that are configured to be activated and/or deactivated at different times relative to one another during a portion of an AC cycle, wherein, for a majority of solid state light emitters of a first solid state emitter set, each solid state light emitter of the majority of solid state light emitters is arranged closer to at least one solid state emitter of a second solid state light emitter set than to any other solid state light emitter of the first solid state light emitter set.

In certain embodiments, a lighting apparatus as described herein includes an array of solid state light emitters arranged on or supported by a substrate, with the array including a plurality of solid state light emitter sets each comprising multiple solid state emitters, wherein at least two different solid state light emitter sets of the plurality sets are adapted to be activated and/or deactivated at different times relative to one another during a portion of an AC cycle, wherein the at least two different solid state light emitter sets comprise different duty cycles, wherein the array comprises multiple solid state light emitters distributed across a central portion of the substrate, and comprises multiple solid state light emitters distributed across a peripheral portion of the substrate, and wherein the central portion comprises more solid state light emitters than the peripheral portion. In certain embodiments, the central portion of the substrate comprises less than or equal to about 65%, less than or equal to about 50%, less than or equal to about 40%, less than or equal to about 30%, less than or equal to about 15%, or less than or equal to about 10% of a total surface area of one face of the substrate. In certain embodiments, the peripheral portion circumscribes the central portion of the substrate. In certain embodiments, the central portion and the peripheral portion in combination comprise at least one of the following: concentric circles, concentric squares, concentric rectangles, or other concentric polygonal shapes of the same type.

In certain embodiments, a first solid state light emitter set of the at least two different solid state emitter sets comprises a smallest duty cycle of the different duty cycles, a second solid state light emitter set of the at least two different solid state emitter sets comprises a largest duty cycle of the different duty cycles, at least a majority of solid state emitters of the first solid state light emitter set is disposed in the central portion of the substrate, and at least a majority of solid state emitters of the second solid state light emitter set is disposed in the peripheral portion of substrate. In certain embodiments, a central portion of a substrate of a solid state lighting apparatus contains solid state emitters having a greater aggregated light emission area than a peripheral portion of the substrate. In certain embodiments, a plurality of solid state light emitter sets comprises at least three different solid state light emitter sets arranged to be activated and/or deactivated at different times relative to one another.

In certain embodiments, a lighting apparatus includes an array of solid state light emitters arranged or supported by a common substrate and including a plurality of solid state light emitter sets each comprising multiple solid state light emitters, wherein at least two different solid state light emitter sets of the plurality of solid state light emitter sets are arranged to be activated and/or deactivated at different times relative to one another during a portion of an AC cycle, wherein the array is distributed across a region of the substrate, and wherein, for each set of the solid state light emitter sets, the multiple solid state light emitters are symmetrically arranged within or along the region. In certain embodiments, for each solid state light emitter set, the multiple solid state light emitters are arranged with azimuthal or rotational symmetry within or along the region. In certain embodiments, for each solid state light emitter set, the multiple solid state light emitters are arranged with lateral symmetry within or along the region.

In certain embodiments, a lighting apparatus includes an array of solid state light emitters arranged or supported by a common substrate and including a plurality of solid state light emitter sets each comprising multiple solid state light emitters, wherein at least two different solid state light emitter sets of the plurality of solid state light emitter sets are arranged to be activated and/or deactivated at different times relative to one another during a portion of an AC cycle, wherein the lighting device comprises at least one of the following features: (a) at least one solid state light emitter set of the plurality of solid state light emitter sets is arranged to emit at least one peak wavelength that differs by at least 30 nm from at least one peak wavelength emitted by at least one other solid state light emitter set of the plurality of solid state light emitter sets; and (b) at least one solid state light emitter set of the plurality of solid state light emitter sets is arranged to emit a first peak wavelength and to emit a second peak wavelength that differs from the first peak wavelength by at least 30 nm. In certain embodiments, both of the foregoing features (a) and (b) may be present. In certain embodiments, at least two different solid state emitter sets comprise different duty cycles relative to one another, or at least three different solid state light emitter sets arranged to be activated and/or deactivated at different times relative to one another.

In certain embodiments, a first solid state light emitter set includes a plurality of LED chips adapted to generate peak emissions in a blue range and arranged to stimulate at least one phosphor adapted to generate peak emissions in a yellow range or a green range, and a second solid state light emitter set includes a plurality of LED chips adapted to generate peak emissions in an orange range or a red range.

In certain embodiments, color temperature of aggregated emissions of a lighting apparatus adapted to operate with alternating current (AC) received from an AC power source may be adjusted by adjusting duty cycle of one or more sets of multiple sets of solid state emitters that are each separately arranged to emit white light but at different color temperatures.

In certain embodiments, a lighting apparatus includes an array of solid state light emitters arranged or supported by a common substrate and including a plurality of solid state light emitter sets each comprising multiple solid state light emitters, wherein at least three different solid state light emitter sets of the plurality of solid state light emitter sets are arranged to be activated and/or deactivated at different times relative to one another during a portion of an AC cycle, and wherein each solid state light emitter set of the at least three different solid state light emitter sets is independently arranged to emit light having x, y color coordinates within four MacAdam step ellipses of a reference point on the blackbody locus of a 1931 CIE Chromaticity Diagram and having a color temperature that differs by at least 400 K relative to a color temperature of each other solid state light emitter set of the at least three different solid state light emitter sets. Utilization of multiple sets of solid state emitters with each set arranged to generate white light of different color temperatures permits color temperature of the aggregated emissions to be adjusted by varying the duty cycle of the respective solid state emitter sets. In certain embodiments, a control element may be arranged to permit adjustment of duty cycle of each solid state light emitter set of the at least three different solid state light emitter sets, and thereby permit adjustment of color temperature. In certain embodiments, at least three different solid state light emitter sets in combination are arranged to emit light having x, y color coordinates within two MacAdam step ellipses of a reference point on the blackbody locus of a 1931 CIE Chromaticity Diagram.

In certain embodiments, beam patterns output from a solid state lighting device may be adjusted by adjusting duty cycles of different solid state light emitter sets, preferably without use of any mechanical elements. In certain embodiments, different sets of solid state light emitters are arranged differently with respect to at least one reflector and/or at least one optical element to permit such beam pattern adjustment.

In certain embodiments, a lighting apparatus includes an array of solid state light emitters arranged on or supported by a body structure and including a plurality of solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; at least one reflector and/or at least one optical element arranged to receive emissions from the plurality of solid state light emitter sets, and arranged to affect a beam pattern generated by the lighting device; and a control element arranged to permit adjustment of duty cycle of each solid state light emitter set of the at least two solid state light emitter sets, and thereby permit adjustment of said beam pattern. In certain embodiments, both at least one reflector and at least one optical element may be provided. In certain embodiments, a first reflector or first reflector portion may be arranged to receive emissions from a first solid state light emitter set of the plurality of solid state light emitter sets, and a second reflector or second reflector portion may be arranged to receive emissions from a second solid state light emitter set of the plurality of solid state light emitter sets. In certain embodiments, a first optical element portion may be arranged to receive emissions from a first solid state light emitter set, and a second optical element portion may be arranged to receive emissions from a second solid state light emitter set.

In certain embodiments, a lighting apparatus is adapted to operate with alternating current (AC) received from an AC power source, and the lighting apparatus includes: a first array of solid state light emitters arranged on or supported by a first substrate and including a first plurality of solid state light emitter sets each comprising multiple solid state light emitters, wherein at least two different solid state light emitter sets of the first plurality of solid state light emitter sets are arranged to be activated and/or deactivated at different times relative to one another during a portion of an AC cycle; a second array of solid state light emitters arranged on or supported by a second substrate and including a second plurality of solid state light emitter sets each comprising multiple solid state light emitters, wherein at least two different solid state light emitter sets of the second plurality of solid state light emitter sets are arranged to be activated and/or deactivated at different times relative to one another during a portion of an AC cycle; and a support plate comprising a plurality of substrate mounting regions including a first substrate mounting region arranged to receive the first substrate and including a second substrate mounting region arranged to receive the second substrate. In certain embodiments, the first substrate may include a first circuit board (e.g. a PCB, including but not limited to a metal core PCB), and the second substrate may include a second printed circuit board. In certain embodiments, the support plate may include a heatsink in conductive thermal communication with the first substrate and the second substrate. Such heatsink may include multiple fins arranged to dissipate heat into a heat exchange apparatus or an ambient environment (e.g., an ambient air environment). In certain embodiments, the support plate may include a reflector arranged to reflect emissions from at least some emitters of the first array of solid state emitters, and to reflect emissions from at least some emitters of the second array of solid state emitters. In certain embodiments, the first substrate mounting region may include a first plurality of electrical conductors or contacts arranged in electrical communication with the first substrate and the first array of solid state emitters, and the second substrate mounting region may include a second plurality of electrical conductors or contacts arranged in electrical communication with the second substrate and the second array of solid state emitters. In certain embodiments, the first substrate mounting region may include a first socket, and the second substrate mounting region may include a second socket.

Various illustrative features are described below in connection with the accompanying figures.

FIG. 1 is a schematic block diagram illustrating a solid state lighting apparatus generally designated 10 according to some embodiments of the present subject matter. According to FIG. 1, the solid state lighting apparatus 10 can include a light emitting diode (LED) driver circuit 12 coupled to a LED string circuit 14, both of which can be mounted on a surface of a substrate 16. The term "mounted on" as used herein includes configurations where the component, such as a LED chip or submount of a LED package, can be physically and/or electrically connected to a portion of substrate 16 via solder, epoxy, silicone, adhesive, glue, paste, combinations thereof and/or any other suitable attachment material and/or method. Accordingly, different components that are described as being "mounted on" a substrate can be disposed on the same surface of a substrate, or on opposing surfaces of the same substrate. For example, components that are placed and soldered on the same substrate during assembly can be described as being "mounted on" that substrate.

The LED driver circuit 12 can be coupled to an AC voltage power source, which can provide an alternating electrical signal (current and voltage) to at least one LED string circuit 14, and other circuits included in the solid state lighting apparatus 10, to cause light to be emitted from solid state lighting apparatus 10. The at least one LED string circuit 14 can comprise multiple solid state light emitters, such as LED chips, preferably arranged as multiple groups or sets of LEDs, wherein each group or set is preferably separately controllable relative to each other group or set. In certain embodiments, LED string circuit 14 can comprise a multi-dimensional (e.g., two-dimensional) array of LED chips. The LED chips can be optionally arranged in one or more mutually exclusive groups, segments, or sets of LED chips. In one aspect, LED string circuit 14 comprises an array of LED chips arranged in mutually exclusive sets of one or more (preferably multiple) LED chips.

It will be appreciated that various embodiments described herein can make use of the direct application of AC voltage to apparatus 10 (e.g., from an outside power source, not shown) without the inclusion of an "on-board" switched mode power supply. That is, various embodiments relate to devices that are devoid of any AC-to-DC converter in electrical communication between the AC power source (not shown) and multiple groups of LED chips. In certain embodiments, a LED driver circuit 12 can output current including a rectified AC waveform to LED string circuit 14 to generate acceptable light output from the lighting apparatus 10. It can further be appreciated that solid state lighting apparatus 10 can be utilized in light bulbs, lighting devices, and/or lighting fixtures of any suitable type, such as, for example and without limitation, the various lighting devices illustrated in FIGS. 9, 10A, and 10B.

Figure 3:
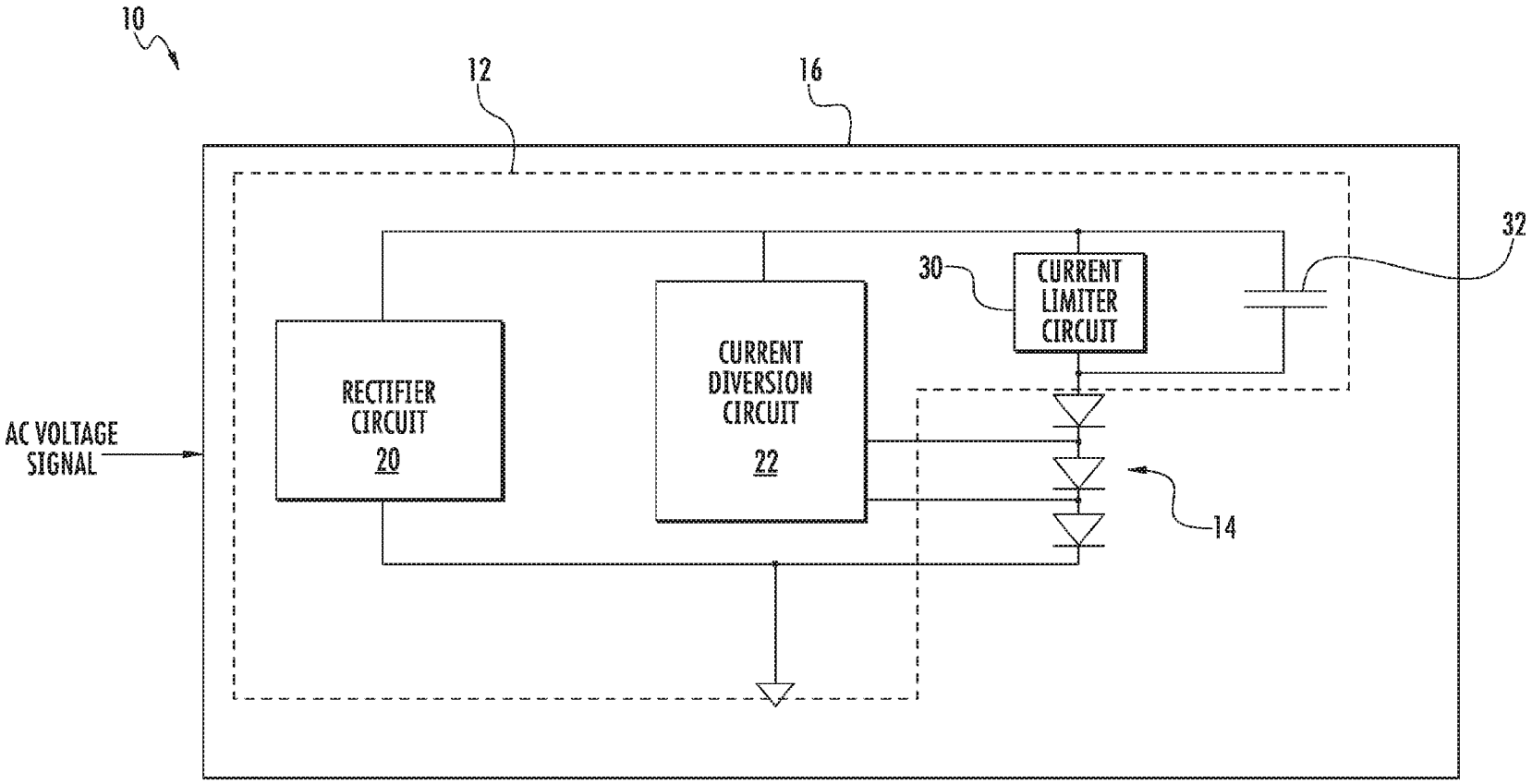
FIG. 3 is a schematic block diagram illustrating the LED driver circuit shown in FIGS. 1 and 2 further including a current limiter circuit and a capacitor coupled to the LED string circuit according to certain embodiments.

In certain embodiments, a LED driver circuit 12 can include one or more of the following: components used to rectify the AC voltage signal, components to provide an electrical current source to at least one LED string circuit 14, components for at least one current diversion circuit, components for at least one current limiting circuit (e.g., to limit the amount of current passing through at least one LED chip and/or set of LED chips in LED string circuit 14), and at least one energy storage device, such as a capacitor 32 (such as shown in FIG. 3). In certain embodiments, one or more of the foregoing components can be mounted or disposed on a portion of substrate 16 as discrete elements. In further embodiments of the present subject matter, some or all of the foregoing circuit elements described herein can be combined or otherwise integrated into one or more integrated circuits or circuit packages mounted or disposed on a portion of substrate 16.

LED string circuit 14 can include a plurality of "chip-on-board" (COB) LED chips and/or packaged LED chips that can be electrically coupled or connected in series or parallel with one another and mounted on a portion of substrate 16. In certain embodiments, COB LED chips can be mounted directly on portions of substrate 16 without the need for additional packaging. In certain embodiments, LED string circuit 14 can make use of packaged LED chips in place of the COB LED chips. For example, in certain embodiments, LED string circuit 14 can comprise serial or parallel arrangements of XLamp XM-L High-Voltage (HV) LED packages available from Cree, Inc. of Durham N.C.

In certain embodiments, a solid state lighting apparatus 10 can comprise a relatively small form factor board or substrate 16, which can be directly coupled to an AC voltage signal and can provide a rectified AC voltage signal to string circuit 14 without the use of an on-board switched mode power supply. COB LED chips and/or LED packages within circuit 14 can be electrically connected in serial arrangements, parallel arrangements, or combinations thereof.

Figure 7A:
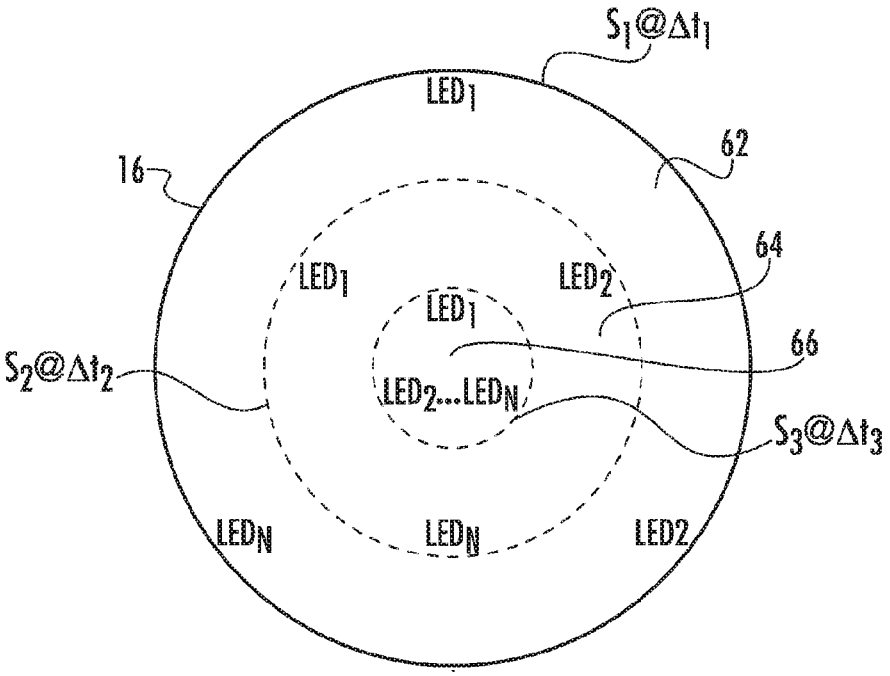
FIG. 7A is a schematic diagram illustrating LED chips and/or LED packages arranged in overlapping concentric circular (or annular) regions over a substrate according to certain embodiments.
Figure 7B:
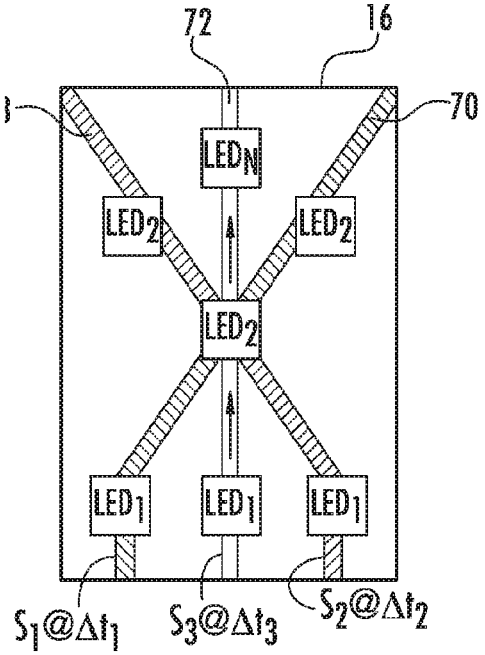
FIG. 7B is a schematic diagram illustrating LED chips and/or LED packages arranged relative to crossing or overlapping traces and/or electrical circuitry components arranged over a substrate according to certain embodiments.
Figure 7C:
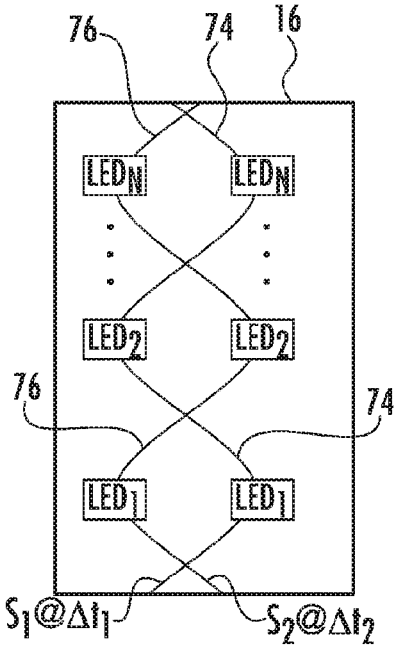
FIG. 7C is a schematic diagram illustrating LED chips and/or LED packages arranged relative to crossing or overlapping traces and/or electrical circuitry arranged over a substrate according to certain embodiments
Figure 8:
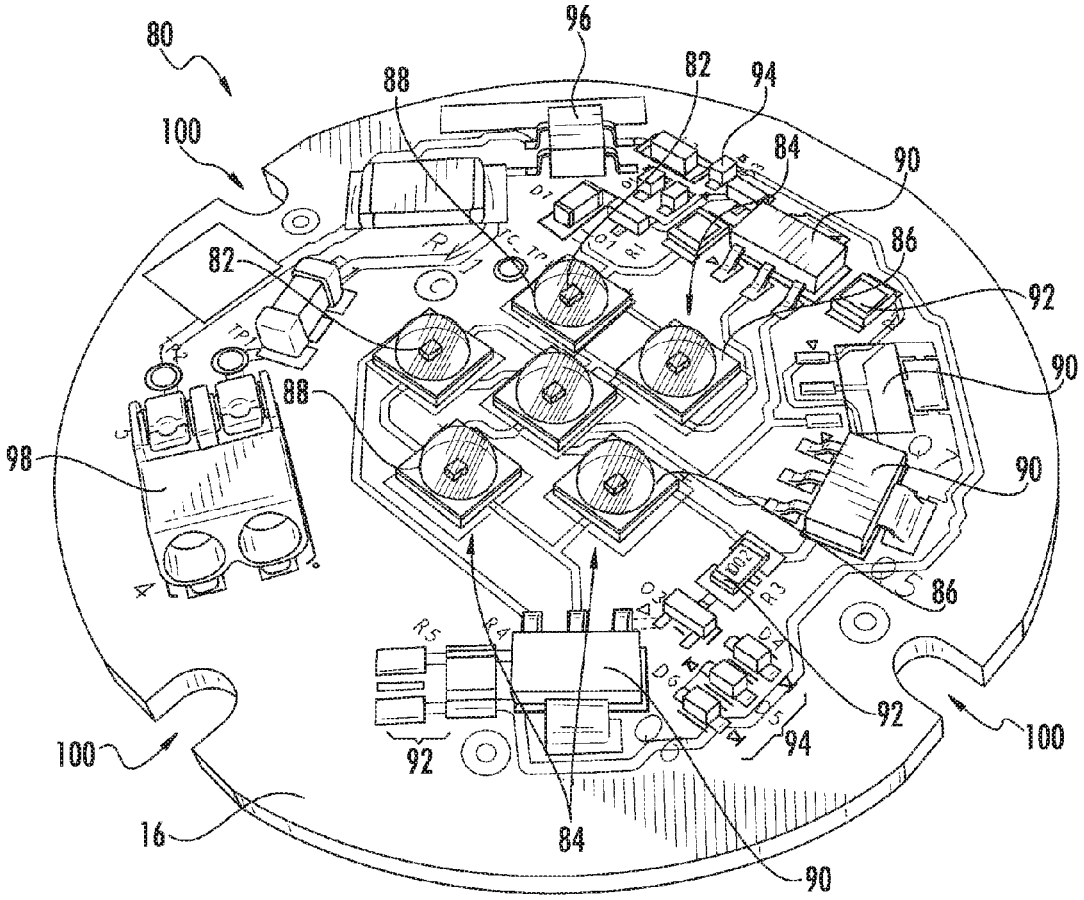
FIG. 8 is a perspective view illustrating a solid state lighting apparatus including multiple solid state light emitters and associated circuitry arranged on or over a substrate according to certain embodiments.

In certain embodiments, a substrate 16 can be provided in any relatively small form factor (e.g., square, round, non-square, non-round, symmetrical, and/or asymmetrical) such as those described herein in reference to FIGS. 7A to 8. Further, the resulting small board with COB LED chips or LED packages included thereon operated by the direct application of AC voltage signal (i.e., without an on-board switched mode power supply) can provide a small and efficient output lighting apparatus 10 that can deliver approximately 70 lumens per Watt (LPW) or more in select color temperatures, such as cool or warm white color temperatures (e.g., from approximately 2700 to 7000 K).

In other embodiments, a substrate 16 may comprise a larger form factor, such as may be suitable for replacement of elongated fluorescent tube-type bulbs or replacement of fluorescent light fixtures.

Figure 2:
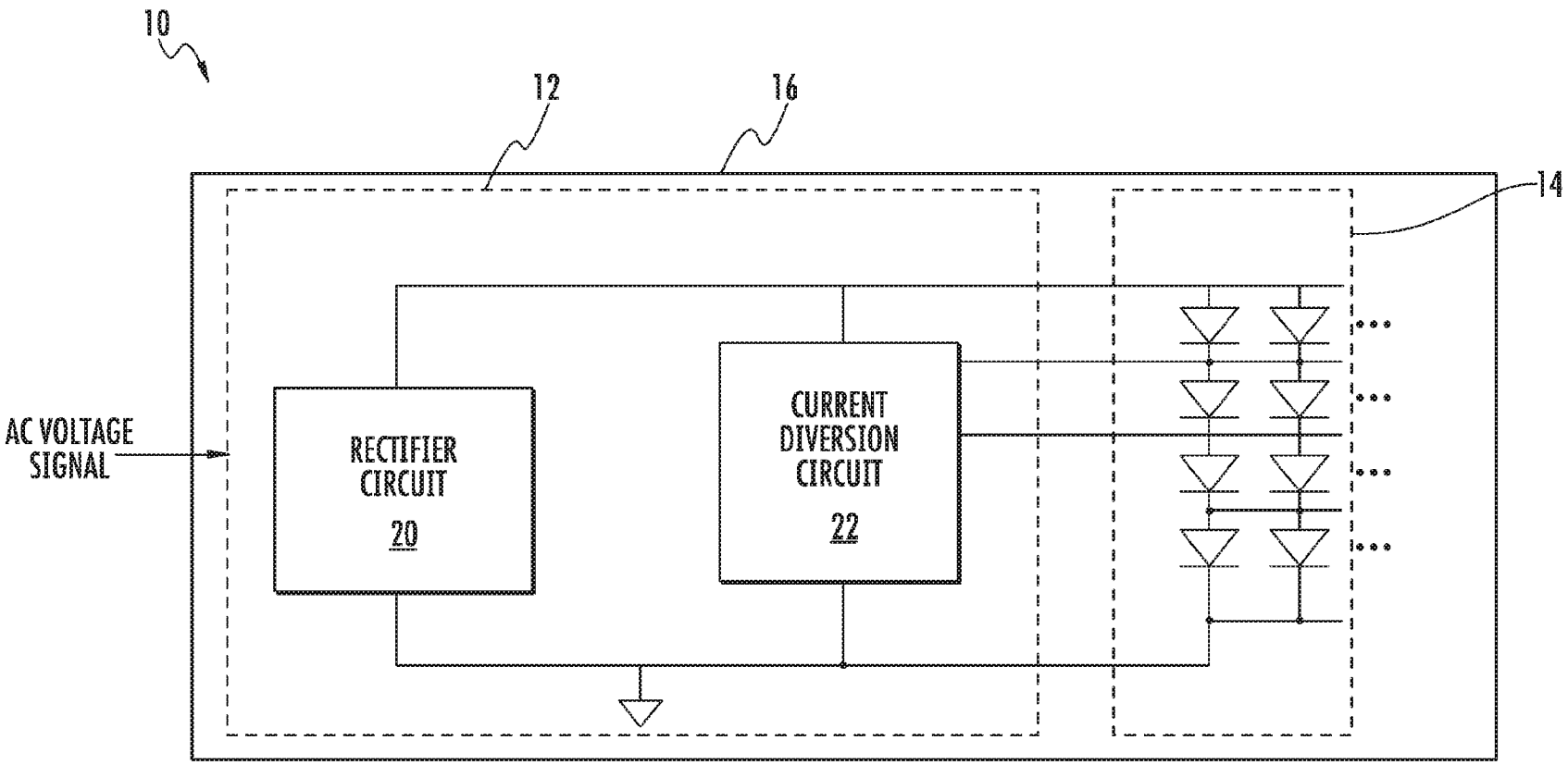
FIG. 2 is a schematic block diagram illustrating the LED driver circuit including a rectifier circuit and a current diversion circuit as shown in FIG. 1 and a LED string circuit coupled thereto according to certain embodiments.

FIG. 2 is a schematic block diagram illustrating solid state lighting apparatus 10 as shown in FIG. 1 as applied to certain embodiments. According to FIG. 2, LED driver circuit 12 can include a rectifier circuit 20 coupled to a current diversion circuit 22 and LED string circuit 14. In certain embodiments, LED string circuit 14 can comprise at least one plurality of LED chips and/or LED packages coupled in series and more preferably multiple sets of multiple LED chips and/or LED packages. As further shown in FIG. 2, current diversion circuit 22 can be coupled to selected nodes between one or more sets of LED chips and/or LED packages in string circuit 14.

Current diversion circuit 22 can be configured to operate responsive to a bias state transition of those sets of respective LED chips or LED packages across which current diversion circuit 22 is coupled. In certain embodiments, LED chips or packages within string circuit 14 can be incrementally activated and de-activated responsive to the forward biasing of LED sets as a rectified AC voltage is applied to LED string circuit 14. For example, current diversion circuit 22 can include transistors configured to provide respective controllable current diversion paths around certain LED sets disposed between the selected nodes to which current diversion circuit 22 is coupled. Such transistors can be turned on or off by the biasing transitions of LED sets which can be used to affect the biasing of the transistors. Current diversion circuits 22 operating in conjunction with a LED string circuit 14 are further described, for example, in commonly assigned co-pending U.S. application Ser. No. 13/235,127, the entirety of which is incorporated by reference herein. Current diversion circuit 22 can activate and/or deactivate different LED sets at different times relative to one another during a portion of an AC cycle as explained further below. In certain embodiments, and as explained below, solid state lighting apparatus 10 can comprise multiple LED sets having different duty cycles. In various embodiments, multiple LED sets can be provided and strategically positioned over portions of substrate 16 to reduce perceived flicker, perceived color shifts, and/or perceived (e.g., positional or directional) flux variation during activation and/or deactivation of the respective LEDs.

As further shown in FIG. 2, in certain embodiments, rectifier circuit 20, current diversion circuit 22, and LED string circuit 14 can be mounted or disposed on a portion of substrate 16 such that each of these components is provided on a single surface of the substrate 16. In certain embodiments, some of the circuits described herein are mounted on a first side of the substrate 16 whereas the remaining circuits are mounted on an opposing side of substrate 16. In certain embodiments, the circuits described herein can be mounted directly on the substrate 16 without the use of intervening substrates, submounts, carriers, or other types of surfaces which are sometimes used to provide stacked types of assemblies in conventional arrangements.

In certain embodiments, some or all of the components described in reference to FIG. 2 can be mounted on the substrate 16 as discrete electronic component packages. In certain embodiments, some of the remaining circuits described in reference to FIG. 2 can be integrated into a single integrated circuit package mounted on the substrate 16.

In certain embodiments, solid state lighting apparatus 10 can may include one or more current diversion circuits 22 coupled to portions of string circuit 14 alone without use of a current limiter circuit 30 (FIG. 3) and capacitor 32 (FIG. 3). That is, in certain embodiments, current diversion circuit 22 can be used alone to selectively activate and/or deactivate sets of LED chips and/or packages within circuit 14 without the need for current limiter circuit 30 and/or capacitor. However, as current limiter circuit 30 can be configured to supply current to capacitor 32 instead of LED chips within circuit 14, in certain embodiments current and/or energy can advantageously be stored within capacitor 32 and/or configured to discharge charge from capacitor 32 through LED string circuit 14 during portions of the rectified AC waveform in order to reduce or eliminate perceived flicker and/or observable color change during activation and/or deactivation of one or more LED sets.

In certain embodiments, apparatuses 10 as described herein can provide at least about 700 lumens (lm), or provide approximately 700 lumens (lm) to approximately 820 lm, an efficacy ranging from between about 71 LPW and about 80 LPW at cool or warm white color temperatures. It will be understood that in certain embodiments, however, that greater output may be achieved by, for example, increasing the number of LED chips and/or packages or by increasing the current signal or level used to drive the LED chips or packages.

Figure 4:
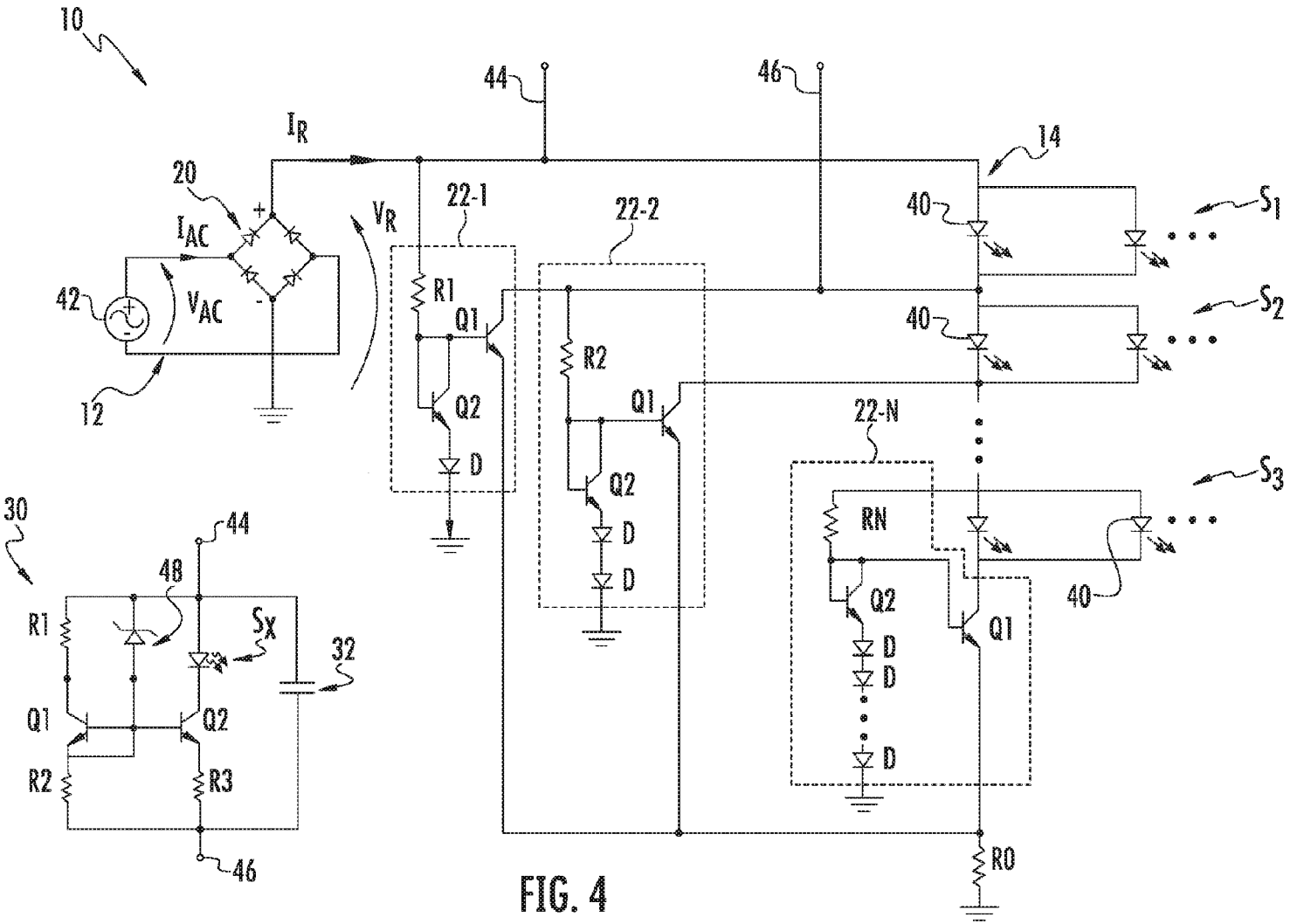
FIG. 4 is a circuit schematic diagram illustrating a LED driver circuit coupled to a LED string circuit according to certain embodiments.

FIG. 3 is a schematic block diagram illustrating solid state lighting apparatus 10 including LED driver circuit 12 according to certain embodiments. LED driver circuit 12 may include rectifier circuit 20 and one or more current diversion circuits 22-1, 22-2, . . . , 22-N (as shown in FIG. 4) connected to respective LED strings within string circuit 14. In certain embodiments, driver circuit 12 can be coupled to current limiter circuit 30, which can be connected in parallel to a capacitor 32, both of which are optional and can be coupled in series with LED string circuit 14. In certain embodiments, driver circuit 12, rectifier circuit 20, current diversion circuit 22, string circuit 14, and current limiter circuit 30 can all be mounted on one or more portions of the same and/or different surfaces of substrate 16.

It will be understood that current limiter circuit 30 and capacitor 32 according to certain embodiments can advantageously reduce flicker which may otherwise result from the AC voltage provided directly to solid state light emitters of solid state lighting apparatus 10. For example, capacitor 32 can be used to store energy (e.g., near peak voltage) and use that stored energy to drive portions of LED string 14 (e.g., one or more LED sets) when the AC voltage magnitude is less than what may be required to forward bias the LED chips or packages in string circuit 14. Still further, current limiter circuit 30 can be configured to direct current to capacitor 32 so that energy is stored therein or configured to discharge the charge in capacitor 32 through LED string circuit 14. Although FIG. 3 shows a capacitor 32 as being used to store and deliver energy, it is also understood that in certain embodiments any type of electronic energy storage device (e.g., including but not limited to inductors) can be used as an alternative to or, in combination with, capacitor 32.

In certain embodiments, the components shown in FIG. 3 can be mounted on the same surface of the substrate 16 and/or one or more different surfaces. For example, in certain embodiments, some circuits shown in FIG. 3 can be mounted on a first surface of substrate 16 whereas the remaining circuits can be mounted on a second, opposing surface of substrate 16. In certain embodiments, LED chips included in the LED string circuit 14 may include COB LED chips that may be mounted on any surface of substrate 16 or on a submount or other substrate which is coupled to the substrate 16, for example, a submount of a LED package. Components of solid state lighting apparatus 10 can be mounted on any surface and/or any combination of different surfaces.

FIG. 4 is a circuit schematic diagram of solid state lighting apparatus 10 according to certain embodiments. FIG. 4 illustrates LED driver circuit 12 coupled to LED string circuit 14. In certain embodiments, string 14 can comprise a string of serially connected sets of solid state emitters, such as sets of LED chips (which can be packaged LED chips or COB) generally designated $S_1, S_2, \ldots, S_N$. In certain embodiments each LED set $S_1, S_2, \ldots, S_N$ can be mutually exclusive and can comprise at least one packaged or non-packaged LED chip 40. In certain embodiments each set $S_1, S_2, \ldots, S_N$ can also comprise more than one packaged or non-packaged LED chip 40.

Where multiple LED chips 40 are used, chips 40 within a given set $S_1, S_2, \ldots, S_N$ can be arranged in series, parallel, and/or combinations thereof. In certain embodiments, each LED set $S_1, S_2, \ldots, S_N$ can be configured to be activated and/or deactivated at different times. In certain embodiments, LED sets $S_1, S_2, \ldots, S_N$ can be sequentially activated and deactivated in the reverse order. Notably, LED sets $S_1, S_2, \ldots, S_N$ can be strategically arranged on portion of substrate 16 such that color and light output from apparatus 10 can be consistently maintained (e.g., with no perceived flicker, perceived color shift, and/or perceived positional or directional flux variation) during activation and/or deactivation of different LED sets $S_1, S_2, \ldots, S_N$ at different times. In certain embodiments, each LED set $S_1, S_2, \ldots, S_N$ can comprise a plurality of LED chips arranged in one or more arrays comprised of serial and/or parallel arrangements.

In certain embodiments, LED chips 40 of each LED set $S_1, S_2, \ldots, S_N$ can comprise one or more chips of the same color (e.g., $S_1, S_2, \ldots, S_N$ can be the same color) or different colors (e.g., $S_1, S_2, \ldots, S_N$ can each be a different color). In certain embodiments, one or more LED sets $S_1, S_2, \ldots, S_N$ can comprise differently colored LED chips 40 within that set (e.g., intra-set). In certain embodiments each LED set $S_1, S_2, \ldots, S_N$ can comprise the same color combination as other sets (e.g., $S_1, S_2, \ldots, S_N$ can each have a blue, red, and green chip) or at least one set can have a color combination that differs from at least one other set (e.g., $S_1$ can have a blue, red, and green chip and $S_2$ can have a blue shifted yellow (BSY), cyan, and amber chip). In certain embodiments, multiple LED chips 40 having the same and/or any different combinations of color, wavelength, color temperature, and/or brightness may be provided.

As illustrated in FIG. 4, in certain embodiments each mutually exclusive LED set $S_1, S_2, \ldots, S_N$ can comprise more than one LED chip 40, where each LED chip 40 in the set is connected in parallel. Each LED set $S_1, S_2, \ldots, S_N$ can then be serially connected. However, in other embodiments, any other serial and/or parallel arrangement of LEDs may be provided. For example, parallel connected sets $S_1, S_2, \ldots, S_N$ and/or sets having serially connected and/or serial and parallel connected LED chips 40 may be provided. As noted earlier, each LED chip 40 can be, but does not have to be packaged. The sets of LED chips 40 may be configured in a number of different ways and may have various compensation circuits associated therewith, as discussed, for example, in commonly assigned co-pending U.S. application Ser. Nos. 13/235,103 and 13/235,127, the entire disclosures of which are incorporated herein by reference.

In certain embodiments, electrical power or signal can be provided to LED string 14 by a driver circuit 20 comprising a rectifier circuit 20 that is configured to be coupled to an AC power source 42 and to produce a rectified voltage $V_R$ and current $I_R$ therefrom. In certain embodiments, rectifier circuit 20 can comprise four diodes which prevent current from flowing in the negative direction, thereby producing a rectified AC waveform (e.g., 50, FIG. 5A). Any other suitable circuits for producing rectified AC waveforms are contemplated herein. In certain embodiments, driver circuit 20 may be included in lighting apparatus 10 or may be part of a separate unit that is coupled to apparatus 10.

In certain embodiments, apparatus 10 may include respective current diversion circuits 22-1, 22-2, . . . , 22-N connected to respective nodes and/or LED sets $S_1, S_2, \ldots, S_N$ of string circuit 14. Current diversion circuits 22-1, 22-2, . . . , 22-N can be configured to provide current paths that bypass respective LED sets $S_1, S_2, \ldots, S_N$. The current diversion circuits 22-1, 22-2, . . . , 22-N can each include at least one transistor Q1 configured to provide a controlled current path that may be used to selectively bypass one or more LED sets $S_1, S_2, \ldots, S_N$. Transistors Q1 can be biased using one or more second transistors Q2, one or more resistors R1, R2, . . . , RN and/or one or more diodes D. Second transistors Q2 can be configured to operate as diodes, with base and collector terminals connected to one another. Differing numbers of diodes D can be connected in series with second transistors Q2 in respective ones of current diversion circuits 22-1, 22-2, . . . , 22-N, such that the base terminals of current path transistors Q1 in the respective current diversion circuits 22-1, 22-2, . . . , 22-N can be biased at different voltage levels. Resistors R1, R2, . . . , RN can limit base currents for current path transistors Q1. Current path transistors Q1 of the respective current diversion circuits 22-1, 22-2, . . . , 22-N can turn off at different emitter bias voltages, which can be determined by a current flowing through apparatus resistor R0. Accordingly, current diversion circuits 22-1, 22-2, . . . , 22-N can be configured to operate in response to bias state transitions of the LED sets $S_1, S_2, \ldots, S_N$ as the rectified voltage $V_R$ increases and decreases such that the LED sets $S_1, S_2, \ldots, S_N$ can be incrementally and selectively activated and deactivated as the rectified voltage VR rises and falls. Current path transistors Q1 can be turned on and off as bias states of LED sets $S_1, S_2, \ldots, S_N$ change.

In certain embodiments, string circuit 14, including serially connected LED sets $S_1, S_2, \ldots, S_N$, can also be coupled in series with current limiter circuit 30. In certain embodiments, current limiter circuit 30 can comprise a current mirror circuit, although current limiter circuits of any suitable type may be used. In certain embodiments, current limiter circuit 30 can be connected at nodes 44 and 46 of apparatus 10 as shown in FIG. 4. When connected at nodes 44 and 46, one or more storage capacitors 32 can be coupled in parallel with string circuit 14 and serially connected LED sets $S_1, S_2, \ldots, S_N$ within current limiter circuit 30. Current limiter circuit 30 can be configured to limit current through string circuit 14 of serially connected LED sets $S_1, S_2, \ldots, S_N$ to an amount that is less than a nominal current provided to string circuit 14. Thus, current limiter circuit 30 can regulate current within apparatus 10 and provide current flow during all portions of a rectified AC waveform (e.g., FIG. 5A). This can provide uniform light and color emission, thereby reducing or eliminating perceptible flicker and/or color shifting.

In certain embodiments, current limiter circuit 30 can include first and second transistors Q1, Q2 and one or more resistors R1, R2, R3 connected in a current mirror configuration. The current mirror circuit can provide a current limit of approximately $(V_{LED}-0.7)/(RI+R2)\times(R2/R3)$. A voltage limiter circuit 48, e.g., a Zener diode, can also be provided to limit the voltage developed across the one or more storage capacitors 32. In this manner, the one or more storage capacitors 32 can be alternately charged via the driver circuit 12 comprised of the rectifier circuit and discharged via string circuit 14 of serially connected LED sets $S_1, S_2, \ldots, S_N$, which may provide more uniform illumination. In certain embodiments, current limiter circuit 30 can also be coupled to a LED set $S_X$, which is included among the plurality of LED sets $S_1, S_2, \ldots, S_N$ in string circuit 14. It is understood that LED set $S_X$ can include single LED chips 40 or multiple LED chips 40 coupled in parallel and/or series with one another. As noted earlier, each LED set $S_1, S_2, \ldots, S_N$ can be mutually exclusive and coupled in series with one another.

Figure 5A:
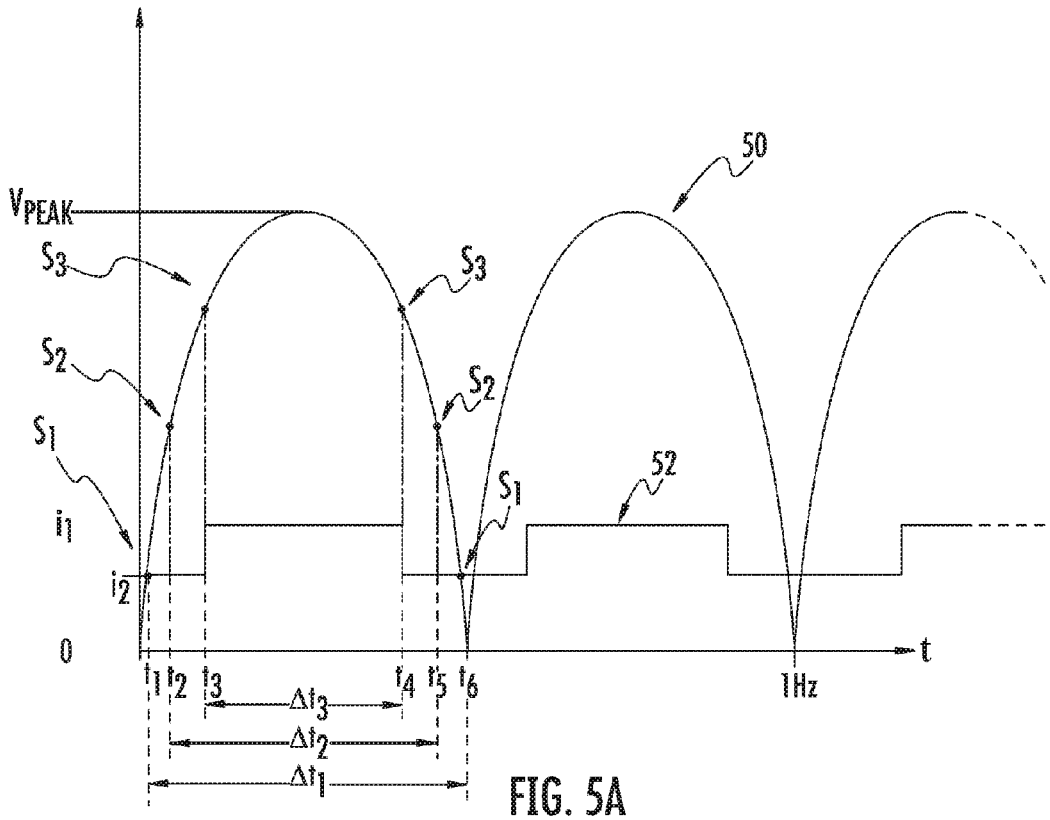
FIG. 5A is a plot of voltage versus time of a rectified AC waveform with a superimposed plot of activation and deactivation times for three LED sets S1, S2, S3, and a superimposed plot of average current with respect to time, of a solid state lighting apparatus according to certain embodiments.
Figure 5B:
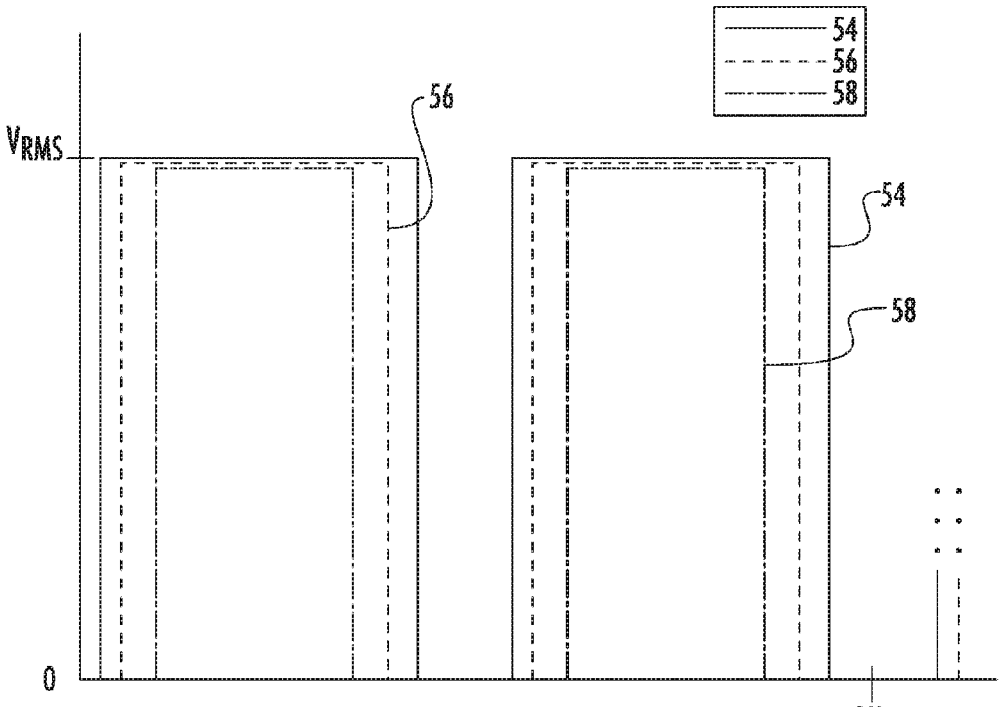
FIG. 5B is a plot of RMS voltage versus time showing duty cycles for three LED sets S1, S2, S3 of a solid state lighting device according to certain embodiments.

FIGS. 5A and 5B graphically illustrate aspects of operation of solid state lighting apparatuses 10 according to certain embodiments, with respect to voltage and/or current. Solid state apparatus 10 can receive AC input directly from an AC power source (not shown). The AC input can have a sinusoidal voltage waveform. As FIG. 5A illustrates, a rectifier circuit 20 (FIGS. 2 and 4) can comprise a full-wave rectifier which can convert the sinusoidal voltage waveform into a fully rectified AC waveform generally designated 50. As rectified AC waveform 50 goes from 0V to its peak voltage $V_{Peak}$, different LED sets $S_1, S_2, \ldots, S_N$ can be activated or turn "on" when the voltage is sufficient to run that LED set in addition to any one or more other LED sets that are already on. As the voltage decreases from peak voltage $V_{Peak}$ to 0V, LED sets can become deactivated or turn "off" in the opposite sequence. For example between 0V and $V_{PEAK}$, a first LED set $S_1$ can first become activated at time $t_1$. A second LED set $S_2$ can become activated at time $t_2$, where time $t_2$ is later than and/or occurs after time $t_1$. FIG. 5 also illustrates an optional third LED set $S_3$ becoming activated at time $t_3$ which is later than and/or occurs after times $t_1$ and $t_2$. The LED sets can then turn off in the opposite/reverse sequence. That is, third LED set $S_3$ can be deactivated first, at time $t_4$. Second LED set $S_2$ can be deactivated at time $t_5$, which occurs after time $t_4$ and finally first LED set $S_1$ can be deactivated at time $t_6$ which occurs after times $t_4$ and $t_5$.

In certain embodiments, each LED set can be "on" or active for a given time portion or time interval. For example, first LED set $S_1$ is active for a first time interval $\Delta t_1$ which is longer than second and third time intervals $\Delta t_2$ and $\Delta t_3$ that are associated with second and third LED sets $S_2$ and $S_3$, respectively. As FIG. 5A shows, second LED set $S_2$ is on for the second longest time $\Delta t_2$, and third LED set $S_3$ is on for the shortest amount of time, $\Delta t_3$ during one cycle of rectified AC waveform 50. The activation/deactivation sequence can be repeated over other portions of AC waveform. In certain embodiments, any number of LED sets can be used (e.g., up to an $N^{th}$ set, $S_N$), and each LED set can include one or multiple LED chips 40 (FIG. 4) of any contemplated color and/or color combinations. In certain embodiments utilizing including multiple LEDs in each set, such LEDs 40 (FIG. 4) in each LED set can comprise serial, parallel, or any combination of serial/parallel arrangements.

In certain embodiments, current (generally designated 52 in FIG. 5A) within solid state lighting apparatus 10 can be controlled via current limiter circuit 30 (see FIGS. 3 and 4) by limiting current $i_2$ through one or more LED sets $S_1, S_2, \ldots, S_N$ (see FIG. 4) to a value less than the total current $i_1$ supplied by driving circuit 12 (FIGS. 1 to 4). In certain embodiments, current $i_1$ can be limited to $i_2$ by diverting a portion of the total current $i_1$ to charge capacitor 32 (see FIGS. 3, 4). When activated, LED sets $S_1, S_2, \ldots, S_N$ can run at a constant current during each time interval in certain embodiments. An increase in current to the total current $i_1$ can turn on additional LED sets, for example, second and third LED sets $S_2$ and $S_3$. In certain embodiments, when the magnitude of the rectified AC voltage 52 falls below a certain level, such as at times $t_4$ and $t_5$ when $S_3$ and $S_2$ have been turned off, respectively, current $i_2$ through the one or more LED chips 40 in first LED set $S_1$ can be maintained by discharging the one or more storage capacitors 32. In this manner, the one or more LED chips 40 within each activated set can continue to be illuminated.

FIG. 5B graphically illustrates duty cycles associated with the LED sets depicted in FIG. 5A. A duty cycle is the time that each LED set spends in an active state as a fraction of the total time under consideration. In certain embodiments, each LED set $S_1, S_2, \ldots, S_N$ within a lighting apparatus 10 can comprise a different duty cycle. That is, in certain embodiments each LED set can be on and/or off for different amounts of time during a rectified AC waveform 50 (FIG. 5A). For example, a 30% duty cycle means that the set is "on" or activated for approximately 30% of the time and "off" or deactivated approximately 70% of the time; however, each emitter set is preferably activated and deactivated many times per second. For example, each LED set (e.g., $S_1$, $S_2$, and $S_3$ can turn on and off once time for each voltage zero crossing of a raw (input) AC waveform, or once time for each voltage minimum of a rectified AC waveform 50 (see FIG. 5A). If, for example, the AC input signal is supplied at 60 Hertz (60 cycles per second) with two zero crossings per cycle, then the rectified AC waveform will include 120 voltage minima per second, such that each LED set may be activated and deactivated 120 times per second.

In various embodiments, apparatuses described herein can be configured to activate and/or deactivate different LED sets at different and/or overlapping times to avoid perceptible flicker and to maintain color point (e.g., turn on/off the right color combinations to maintain a constant color point). For illustration purposes, only three LED sets have been illustrated as being activated and/or deactivated twice during one cycle of an input AC waveform; however, in certain embodiments, any suitable number of LED sets (e.g., 2, 3, 4, 5, 6, 7, 8, 9, or 10 or more LED sets) may be provided. In certain embodiments, LED sets may be activated and/or deactivated more than twice per cycle, and any suitable AC input frequency may be used to achieve a desired frequency of activation and/or deactivation for one or more LED sets of a solid state lighting apparatus.

In certain embodiments, LED sets are activated and deactivated at least 50, 60, 80, 100, 120, 160, 200, 240, or more time per second. Any suitable frequency of activation and deactivation of one or more LED sets be used to reduce and/or eliminate perceived flicker, perceived color shift, and/or perceived differences in luminous flux. In certain embodiments, LED sets $S_1, S_2, \ldots, S_N$ can also comprise overlapping duty cycles, where different LED sets can be activated (e.g., "on") and/or deactivated (e.g., "off") during portions of the same cycle and/or fraction of time.

In certain embodiments, the multiple sets can be configured to operate within (+/−) approximately 15 percent (%) of a root mean square (RMS) voltage $V_{RMS}$ of the AC power source. For illustration purposes in FIG. 5B, each LED set $S_1$, $S_2$, $S_3$ is shown as operating at a voltage approximately equal to RMS voltage $V_{RMS}$, however, in certain embodiments, one or more sets can operate approximately 15% more than or approximately 15% less than RMS voltage $V_{RMS}$. FIG. 5B illustrates that first LED set $S_1$ can comprise a first duty cycle 54. For illustration purposes, first LED set $S_1$ can be associated with first duty cycle 54, which can be the longest duty cycle and can range from approximately 25% approximately 100%. Second LED set $S_2$ can comprise a second duty cycle 56, and third LED set $S_3$ can comprise a third duty cycle 58. Second duty cycle 56 can be the second longest and third duty cycle 58 can be the shortest duty cycle. In certain embodiments, a solid state lighting apparatus 10 can have at least two LED sets having at least two different duty cycles, wherein the duty cycles are different and one duty cycle can be longer than the other. The longest duty cycle can range from approximately 25% to approximately 100% and any sub range therebetween such as approximately 25-50%; approximately 50-75%; and approximately 75-100%. The shortest duty cycle can range from approximately 1% to approximately 80%, and any sub ranges therebetween such as approximately 1-10%; approximately 10-20%; approximately 20-50%; and approximately 50-80%. In certain embodiments, any number of LED sets with appropriate duty cycle values may be provided. In certain embodiments, duty cycles of one or more LED sets may be adjusted.

In certain embodiments, relative numbers of solid state light emitters (e.g., LEDs) in different LED sets may be adjusted to enhance efficacy, with at least two different sets of LEDs in a single device embodying different numbers of LEDs. The inventors have discovered that in order to enhance efficacy, it is desirable to pick the LED counts in each LED set (e.g., string) such that $n_1 >= n_2 >= n_3 >= \ldots n_X$, were $n_1$ is the number of LEDs in the set that are on the longest (i.e., having the largest duty cycle), $n_2$ is the number of LEDs in the set that is on the next longest (i.e., having the second largest duty cycle), $n_3$ is the number of LEDs in the set that is on the next longest (i.e., having the third largest duty cycle), and so on, subject to the constraint that $n_1+n_2+n_3 \ldots n_X = N_{total}$, where $N_{total}$ is the total number of LED desired to be included in the lighting apparatus. Accordingly, in a solid state lighting apparatus adapted to operate with alternating current (AC) received from an AC power source, including multiple sets of solid state light emitters (e.g., arranged on or supported by a substrate), wherein at least first and second sets of the multiple sets of solid state light emitters are configured to be activated and/or deactivated at different times relative to one another during a portion of an AC cycle, and wherein the at least first and second sets of the multiple sets of solid state light emitters comprise different duty cycles, the apparatus preferably includes at least one of the following features (i) and (ii): (i) the first set of solid state light emitters comprises a largest duty cycle of the different duty cycles and consists of a greater number of solid state light emitters than any other set of the multiple sets of solid state light emitters; and (ii) the second set of solid state light emitters comprises a smallest duty cycle of the different duty cycles and consists of a smaller number of solid state light emitters of the multiple sets of solid state light emitters. In certain embodiments, at least a third set of solid state emitters (e.g., having a duty cycle intermediate between the first set and the second set) may be provided, with the third set of solid state emitters preferably having a number of solid state emitters intermediate (a) the number of solid state emitters contained in the first set and (b) the number of solid state emitters contained in the second set.

Figure 6A:
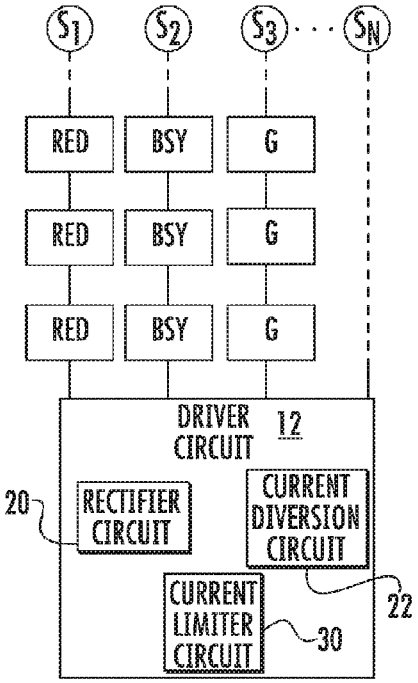
FIGS. 6A to 6C are schematic block diagrams illustrating LED sets and driver circuits of three solid state lighting apparatuses according to certain embodiments.
Figure 6B:
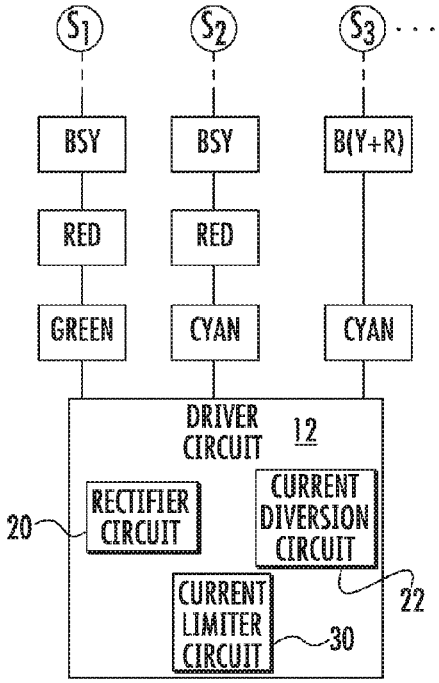
Figure 6C:
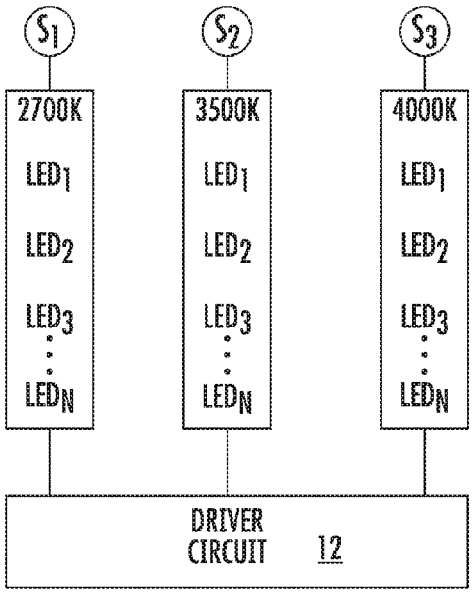

FIGS. 6A to 6C are schematic block diagrams illustrating LED sets of solid state lighting apparatuses according to certain embodiments. In particular, FIGS. 6A to 6C illustrate embodiments including variation LED chip color, phosphor color, and/or color temperature and different combinations thereof which as applied to LED sets $S_1, S_2, \ldots, S_N$ of solid state lighting apparatus 10. For illustration purposes, only three different embodiments are shown, however, any suitable combination of the same and/or differently colored LED chips or phosphor intra-set and/or inter-set (e.g., set-to-set) is contemplated herein. As described previously herein, and as shown in FIGS. 6A to 6C, in certain embodiments driver circuit 12 can comprise rectifier circuit 20 for producing a rectified AC waveform (FIG. 5A), current diversion circuit 22 for diverting current to activate and/or deactivate LED sets $S_1$, $S_2$, $S_3, \ldots, S_N$, and optional current limiter circuit 30 for charging and discharging capacitors to reduce flicker when a drop in voltage occurs. Driver circuit 12 can selectively supply current to one or more LED sets $S_1, S_2, S_3, \ldots, S_N$ to activate and deactivate each LED set at the same or different times and/or duty cycles relative to an AC waveform (e.g., relative to a rectified AC waveform according to FIG. 5A).

In certain embodiments, LED chip colors may be uniform (e.g., the same) within a set, but may differ from set to set. As illustrated in FIG. 6A, in certain embodiments each LED set $S_1, S_2, S_3, \ldots, S_N$ can comprise the same color of LED chips intra-set. That is, each set $S_1, S_2, S_3, \ldots, S_N$ can comprise one or more LED chips that are consistently and approximately the same primary color within the given set, but such chips may differ in color relative to LED chips within other sets. For example, first LED set $S_1$ can comprise one or more red LED chips, second LED set $S_2$ can comprise one or more blue shifted yellow (BSY) LED chips, and third LED set can comprise one or more green LED chips (generally designated G). Each set $S_1, S_2, S_3, \ldots, S_N$ can comprise a same color intra-set, but colors may differ between sets (inter-set color variation). In certain embodiments, each LED set $S_1$, $S_2$, $S_3, \ldots, S_N$ can comprise differently colored LED chips intra-set, but each set in the aggregate may include substantially the same color combination. For example, each set $S_1$, $S_2, S_3, \ldots, S_N$ can comprise the same color combination of differently colored LED chips and/or phosphors. For example, each set $S_1, S_2, S_3, \ldots, S_N$ can comprise at least one red chip, one BSY chip, and one green chip (e.g., differently colored LED chips intra-set) or any other combination of differently colored LED chips.

In certain embodiments, any combination and/or variation of one or more color of LED chips intra-set and/or inter-set are contemplated herein, whether provided as combinations of LED chip and/or LEDs in combination with differently colored lumiphors (e.g. phosphors). Certain embodiments may utilize LED chips that can individually be adapted to generate peak emissions and/or a peak wavelength in a blue range, a green range, cyan, a red range, red-orange, orange, amber, and/or in a yellow range light upon activation by electrical current. In certain embodiments, LED chips can be used alone or in combination with one or more lumiphors (e.g., phosphors) configured to generate peak emissions in a red range, a green range, a blue range, a yellow range, or any other desired color range upon activation or stimulation by light from one or more LED chips. At least one LED set can be adapted to emit at least one peak wavelength that differs by at least 30 nm from at least one peak wavelength emitted by at least one other LED chip in at least one other LED set. In further aspects, at least one LED set can be adapted to emit a first peak wavelength and to emit a second peak wavelength that differs from the first peak wavelength by at least 30 nm. Notably, driver circuit 12 can be configured to activate and/or deactivate different sets of LED chips without a perceptible shift in color point, color temperature, and/or without perceptible flicker. In part, this can be accomplished by intra-set and inter-set color selection, and/or by relative positioning of LED sets and/or their constituent LEDs.

In certain embodiments, during activation and deactivation of one or more LED sets, a color point of a lighting apparatus can be maintained (e.g., without a perceptible color shift). This can also be achieved in part by board or substrate 16 designs, and/or relative placement, LED chips having different colors and/or duty cycles. For example, as described below in FIGS. 7A to 7C, LED chips of different sets can become physically intermingled and/or strategically placed in an array adjacent or proximate each other over portions of substrate 16 (FIGS. 7A to 7C) such that upon activation and deactivation, LED chips of some LED sets can activate and compensate for color combinations that may be lost upon deactivation of some other LED sets. Such activation and deactivation of LED sets can be advantageous as it can conserve energy, improve thermal management, and/or improve reliability of lighting apparatus 10.

In certain embodiments, a lighting apparatus may include multiple sets of solid state emitters, wherein various sets include intra-set emitter color variation, together with variation in color between sets (inter-set color variation). FIG. 6B illustrates intra-set and inter-set color variation within LED sets $S_1, S_2, S_3, \ldots, S_N$ of a lighting apparatus 10. For example, first LED set $S_1$ can comprise LED chips including BSY, red, and green; a second LED set $S_2$ can comprise LED chips including BSY, red, and cyan; and a third LED set $S_3$ can comprise LED chips including blue shifted (yellow plus red) (e.g., B(Y+R)) and cyan. Any number of LED sets having any number of LED chips, including just one LED chip, is contemplated. FIG. 6B illustrates each LED set having color variation within that set (e.g., intra-set variation) together with color variation set-to-set (e.g., inter-set variation). Additional or different LED sets including suitable combinations of colors may be provided in certain embodiments.

In certain embodiments, emitter sets separately arranged to generate white emissions of different color temperatures may be combined in a lighting apparatus to permit color temperature of aggregated emissions to be varied. FIG. 6C illustrates LED sets targeting a specific color point or color temperature, such that an overall color temperature can be achieved and maintained during activation and/or deactivation of one or more LED sets. For example, first LED set $S_1$ comprises one or more LED chips (e.g., $LED_1$ to $LED_N$) where the illuminated chips can combine to emit approximately 2700 K, or a warm white color. Second set $S_2$ comprises one or more LED chips $LED_1$ to $LED_N$ targeting a second color temperature (that can be different than the color temperature of first LED set $S_1$ and third LED set $S_3$. As FIG. 6C further illustrates, second LED set $S_2$ includes different LED chips $LED_1$ to $LED_N$ which when illuminated can combine to emit light of approximately 3500 K or neutral white. Third set $S_3$ can include one or more LED chips which when illuminated can combine to emit light of approximately 4000 K or cool white. In certain embodiments, more or less than three sets of LED chips may be provided. Notably, LED sets $S_1, S_2, \ldots, S_N$ can combine to emit an overall color temperature which can be maintained during activation and deactivation of the different LED sets. In certain embodiments, color temperature of aggregated emissions from a lighting apparatus may be adjusted by altering duty cycle of one or more sets of LEDs. The 2700 K, 3500 K, and 4000 K color temperatures recited above are for illustration purposes only; in certain embodiments, one or more LED sets can target one or more color temperature ranging anywhere from approximately 2700 K to approximately 7000 K, or any warm white, neutral white, or cool white color temperatures.

In certain embodiments, lighting apparatuses described herein can comprise multiple sets of solid state light emitters, such as and without limitation, LED chips. In addition, different LED sets can comprise different ratios of differently colored LED chips, for example, different ratios of BSY chips, B(Y+R) chips, red chips, green chips, cyan chips, and/or combinations thereof, such that some activated sets can compensate for and/or maintain an overall color of apparatus 10 when other LED sets deactivate. Still referring to color choice for one or more LED chips and/or LED sets, three different LED emitter sets can be independently arranged to emit light having x, y color coordinates within approximately four MacAdam step ellipses of a reference point on the blackbody locus of a 1931 CIE Chromaticity Diagram and have a color temperature that differs by at least 400 K relative to a color temperature of each other LED set of the at least three different LED sets. More than three LED sets are contemplated.

FIGS. 7A to 7C schematically illustrate placement of LED sets over portions of a substrate 16. Each LED set can comprise one or more LED chips (e.g., $LED_1, LED_2, \ldots LED_N$) that may embody the same and/or different output color, color temperature, or color point as previously noted. LED chips can be directly mounted over portions of substrate 16 or packaged and portions of the LED package can be directly mounted over portions of substrate 16. Notably, LED chips of different LED sets ($S_1, S_2, \ldots, S_N$) can be strategically placed over portions of substrate 16 such that perceived color shifts and/or flicker that may occur during activation and deactivation of the different LED sets during various portions of a rectified AC cycle (see FIGS. 5A/5B) for different fractions of time can be greatly reduced and/or eliminated. As shown in FIG. 7A, FIG. 7A illustrates a substrate 16 that can be at least partially comprised of concentric or coaxial portions as indicated by broken or phantom lines. Substrate 16 can comprise any overall shape, for example, substrate 16 can be a substantially square, rectangular, circular, non-circular, symmetrically, and/or asymmetrically shaped board. Substrate 16 can comprise any size, for example, substrate 16 can comprise a substantially circular shaped board that is approximately 3 mm or more in diameter, approximately 4 mm or more in diameter, approximately 5 mm or more in diameter, approximately 7 mm or more in diameter, approximately 10 mm or more in diameter, or more than approximately 20 mm in diameter. In other aspects, substrate 16 can comprise a substantially square or rectangular shaped board having one side that is approximately 3 mm or more in length, approximately 5 mm or more in length, approximately 7 mm or more in length, approximately 10 mm or more in length, approximately 15 mm or more in length, approximately 20 mm or more in length, or more than approximately 30 mm in length. Substrate 16 can comprise any thickness, for example, approximately 0.5 mm or more, approximately 1 mm or more, approximately 2 mm or more, approximately 2.5 mm or more, approximately 3 mm or more, approximately 4 mm or more, or more than approximately 5 mm.

Different LED sets can be arranged over different portions of substrate 16. IN certain embodiments, one or more LED chips of one LED set can be physically intermingled, adjacent, and closely packed proximate one or more other LED chips of one or more other LED sets. In certain embodiments, LED chips of different sets form a singular, uniform array of LED chips. For example, and as FIG. 7A illustrates, in certain embodiments, first LED set $S_1$ can be disposed over a first portion 62 of substrate 16, second LED set $S_2$ can be disposed over a second portion 64 of substrate 16, and third LED set $S_3$ can be disposed over a third portion 66 of substrate 16.

In certain embodiments, LED chips (e.g., $LED_1$, $LED_2$, . . . , $LED_N$) of first LED set $S_1$ can be adjacent and/or closest to LED chips of second LED set $S_2$. LED chips of second LED set $S_2$ can be disposed between LED chips of first LED set $S_1$ and third LED set $S_3$. As known in the art, LED chips heat up during operation. Thus, in certain embodiments, LED chips of each LED set can comprise a staggered and/or physically intermingled arrangement for spreading heat across different portions of substrate 16 to improve heat dissipation therefrom 16 and/or to prevent hot spots from occurring in concentrated areas or regions of substrate 16, such as regions directly under the LED chips. In certain embodiments, LED chips of some LED sets can be intermingled and/or positioned adjacent LED chips of other LED sets in any suitable method, for example, by overlapping strings of LED chips, using flex circuitry components, and/or cross-circuitry components such as embedded electrical traces, conductive vias, and jumper elements to transfer current through and/or across portions of substrate 16 and into respective LED chips of different LED sets.

As shown in FIG. 7A, in certain embodiments, first portion 62, second portion 64, and third portion 66 can comprise substantially circular and/or ring shaped portions that can be coaxial and/or concentric, and the respective LED sets $S_1$, $S_2$, $S_3$ may be arranged concentrically, with the sets arranged within or between boundaries of overlapping concentric circles. In certain embodiments, a set of solid state light emitters having a smallest duty cycle (e.g., $S_3$) is disposed proximate to a center of the substrate 16. This can assist with and/or improve thermal management properties associated with substrate 16. In certain embodiments, second portion 64 is arranged along a peripheral portion of third portion 66 and first portion 62 is arranged along a peripheral portion of first portion 62. As FIG. 7A illustrates, third LED set $S_3$ can be active for $\Delta t_3$, which can be the shortest amount of time and third LED set $S_3$ can comprise the shortest duty cycle of each LED set used in apparatus 10 (see FIGS. 5A and 5B). This allows LED chips that are active or "on" for a shortest amount of time to be disposed proximate a center of substrate 16. This can advantageously improve thermal management properties associated with substrate 16, by allowing heat to spread away from the center of substrate 16.

Positioning emitters having smaller duty cycles closer to a center of a substrate may aid in thermal dissipation and in promoting longevity of solid state emitters, by reducing thermal load (and reducing hot spots) proximate to the center of the substrate. Second LED set $S_2$, having the second longest duty cycle and on for the second longest (or shortest) time $\Delta t_2$ (FIG. 5A) can be disposed proximate a middle portion of substrate 16 and first LED set $S_1$ can be disposed proximate the outermost edge regions of substrate 16. Thus, the LED set having the longest duty cycle (e.g., first LED set $S_1$) and that is active for a longest time (e.g., $\Delta t_1$) can be positioned farthest from the center of substrate 16. In certain embodiments, third LED set $S_3$ can comprise more LED chips than either or both of the first $S_1$ and second $S_2$ LED sets. In certain embodiments, a at least twice as many LED chips are disposed in the central portion (e.g., third portion 68) of substrate 16 than in a peripheral area. In certain embodiments, a central portion (e.g., third portion 68) of substrate 16 can comprise no more than 50% of a spatial area of substrate 16, no more than 30% of a spatial area of substrate 16, or no more than 10% of the spatial area of substrate 16.

In certain embodiments, first, second, and third portions 62, 64, and 66, respectively, can also comprise concentric shapes that are substantially square, rectangular, or non-circular. In other aspects, the portions can be non-concentric, for example, parallel strips or other adjacent portions of substrate 16. LED chips of first LED set $S_1$ can be adjacent LED chips of both second LED set $S_2$ and third LED set $S_3$ to form a pattern or array. Any arrangement of LED sets $S_1$, $S_2$, . . . , $S_N$ over portions of substrate 16 is contemplated. In certain embodiments, substrate 16 can comprise only two or more than three portions for receiving only two or more than three sets of LED chips. In certain embodiments, the number of substrate portions or regions corresponds to the number of LED sets.

FIGS. 7B and 7C illustrate positioning of LED chips $LED_1$, $LED_2$, . . . , $LED_N$ along overlapping portions of electrical traces or circuits of substrate 16, such that LED chips of different LED sets physically intermingle or form a uniform array of LED chips (i.e., while remaining electrically mutually exclusive within the respective LED set). IN certain embodiments, LEDs of different sets may be disposed proximate to one another to thereby reduce or eliminate perceived color shifts, perceived flux (e.g., spatial or directional) flux variations, and/or perceived flicker during operation of lighting apparatus. In certain embodiments, and as illustrated in FIG. 7B, first and second LED sets $S_1$ and $S_2$ can be disposed over first and second traces 68 and 70, respectively. First and second traces 68 and 70 are shown schematically and for illustration purposes only. Such traces can, but may not be, visible along an exposed surface of the substrate, as conductive traces may be arranged on opposing substrate surfaces and/or can be at least partially disposed internal to substrate 16.

In certain embodiments, traces 68 and 70 can comprise crossing circuitry components utilizing electrically conductive vias or through-holes adapted to convey electrical current internally and/or to different surfaces of the substrate 16. In certain embodiments, portions of first and second traces 68 and 70 can indirectly overlap, and at least one LED chip of first LED set $S_1$ can be disposed proximate at least one LED chip of third LED set $S_3$. In certain embodiments, at least one insulating material (e.g., an insulating layer of substrate 16) can be physically arranged between overlapping portions of traces 68 and 70 such that electrical traces remain electrically insulated from each other. In certain embodiments, traces 68 and 70 can comprise overlapping and/or braided portions of electrically insulated flexible conductors or circuit-containing substrates (e.g., circuit boards). In certain embodiments, third LED set $S_3$ can be disposed along portions of a third trace 72, which can be disposed proximate a center line or center portion of substrate 16. In certain embodiments, LED chips of first LED set $S_1$ comprising a longest duty cycle can be positioned directly adjacent to, and/or closely packed with, LED chips of third LED set $S_3$ comprising a shortest duty cycle. Any number of LED chips and/or LED sets can be used to place LED chips that are active the longest amount of time next to LED chips that are active the least amount of time to alleviate noticeable color shifts, flux variations, and/or flicker during operation. Such placement can also advantageously improve thermal management of lighting apparatuses disclosed herein by efficiently spreading heat across different regions and away from the center of substrate 16, and avoiding or reducing hot spots during operation FIG. 7C illustrates LED chips of first LED set $S_1$ and second LED set $S_2$ disposed along portions of overlapping electrical circuitry or first and second electrical traces or conductors 74 and 76, respectively. In certain embodiments, traces 74, 76 may be formed on one or more surfaces of a substrate. In certain embodiments, traces 74, 76 may include insulated conductors that may or may not be affixed to a substrate. As FIG. 7C illustrates, LED chips of first LED set $S_1$ can be disposed between at least two LED chips of second set $S_2$, and vice versa. In certain embodiments, each set may be symmetrically arranged within or along a portion of substrate 16. In certain embodiments, a solid state lighting apparatus can comprise multiple LED chips arranged with azimuthal and/or lateral symmetry within or along portions of substrate 16. such arrangement can advantageously spread heat more efficiently by allowing LED chips that are active the longest amount of time and having a largest duty cycle alternate positions along substrate 16 such that they are not concentrated in one portion or area of substrate 16. This arrangement can also allow LED chips that are on the longest to be positioned closest to LED chips that have a shorter and/or a shortest duty cycle thereby reducing color shifts and/or flicker, as large gaps between inactive LED chips can be lessened or bridged by LED chips that are in an active state. LED chips of one set can be placed any suitable distance from LED chips of another set. In certain embodiments, LED chips of different sets can be spaced apart a distance of approximately 0.05 mm (e.g., 50 μm) or more, approximately 0.1 m (e.g., 100 μm) or more, approximately 0.2 mm or more, approximately 0.5 mm or more, approximately 1 mm or more, approximately 2 mm or more, approximately 5 mm or more, approximately 1 cm or more, or more than 2 cm.

FIG. 8 is a perspective view illustrating a solid state lighting apparatus generally designated 80. Solid state lighting apparatus 80 can be the same as or similar in form and function to apparatus 10 previously described in schematic detail. Solid state apparatus 80 can comprise substrate 16, which may include portions or components of a LED driver circuit, a LED string circuit, a rectifier circuit, a current diversion circuit, and/or a current limiter circuit disposed or mounted thereon as previously described. In certain embodiments, one or more portions of substrate 16 may include a printed circuit board (PCB), a metal core printed circuit board (MCPCB), a flexible printed circuit board, a dielectric laminate (e.g., FR-4 boards as known in the art) or any suitable substrate for mounting LED chips and/or LED packages. In certain embodiments substrate 16 can be comprised one or more materials arranged to provide desired electrical isolation and high thermal conductivity. In some embodiments, at least a portion of substrate 16 may comprise a dielectric to provide the desired electrical isolation between electrical traces or components of multiple LED sets. In certain embodiments, substrate 16 can comprise ceramic such as alumina, aluminum nitride, silicon carbide, or a polymeric material such as polyimide and polyester etc. In certain embodiments substrate 16 can also comprise a flexible circuit board, which can allow the substrate to take a non-planar or curved shape allowing for directional light emission with the LED chips also being arranged in a non-planar manner.

In certain embodiments, at least a portion of substrate 16 can comprise a MCPCB, such as a "Thermal-Clad" (T-Clad) insulated substrate material, available from The Bergquist Company of Chanhassen, Minn. A "Thermal Clad" substrate may reduce thermal impedance and conduct heat more efficiently than standard circuit boards. In certain embodiments, a MCPCB can also include a base plate on the dielectric layer, opposite the LED string circuit, and can comprise a thermally conductive material to assist in heat spreading. In certain embodiments, the base plate can comprise different material such as copper, aluminum or aluminum nitride. The base plate can have different thicknesses, such an in the range of 100 to 2000 μm. Substrate 16 can comprise any suitable material and any suitable thickness (e.g., approximately 0.5 mm to more than 5 mm as previously described).

In certain embodiments, a solid state lighting apparatus 80 can comprise a string circuit of multiple solid state light emitters, such as LED chips 82, arranged in multiple mutually exclusive sets. In certain embodiments, each LED chip 82 can be directly disposed over portions of substrate 16 (e.g., COB LED chips) or each LED chip 82 can be disposed in a LED package generally designated 84. In certain embodiments, LED package 84 can comprise a package submount 86 and an optional optical element 88. Optical element 88 can comprise a layer of silicone encapsulant or a glass or overmolded silicone lens. Submount 86 can comprise any suitable material, for example, a metal, plastic, ceramic, or combinations thereof. In certain embodiments, a submount 86 may include a ceramic based submount comprising alumina ($Al_2O_3$), or aluminum nitride AlN, however, any material is contemplated. In certain embodiments, a submount 86 can comprise a body structure including a reflector having multiple reflector portions adapted to affect a beam pattern generated by apparatus 80.

In certain embodiments, electrical traces and/or other circuitry components can be used to permit electrical communication with solid state light emitters arranged in multiple sets of LED chips 82 over submount 16. As described earlier, in certain embodiments each LED set can comprise one or more packaged or unpackaged LED chips 82 electrically connected in parallel. In certain embodiments, each LED set can be connected in series with other LED sets. In certain embodiments LED chips 82 can comprise the same color intra-set and/or inter-set. In certain embodiments, LED chips 82 can comprise different colors intra-set and/or inter-set. Any combination of intra- and inter-set colors, color points, and color temperatures are contemplated. In certain embodiments, current diversion circuits comprised of at least one transistor 90, resistor 92, and diode 94 can be arranged in parallel with each LED set to divert current about and thereby activate and/or deactivate the LED sets during portions of an AC cycle. Current diversion circuits can also comprise multiple transistors 90, resistors 92, and/or diodes 94. To reduce flicker and/or color shifting during activation and deactivation, LED sets can be placed such that LED chips that are "on" the most amount of time or can be directly adjacent LED chips that are "on" the least amount of time. Stated differently, LED chips having the largest duty cycle can be placed closer (e.g., directly adjacent in a closely packed array) to LED chips having a shorter duty cycle and, optionally the shortest duty cycle of multiple duty cycles. Such placement can also improve thermal management and reduce substrate 16 from accumulating hot spots during elevated operating temperatures.

In certain embodiments, solid state lighting apparatus 80 can comprise a rectifier circuit in the form of a rectifier bridge 96. Rectifier bridge 96 can comprise a portion of the drive circuit of apparatus 10 for supplying power to LED chips 82. An input connector 98 can receive AC signal directly from an AC power source (not shown). Rectifier bridge 96 can then convert the sinusoidal AC waveform into a rectified AC waveform without requiring an on-board switched mode power supply. Input connector 98 can comprise a housing having two inlets for receiving and mechanically and electrically coupling with two electrical wires (not shown) arranged to carry an AC input signal from an AC electrical power source. LED chips 82 can be activated and/or deactivated during different portions of the AC cycle. Solid state lighting apparatus 80 can also be modular in the fact that it can easily be mounted to and/or affixed within any suitable lighting fixture by insertion of attachment members (e.g., fasteners, screws, nails, etc.) into portions of attachment member receiving areas 100.

Figure 9:
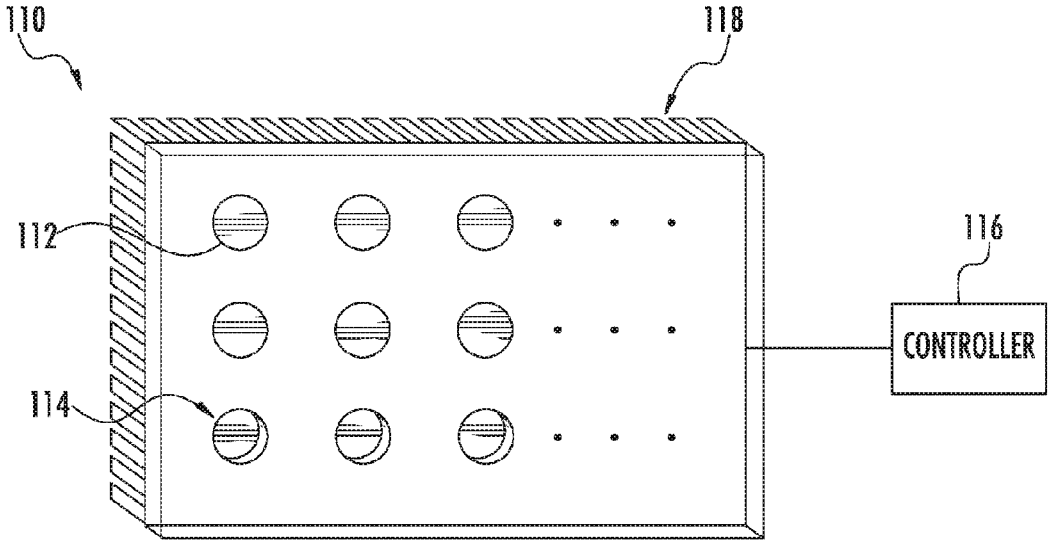
FIG. 9 is a schematic illustration of a lighting panel incorporating multiple solid state lighting apparatuses according to certain embodiments.

In certain embodiments, solid state lighting apparatus 80 can deliver approximately 70 LPW or more in select color temperatures, such as cool or warm white color temperatures (e.g., from approximately 2700 to 7000 K). In embodiments where COB LED chips are used, apparatus 80 can further comprise one or more optional optical elements and/or reflectors for being positioned over and/or cover portions of LED chips to affect the beam pattern generated by apparatus 80. In certain embodiments, at least one reflector can comprise more than one portion for receiving light from LED sets In certain embodiments, one or more substrates (e.g., modules) bearing multiple sets of separately controllable LEDs as described herein may be affixed to a support plate or other superstructure (optionally including heat dissipating elements) arranged to receive the substrate(s). Such approach enables fabrication of a modular lighting device. FIG. 9 illustrates a lighting fixture or panel generally designated 110. Lighting panel 110 can be adapted to receive one or more modular, solid state lighting apparatuses 80 (see FIG. 8). In certain embodiments, panel 110 is adapted to receive a plurality of lighting apparatuses 80 disposed thereon or therein. For example, lighting panel 110 can comprise one or more attachment surfaces 112 to which portions of one or more solid state lighting apparatuses 80 can be mounted. In certain embodiments, a bottom surface (e.g., the surface opposing the surface upon which LED packages 84 are mounted) of lighting apparatus 80 can mount to attachment surfaces 112 via welding, soldering, gluing, taping, epoxying, or otherwise causing adhesion therebetween. In certain embodiments, attachment surfaces 112 can comprise thermally conductive pads adapted to serve as a heat sink to apparatus 80.

In certain embodiments, a lighting panel can further comprise attachment sockets 114 configured to receive modular solid state lighting apparatuses. In certain embodiments, sockets 114 can comprise flush, inset, or raised regions of panel 110 such that apparatuses 80 can be mechanically and/or be electrically connected by plugging electrical connectors into input connectors 98 (FIG. 8). If inset or recessed regions are provided along a panel 110, then drop-in type sockets 114 associated with a panel can advantageously allow packages 84 and/or LED chips 82 (FIG. 8) to become flush with a surface of panel 110, thereby providing enhanced appearance and allowing light to reflect from one or more portions of the panel, preferably while also allowing heat to be conductively communicated from more than one surface of substrate 16 (e.g., a bottom and lateral outside edges of substrate 16) into the panel. In certain embodiments, heat may also dissipate from each lighting apparatus into an ambient environment (e.g., ambient air), via radiant and/or convective means. In certain embodiments, panel 110 comprises attachment surfaces 112. In certain embodiments, lighting panel 110 comprises attachment sockets 114. In certain embodiments, panel 110 can comprise a combination of attachment surface 112 and sockets 114.

In certain embodiments, lighting panels, lighting fixtures, and/or apparatuses described herein may comprise a control element or controller 116. In certain embodiments, controller 116 can be configured to store programs configured to control the selective activation and/or deactivation of different LED sets. In certain embodiments, controller 116 can be programmed such that each LED set switches on/off based upon on a different duty cycle. In certain embodiments, controller 116 can be programmed such that each LED set switches on/off based upon variables associated with voltage, time, AC cycle, duty cycles, and/or combinations thereof. In certain embodiments, controller 116 can be adapted to controllably switch and/or cycle different LED sets on and off based upon any suitable and/or different input variables and any combinations thereof. In certain embodiments, a user can program controller 116 using any desired input variable for selectively controlling activation and deactivation of LED sets within one or more apparatuses 80 disposed in or on panel 110. In certain embodiments, controller 116 can be adapted to permit adjustment of a duty cycle for each LED set of one or more LED sets, and thereby permit adjustment of overall perceived color temperature and/or a beam pattern generated by one or more apparatuses 80. In certain embodiments, a user can select different operating modes based upon desired color rendering and/or efficiency desired from lighting panel 110.

In certain embodiments lighting panel 110 can comprise thermal management members such as fins 118 and/or heat-pipes (not shown) for improved spreading and/or dissipation of heat generated by solid state lighting apparatuses 80 disposed thereon.

Figure 10A:
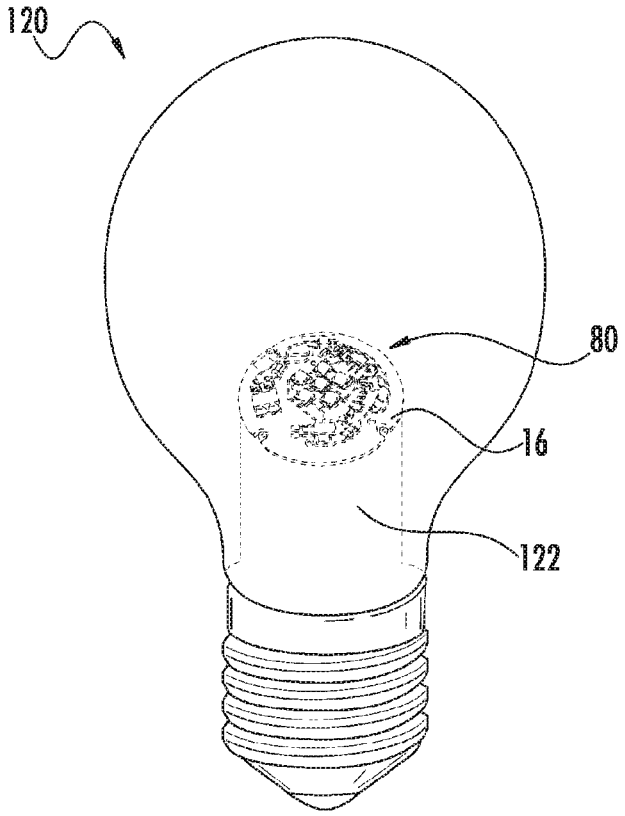
FIG. 10A is a perspective view of a light bulb including at least one solid state lighting apparatuses according to certain embodiments.
Figure 10B:
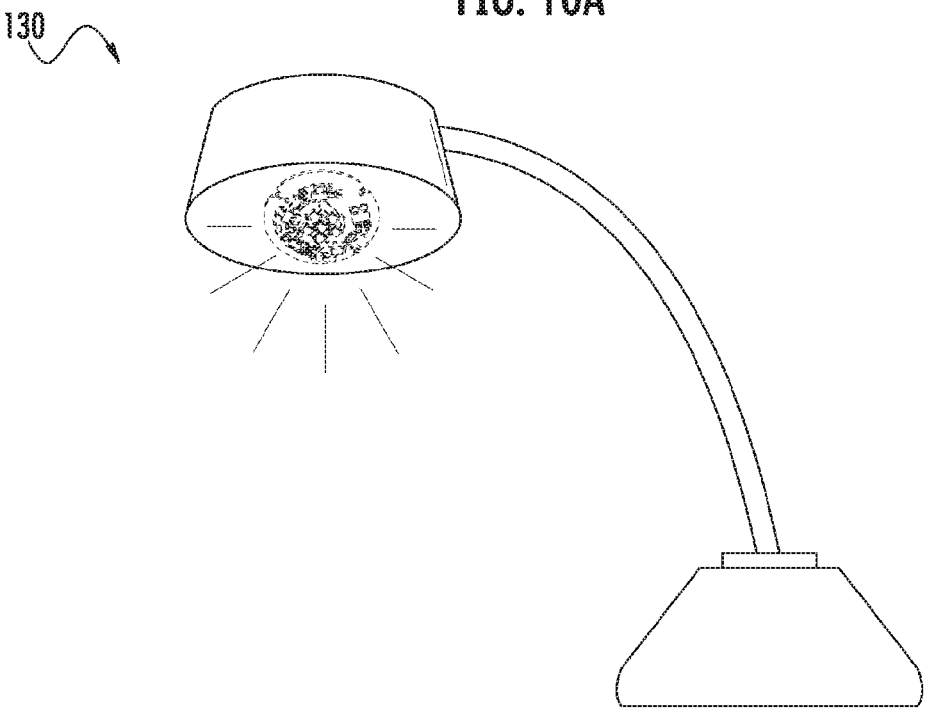
FIG. 10B is a perspective view of a light figure in the form of a desk lamp including at least one solid state lighting apparatus according to certain embodiments.

FIGS. 10A and 10B illustrate exemplary embodiments of at least one solid state lighting apparatus 80 housed in one or more lighting products, such as lighting fixtures. Any number of lighting applications, products, and/or fixtures is contemplated; for illustration purposes only and without limitation, a light bulb, generally designated 120 and a lighting fixture, generally designated 130 are shown in FIGS. 10A and 10B. As FIGS. 10A and 10B illustrate in phantom lines, solid state lighting apparatus 80 can be incorporated within a portion of light bulb 120. As apparatus 80 may not be visible from the exterior of the lighting fixtures, features thereof are illustrated in phantom lines. In certain embodiments, each lighting fixture can comprise only one, or more than one, solid state lighting apparatus 80.

As shown in FIG. 10A, substrate 16 can be disposed over a holding member 122 (e.g., pedestal) and/or heat transfer element within bulb 110. In certain embodiments, substrate 16 can be fastened or screwed into holding member 122 by inserting and affixing attachment members into attachment member receiving areas 100 (FIG. 8). As previously described, solid state lighting apparatus 80 can comprise multiple mutually exclusive sets of LED chips 82 physically arranged in an array over substrate 16. Solid state lighting apparatus 80 can advantageously operate directly from an AC power source without the use of an on-board switched mode power supply, thereby reducing cost and encouraging adoption of LED products. In certain embodiments, solid state lighting apparatus 80 can be configured to selectively activate and deactivate the multiple LED sets at different times relevant to one another during a portion of an AC cycle. In certain embodiments, the multiple LED sets can comprise multiple different duty cycles. In certain embodiments, LED chips in and/or among the LED sets can be selected based upon color, color ratio, color point, targeted wavelength, and/or targeted color temperature to reduce or eliminate perceptible flicker, perceptible flux variation, and/or perceptible color variation that may potentially occur during activation and deactivation of one or more of the LED sets. In certain embodiments, LED chips within LED sets can be selectively placed over portions of substrate 16 for improved thermal properties (e.g., via better heat spreading) and for physically integrating LED chips of LED sets into a tightly packed array for providing improved illumination characteristics.

FIG. 10B illustrates a lighting fixture 130 incorporating at least one solid state lighting apparatus 80. In certain embodiments, lighting fixture 130 can comprise a desk lamp for personal or commercial lighting applications. Solid state lighting apparatus 80 can be mounted within a portion of lighting fixture 130. In certain embodiments, solid state lighting apparatus 80 can be controlled to selectively switch multiple LED sets between active and inactive states. In certain embodiments, more than one solid state lighting apparatus 80 can be used within lighting fixture 130. In certain embodiments lighting fixture 130 can comprise a desk lamp configured to maintain a uniform color and/or color temperature without perceptible flicker, perceptible flux variation, and/or perceptible color variation, even while switching LED sets between active and inactive states.

Figure 11:
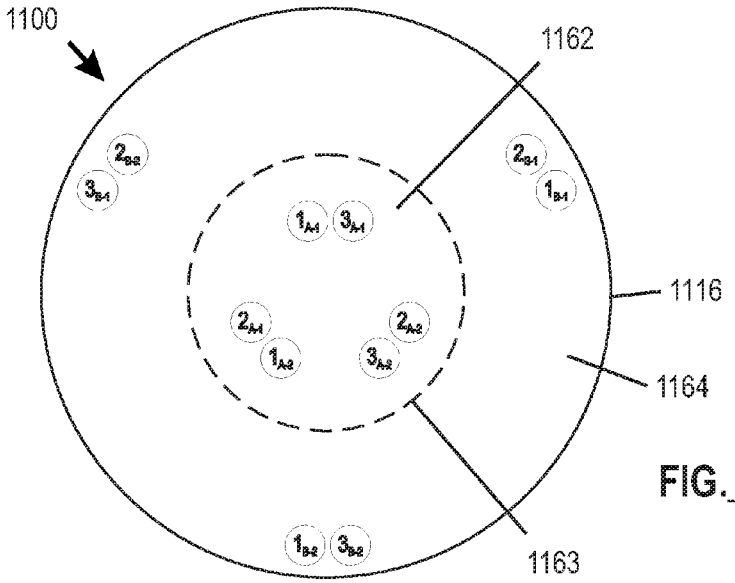
FIG. 11 is a schematic diagram illustrating multiple groups of solid state emitters arranged in overlapping concentric circular (or annular) regions of a substrate of a solid state lighting apparatus according to certain embodiments.

In certain embodiments, at least one solid state light emitter of a first set of solid state light emitters that comprises a largest duty cycle is arranged closer in proximity to at least one solid state emitter of a second solid state light emitter set that comprises a smallest duty cycle. As shown in FIG. 11, multiple groups of solid state emitters arranged in overlapping concentric circular (or annular) regions or portions 1162, 1164 of a substrate of a solid state lighting apparatus 1100 adapted to operate with alternating current (AC) received from an AC power source, including multiple sets of solid state light emitters are configured to be activated and/or deactivated at different times relative to one another during a portion of an AC cycle. A peripheral (or outer) region 1164 circumscribes the central (or inner) region 1162, with a boundary 1163 (which may or may not be represented in a physical apparatus 1100) dividing the respective regions 1162, 1164. FIG. 11 depicts three sets of solid state emitters (the first set including emitters $\mathbf{1}_{A\text{-}1}$, $\mathbf{1}_{A\text{-}2}$; the second set including emitters $\mathbf{2}_{A\text{-}1}$, $\mathbf{2}_{A\text{-}2}$; and the third set including emitters $\mathbf{3}_{A\text{-}1}$, $\mathbf{3}_{A\text{-}2}$) arranged in an inner circular region 1162, and depicts three sets of solid state emitters (the first set including emitters $\mathbf{1}_{B\text{-}1}$, $\mathbf{1}_{B\text{-}2}$; the second set including emitters $\mathbf{2}_{B\text{-}1}$, $\mathbf{2}_{B\text{-}2}$; and the third set including emitters $\mathbf{3}_{B\text{-}1}$, $\mathbf{3}_{B\text{-}2}$), wherein each emitter with the same numerical prefix (i.e., 1, 2, or 3) is arranged to be operated simultaneously, each emitter with the prefix "1" has the (same) largest duty cycle, each emitter with the prefix "2" has the (same) intermediate duty cycle, and each emitter with the prefix "3" has the (same) shortest duty cycle.

In certain embodiments as shown in FIG. 11, in each portion or region 1162, 1164, at least one emitter having a largest duty cycle is arranged closer in proximity to at least one emitter having a smallest duty cycle, since in the central region 1162 a first group emitter $\mathbf{1}_{A\text{-}1}$ is arranged closer to a third group emitter $\mathbf{3}_{A\text{-}1}$ than to any other emitter of the lighting apparatus 1100, and since in the peripheral region 1164 a first group emitter $\mathbf{1}_{B\text{-}2}$ is arranged closer to a third group emitter $\mathbf{3}_{B\text{-}2}$ than to any other emitter of the lighting apparatus 1100. Placing emitters having the largest duty cycle closest to emitters having the smallest duty cycle may improve appearance of the aggregated light emissions by reducing perceptible flicker, reducing perceptible variation (with respect to area) in luminous flux, reducing perceptible variation in aggregated output color, and/or improve thermal management by reducing hot spots within the device. As shown in FIG. 11, in addition to placing emitters having the largest duty cycle closest to emitters having the smallest duty cycle, placement of multiple emitters having a largest duty cycle proximate to one another is avoided, and placement of multiple emitters having a smallest duty cycle proximate to one another is also avoided.

In certain embodiments, at least one solid state light emitter of a first solid state light emitter set is arranged closer to at least one solid state emitter of a second solid state light emitter set than to any other solid state light emitter of the first solid state light emitter set.

Figure 12:
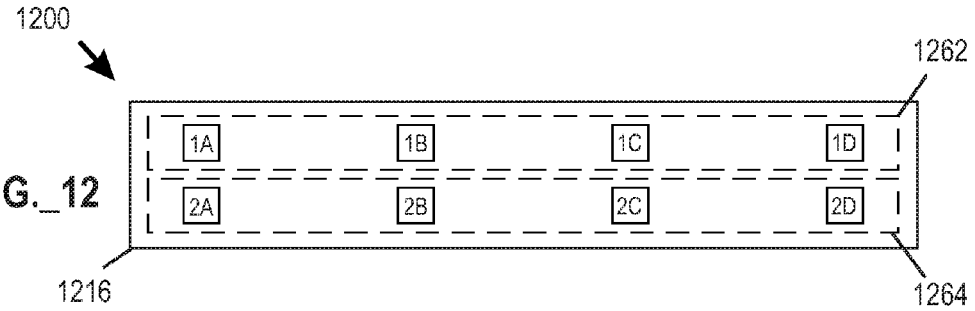
FIG. 12 is a schematic diagram illustrating two groups of solid state emitters arranged in elongated rectangular regions disposed in parallel on a substrate of a solid state lighting apparatus according to certain embodiments.

As shown in FIG. 12, multiple groups or sets of solid state emitters are arranged in elongated rectangular regions 1262, 1264 parallel to one another on or along a substrate 1216 of a solid state lighting apparatus 1200 adapted to operate with alternating current (AC) received from an AC power source. Each emitter with the same numerical prefix (i.e., 1 or 2) is arranged to be operated simultaneously, wherein each emitter with the prefix "1" has the (same) largest duty cycle, and each emitter with the prefix "2" has the (same) smallest duty cycle. The first set includes emitters 1A-1D and the second set includes emitters 2A-2D. As shown in FIG. 12, each emitter of the first set is arranged closer to an emitter of the second set than to another emitter of the first set (e.g., emitter 1B of the first set is arranged closer to emitter 2B of the second set than the proximity of emitter 1B to any other emitters 1A, 1C, 1D of the first set). Although only two sets of emitters each containing four emitters are shown in FIG. 12, it is to be appreciated that any suitable number of emitters sets and constituent emitters may be employed.

In certain embodiments, portions different emitter sets may be dispersed in subgroups that with constituents arranged equidistantly and/or symmetrically relative to a center of a substrate of a light emitting apparatus.

Figure 13:
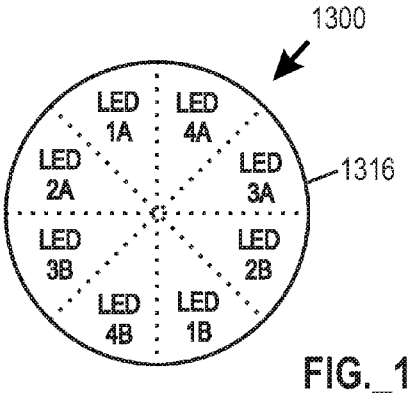
FIG. 13 is a schematic diagram illustrating four groups of solid state emitters arranged in wedge-shaped regions on a substrate of a solid state lighting apparatus according to certain embodiments.

FIG. 13 is a schematic diagram illustrating four groups or sets of solid state emitters (i.e., set 1 including constituents LED 1A, LED 1B; set 2 including constituents LED 2A, LED 2B; set 3 including constituents LED 3A, LED 3B; and set 4 including constituents LED 4A, LED 4B), wherein each emitter set includes two subgroups arranged in wedge-shaped regions on a substrate 1316 of a solid state lighting apparatus adapted to operate with alternating current (AC) received from an AC power source. Each emitter with the same numerical suffix (i.e., 1, 2, 3, or 4) is arranged to be operated simultaneously, wherein each set of solid state light emitters may be configured to be activated and/or deactivated at different times relative to one another during a portion of an AC cycle.

Figure 14:
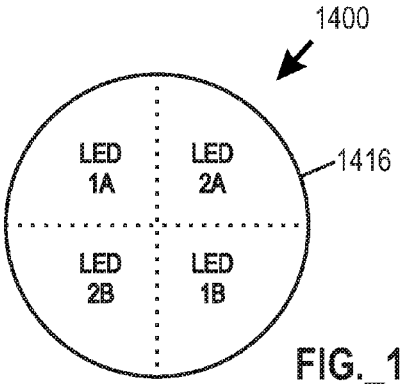
FIG. 14 is a schematic diagram illustrating two groups of solid state emitters arranged in wedge-shaped regions on a substrate of a solid state lighting apparatus according to certain embodiments.

FIG. 14 is a schematic diagram illustrating two groups or sets of solid state emitters (i.e., set 1 including constituents LED 1A, LED 1B; set 2 including constituents LED 2A, LED 2B) wherein each emitter set includes two subgroups arranged in wedge-shaped regions (quadrants) on a substrate 1416 of a solid state lighting apparatus adapted to operate with alternating current (AC) received from an AC power source. Each emitter with the same numerical suffix (i.e., 1 or 2) is arranged to be operated simultaneously, wherein each set of solid state light emitters may be configured to be activated and/or deactivated at different times relative to one another during a portion of an AC cycle.

In certain embodiments, multiple solid state light emitters are distributed across a peripheral portion of the substrate, and a central portion of the substrate comprises a larger number of solid state light emitters than a peripheral portion of the substrate (such that a majority of the emitters are arranged in the central portion).

Figure 15:
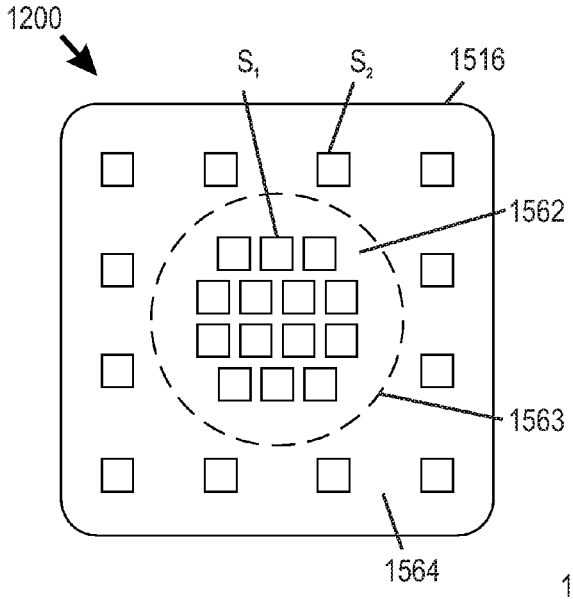
FIG. 15 is a schematic diagram illustrating multiple groups of solid state emitters arranged in first and second groups on a substrate of a solid state lighting apparatus according to certain embodiments, with a central group containing a larger number of solid state emitters than a peripheral group.

As shown in FIG. 15, a first set of solid state emitters $S_1$ is arranged in or on a central portion 1562 of a substrate 1516, and a second set of solid state emitters $S_2$ is arranged in or on a peripheral portion 1564 of the substrate, with a boundary 1563 (whether real or imaginary) arranged between the central region 1562 and the peripheral region 1564 of the substrate 1516 of a solid state lighting apparatus 1200 adapted to operate with alternating current (AC) received from an AC power source. Multiple sets of solid state light emitters are configured to be activated and/or deactivated at different times relative to one another during a portion of an AC cycle. The central portion 1562 of the substrate 1516 includes a larger number of solid state emitters $S_1$ than the number of solid state emitters $S_2$ contained in the peripheral region 1564. In certain embodiments, the central portion 1562 may contain emitters $S_1$ of a first set and the peripheral portion 1564 may contain emitters $S_2$ of a second set that is controlled separately from the first set. In other embodiments, emitters of multiple different sets are distributed among the peripheral region 1564 and among the central region 1562. As shown in FIG. 15, the peripheral region 1564 circumscribes the central region 1562, with twelve emitters arranged in a square in the peripheral region 1564, and with fourteen emitters arranged in two rows of three and two rows of four.

Figure 16:
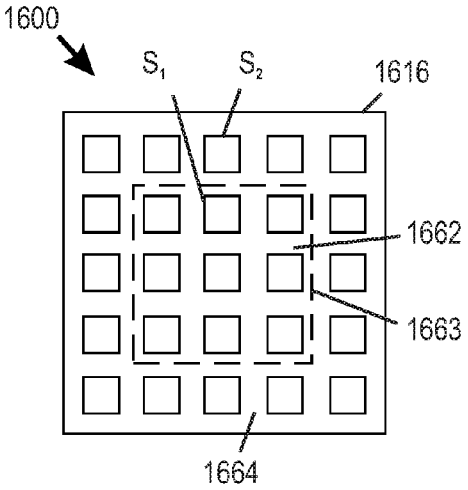
FIG. 16 is a schematic diagram illustrating multiple groups of solid state emitters arranged in concentric rectangular (e.g., square) groups on a substrate of a solid state lighting apparatus according to certain embodiments.

FIG. 16 illustrates a first set of solid state emitters $S_1$ is arranged in or on a central portion 1662 of a substrate 1616, and a second set of solid state emitters $S_2$ arranged in or on a peripheral portion 1664 of the substrate 1616, with a square-shaped boundary 1663 (whether real or imaginary) arranged between the central region 1662 and the peripheral region 1664 of the substrate 1616 of a solid state lighting apparatus 1600 that adapted to operate with alternating current (AC) received from an AC power source. Multiple sets of solid state light emitters are configured to be activated and/or deactivated at different times relative to one another during a portion of an AC cycle. The central portion 1662 is arranged in a square shape, with the peripheral portion 1664 arranged as a larger square circumscribing the central portion 1662. The central portion 1662 comprises nine emitters arranged in three rows of three, whereas the peripheral portion 1664 comprises sixteen emitters arranged in a square including five emitters per side. In certain embodiments, the central portion 1662 may contain emitters $S_1$ of a first set exclusively and the peripheral portion 1664 may contain emitters $S_2$ of a second set exclusively, with the second set being controlled separately from the first set. In other embodiments, emitters of multiple different sets may be distributed among the peripheral region 1664 and among the central region 1662.

Figure 17:
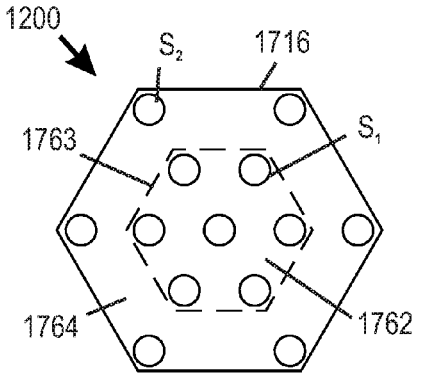
FIG. 17 is a schematic diagram illustrating multiple groups of solid state emitters arranged in concentric polygonal (e.g., hexagonal) groups on a substrate of a solid state lighting apparatus according to certain embodiments.

FIG. 17 illustrates a first set of solid state emitters $S_1$ is arranged in or on a central portion 1762 of a substrate 1716, and a second set of solid state emitters $S_2$ arranged in or on a peripheral portion 1764 of the substrate 1716, with a polygonal (e.g., hexagonal) boundary 1763 (whether real or imaginary) arranged between the central portion 1762 and the peripheral portion 1764 of the substrate 1616 of a solid state lighting apparatus 1700 adapted to operate with alternating current (AC) received from an AC power source. Multiple sets of solid state light emitters are configured to be activated and/or deactivated at different times relative to one another during a portion of an AC cycle. The central portion 1762 is arranged in a hexagonal shape, with the peripheral portion 1764 arranged as a larger hexagon circumscribing the central portion 1762. The central portion 1762 comprises seven emitters with one central emitter bounded by a group of six emitters, whereas the peripheral portion 1764 comprises six emitters arranged proximate to vertices of a hexagon. In certain embodiments, the central portion 1762 may contain emitters $S_1$ of a first set exclusively and the peripheral portion 1764 may contain emitters $S_2$ of a second set exclusively, with the second set being controlled separately from the first set. In other embodiments, emitters of multiple different sets may be distributed among the peripheral region 1664 and among the central region 1762.

Figure 18:
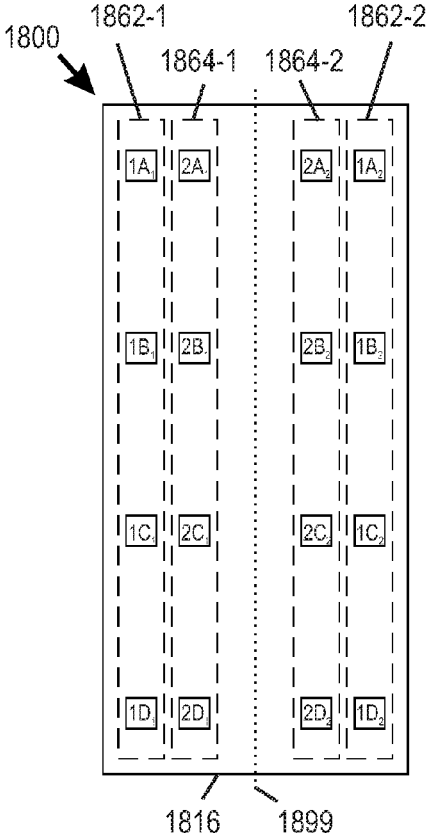
FIG. 18 is a schematic diagram illustrating multiple groups of solid state emitters arranged in elongated rectangular regions disposed in parallel on a substrate of a solid state lighting apparatus according to certain embodiments.

FIG. 18 illustrates a multiple sets of solid state emitters $1A_1$-$1D_1$, $2A_1$-$2D_1$, $1A_2$-$1D_2$, $2A_2$-$2D_2$ arranged in elongated rectangular portions 1862-1, 1864-1, 1862-2, 1864-2, respectively, of a substrate 1816 of a lighting apparatus 1800 adapted to operate with alternating current (AC) received from an AC power source. The first two portions 1862-1, 1864-1 and the second two portions 1862-2, 1864-2 are laterally symmetric relative to a central axis 1899. Each emitter with the same numerical suffix (i.e., 1 or 2) is arranged to be operated simultaneously, wherein each set of solid state light emitters may be configured to be activated and/or deactivated at different times relative to one another during a portion of an AC cycle. As shown in FIG. 12, each emitter is arranged closer to an emitter of an adjacent set than to another emitter of the same set (for example, emitter $1B_1$ of a first portion 1862-1 is arranged closer to emitter $2B_1$ of a second portion 1864-1 than to any other emitter $1A_1$, $1C_1$, $1D_1$ of the first portion 1862-1).

FIGS. 19A-19C are schematic diagrams illustrating placement of solid state emitters on substrates of solid state lighting apparatuses according to certain embodiments. Although three different emitter placement configurations are shown, it is to be appreciated that other emitter placement configurations may be employed in alternative embodiments.

FIG. 19A illustrates a first array of twenty-five emitters (or emitter packages) divided into three sets and arranged on a substrate 1916A, wherein each emitter with the same numerical prefix (i.e., 1, 2, or 3) is arranged to be operated simultaneously, each emitter with the prefix "1" has the (same) largest duty cycle, each emitter with the prefix "2" has the (same) intermediate duty cycle, each emitter with the prefix "3" has the (same) shortest duty cycle, and the suffix of each emitter denotes cell position within the array according to column (denoted with letters "A" to "E") and row (denoted with numbers "1" to "5"). As shown in FIG. 19A, a central emitter $\mathbf{1}_{C3}$ (i.e., in cell C3) of the first emitter set is surrounded with an intermediate group of eight alternating emitters of the second and third emitter sets (i.e., emitters $\mathbf{3}_{B2}$, $\mathbf{2}_{C2}$, $\mathbf{3}_{D2}$, $\mathbf{2}_{D3}$, $\mathbf{2}_{D4}$, $\mathbf{2}_{C4}$, $\mathbf{3}_{B4}$, and $\mathbf{2}_{B3}$), and the intermediate group is surrounded with sixteen alternating emitters of the first, second, and third emitter sets (i.e., emitters $\mathbf{2}_{A1}$, $\mathbf{1}_{B1}$, $\mathbf{3}_{C1}$, $\mathbf{1}_{D1}$, $\mathbf{2}_{E1}$, $\mathbf{1}_{E2}$, $\mathbf{3}_{E3}$, $\mathbf{1}_{E4}$, $\mathbf{2}_{E5}$, $\mathbf{1}_{D5}$, $\mathbf{3}_{C5}$, $\mathbf{1}_{B5}$, $\mathbf{2}_{A5}$, $\mathbf{1}_{A4}$, $\mathbf{3}_{A3}$, and $\mathbf{1}_{A2}$). The resulting apparatus 1900A includes nine emitters in the first set, eight emitters in the second set, and eight emitters in the third set.

FIG. 19B illustrates a second array of twenty-five emitters (or emitter packages) divided into three sets and arranged on a substrate 1916B, wherein each emitter with the same numerical prefix (i.e., 1, 2, or 3) is arranged to be operated simultaneously, each emitter with the prefix "1" has the (same) largest duty cycle, each emitter with the prefix "2" has the (same) intermediate duty cycle, each emitter with the prefix "3" has the (same) shortest duty cycle, and the suffix of each emitter denotes cell position within the array according to column (denoted with letters "A" to "E") and row (denoted with numbers "1" to "5"). As shown in FIG. 19B, a central emitter $\mathbf{3}_{C3}$ (i.e., in cell C3) of the first emitter set is surrounded with an intermediate group of eight alternating emitters of the second and third emitter sets (i.e., emitters $\mathbf{1}_{B2}$, $\mathbf{2}_{C2}$, $\mathbf{1}_{D2}$, $\mathbf{2}_{D3}$, $\mathbf{1}_{D4}$, $\mathbf{2}_{C4}$, $\mathbf{1}_{B4}$, and $\mathbf{2}_{B3}$), and the intermediate group is surrounded with sixteen alternating emitters of the first, second, and third emitter sets (i.e., emitters $\mathbf{2}_{A1}$, $\mathbf{3}_{B1}$, $\mathbf{1}_{C1}$, $\mathbf{3}_{D1}$, $\mathbf{2}_{E1}$, $\mathbf{3}_{E2}$, $\mathbf{1}_{E3}$, $\mathbf{3}_{E4}$, $\mathbf{2}_{E5}$, $\mathbf{3}_{D5}$, $\mathbf{1}_{C5}$, $\mathbf{3}_{B5}$, $\mathbf{2}_{A5}$, $\mathbf{3}_{A4}$, $\mathbf{1}_{A3}$, and $\mathbf{3}_{A2}$). The resulting apparatus 1900B includes eight emitters in the first set, eight emitters in the second set, and nine emitters in the third set.

FIG. 19C illustrates a third array of twenty-five emitters (or emitter packages) divided into three sets and arranged on a substrate 1916C, wherein each emitter with the same numerical prefix (i.e., 1, 2, or 3) is arranged to be operated simultaneously, each emitter with the prefix "1" has the (same) largest duty cycle, each emitter with the prefix "2" has the (same) intermediate duty cycle, each emitter with the prefix "3" has the (same) shortest duty cycle, and the suffix of each emitter denotes cell position within the array according to column (denoted with letters "A" to "E") and row (denoted with numbers "1" to "5"). As shown in FIG. 19C, a central emitter $\mathbf{1}_{C3}$ (i.e., in cell C3) of the first emitter set is surrounded with an intermediate group of eight alternating emitters all of the second sets (i.e., emitters $\mathbf{2}_{B2}$, $\mathbf{2}_{C2}$, $\mathbf{2}_{D2}$, $\mathbf{2}_{D3}$, $\mathbf{2}_{D4}$, $\mathbf{2}_{C4}$, $\mathbf{2}_{B4}$, and $\mathbf{2}_{B3}$), and the intermediate group is surrounded with sixteen emitters of the first and third emitter sets (i.e., emitters $\mathbf{3}_{A1}$, $\mathbf{3}_{B1}$, $\mathbf{1}_{C1}$, $\mathbf{3}_{D1}$, $\mathbf{3}_{E1}$, $\mathbf{3}_{E2}$, $\mathbf{1}_{E3}$, $\mathbf{3}_{E4}$, $\mathbf{3}_{E5}$, $\mathbf{3}_{D5}$, $\mathbf{1}_{C5}$, $\mathbf{3}_{B5}$, $\mathbf{3}_{A5}$, $\mathbf{3}_{A4}$, $\mathbf{1}_{A3}$, and $\mathbf{3}_{A2}$). The resulting apparatus 1900B includes five emitters in the first set, eight emitters in the second set, and twelve emitters in the third set.

In certain embodiments, at least one reflector and/or at least one optical element arranged to receive emissions from multiple solid state light emitter sets adapted to operate with alternating current (AC) received from an AC power source and configured to be activated and/or deactivated at different times relative to one another during a portion of an AC cycle, wherein the light emitter sets are arranged to affect a beam pattern generated by a lighting device; and a control element is arranged to permit adjustment of duty cycle of the solid state light emitter sets to permit adjustment of a beam pattern output by a lighting device.

Figure 20:
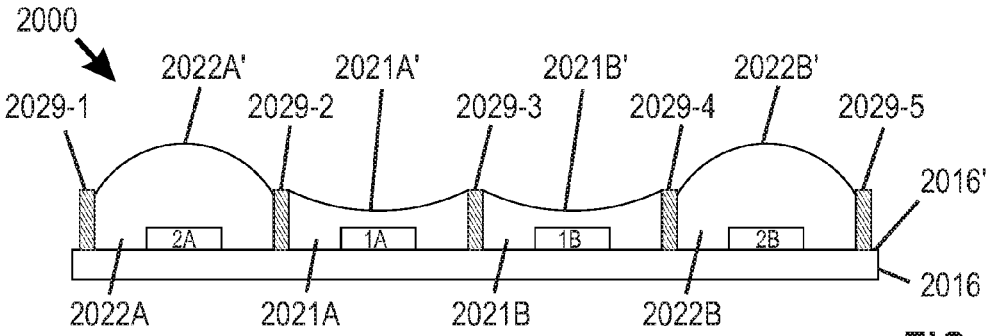
FIG. 20 is a side cross-sectional view of at least a portion of a lighting apparatus including multiple optical elements arranged to receive and transmit emissions from multiple solid state emitters to permit adjustment of a beam pattern.

FIG. 20 illustrates at least a portion of a lighting apparatus 2000 including multiple optical elements 2021A, 2021B, 2022A, 2022B arranged to receive and transmit emissions from multiple solid state emitters (e.g., LEDs) 1A, 1B, 2A, 2B to permit adjustment of a beam pattern emitted by the apparatus 2000A. The solid state emitters 1A, 1B, 2A, 2B are arranged on or over a substrate 2016, which may embody a printed circuit board. In certain embodiments, optional walls or other dividing elements 2029-1 to 2029-5 may be arranged between solid state emitters 1A, 1B, 2A, 2B to contain optical elements 2021A, 2021B, 2022A, 2022B and/or reduce (or eliminate) optical interaction between adjacent emitters. The optical elements 2021A, 2021B, 2022A, 2022B may be arranged as lenses with respective outer surfaces 2021A', 2021B', 2022A', 2022B', which in certain embodiments may have concave, convex, or flat shapes, with optional patterning and/or facets. As shown in FIG. 20, lenses 2021A-2021B associated with one emitter set (e.g., emitters 1A-1B) may be concave (e.g., providing a focused output beam) while lenses 2022A-2022B associated with another emitter set (e.g., emitters 2A-2B) may be convex (e.g., providing a dispersed output beam). In certain embodiments, different optical elements associated with different emitter groups may comprise different focal lengths. Providing different optical elements associated with different emitter groups permits aggregate beam pattern of the lighting apparatus 2000A to be adjusted by adjusting duty cycle of the different emitter groups (e.g., group 1A-1B and group 2A-2B) using one or more control elements (not shown, but as described previously herein). In certain embodiments, gaps (not shown) may be provided between the emitters 1A, 1B, 2A, 2B and the optical elements 2021A, 2021B, 2022A, 2022B.

Figure 21:
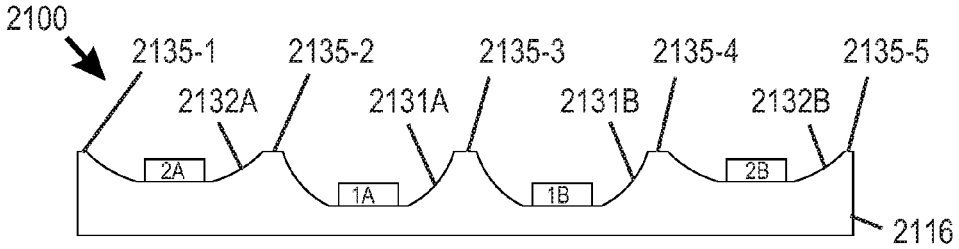
FIG. 21 is a side cross-sectional view of at least a portion of a lighting apparatus including multiple reflectors arranged to receive and reflect emissions from multiple solid state emitters to permit adjustment of a beam pattern.

FIG. 21 illustrates at least a portion of a lighting apparatus 2100 including multiple reflectors 2131A, 2131B, 2132A, 2132B arranged to receive and transmit emissions from multiple solid state emitters (e.g., LEDs) 1A, 1B, 2A, 2B to permit adjustment of a beam pattern emitted by the apparatus 2100. The solid state emitters 1A, 1B, 2A, 2B are arranged on or over a substrate 2116, which may embody a printed circuit board. In certain embodiments, elevated walls 2135-1 to 2135-5 may be arranged between solid state emitters 1A, 1B, 2A, 2B to reduce or eliminate optical interaction between adjacent emitters. In certain embodiments, reflectors 2131A, 2131B, 2132A, 2132B may be defined in at least one surface of the substrate 2116; in other embodiments, one or more reflectors may be pre-manufactured and affixed on or over a surface of the substrate 2116. In certain embodiments, reflectors 2131A, 2131B, 2132A, 2132B may comprise one or more surfaces or coatings of reflective silver or white surfaces, and may comprise diffuse or specular reflective surfaces. In certain embodiments, reflectors may comprise facets and/or compound surfaces arranged to shape output beam patterns. As shown in FIG. 21, reflectors 2131A, 2131B associated with one emitter set (e.g., emitters 1A-1B) may have a different curvature and/or focal length than reflectors 2132A, 2132B associated with another emitter set (e.g., emitters 2A-2B), such that different groups of emitters in combination with associated reflectors may be arranged to output different beam patterns. Providing reflectors of different properties associated with different emitter groups permits aggregate beam pattern of the lighting apparatus 2100 to be adjusted by adjusting duty cycle of the different emitter groups (e.g., group 1A-1B and group 2A-2B) using one or more control elements (not shown).

Figure 22:
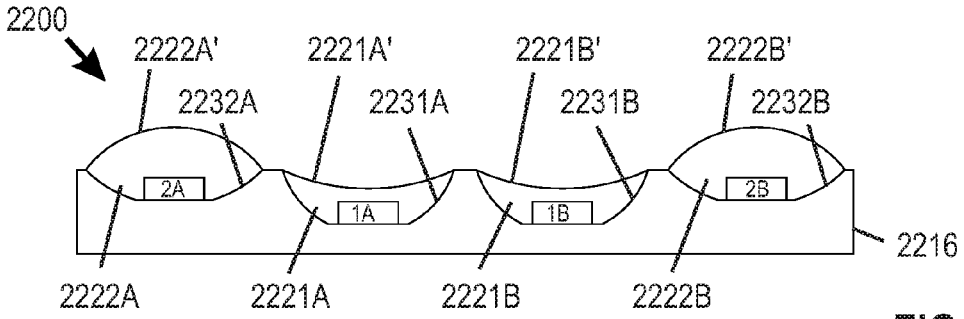
FIG. 22 is a side cross-sectional view of at least a portion of a lighting apparatus including multiple reflectors and multiple optical elements arranged to receive emissions from multiple solid state emitters to permit adjustment of a beam pattern.

In certain embodiments, different reflectors and different optical elements may be associated with different groups of solid state emitters. FIG. 22 illustrates at least a portion of a lighting apparatus 2200 including multiple optical elements 2221A, 2221B, 2222A, 2222B and multiple reflectors 2231A, 2231B, 2232A, 2232B arranged to receive and transmit emissions from multiple solid state emitters (e.g., LEDs) 1A, 1B, 2A, 2B to permit adjustment of a beam pattern emitted by the apparatus 2200. The solid state emitters 1A, 1B, 2A, 2B are arranged on or over a substrate 2216, which may embody a printed circuit board. The optical elements 2221A, 2221B, 2222A, 2222B may be arranged as lenses with respective outer surfaces 2221A', 2221B', 2222A', 2222B', which in certain embodiments may have concave, convex, or flat shapes, with optional patterning and/or facets. As shown in FIG. 22, lenses 2221A-2221B associated with one emitter set (e.g., emitters 1A-1B) may be concave (e.g., providing a focused output beam) while lenses 2222A-2222B associated with another emitter set (e.g., emitters 2A-2B) may be convex (e.g., providing a dispersed output beam). As further shown in FIG. 22, reflectors 2231A, 2231B associated with one emitter set (e.g., emitters 1A-1B) may have a different curvature and/or focal length than reflectors 2232A, 2232B associated with another emitter set (e.g., emitters 2A-2B), such that different groups of emitters in combination with associated reflectors may be arranged to output different beam patterns. Providing optical elements and reflectors of different properties associated with different emitter groups permits aggregate beam pattern of the lighting apparatus 2200 to be adjusted by adjusting duty cycle of the different emitter groups (e.g., group 1A-1B and group 2A-2B) using one or more control elements (not shown).

Figure 23:
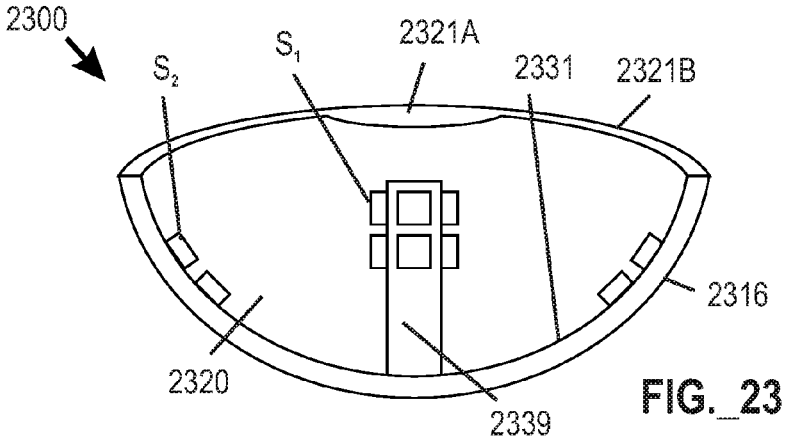
FIG. 23 is a side cross-sectional view of at least a portion of a lighting apparatus including multiple solid state emitter groups arranged relative to a single reflector and a single lens to permit adjustment of a beam pattern.

Although FIGS. 20-22 illustrate emitters in combination with corresponding individual reflectors and/or optical elements, in certain embodiments, different groups of emitters may be positioned differently relative to a common reflector and/or a common optical element in order to permit beam pattern to be adjusted by adjusting duty cycles of one or more emitter groups. FIG. 22 illustrates at least a portion of a lighting apparatus 2300 including multiple solid state emitter groups $S_1$, $S_2$ differently arranged relative to a single reflector 2331 (which may be formed in or on a substrate 2316) and a single lens (encompassing lens portions 2321A-2321B) to permit adjustment of a beam pattern output by the lighting apparatus 2300 by adjusting duty cycle of one or more of the emitter groups $S_1$, $S_2$. In certain embodiments, the lens portions 2321A, 2321B may be separated from the reflector 2331 by a gap or encapsulant material 2320. In certain embodiments, a first emitter group $S_1$ may be arranged on a support column 2339 that is elevated relative to the reflector 2331. In certain embodiments, at least some emitters of the first emitter group $S_1$ may be arranged to transmit light outward toward the reflector 2331 and generally in a direction toward a peripheral lens portion 2321. In certain embodiments, emitters of a second emitter group $S_2$ may be arranged on or over the reflector 2331 and arranged to transmit light generally in a direction toward a central lens portion 2321, In certain embodiments, the peripheral lens portion 2321B and the central lens portion 2321A may comprise different optical properties. As illustrated in FIG. 23, the central lens portion 2321A comprises a different thickness and/or curvature than the peripheral lens portion 2321B. Positioning the emitter groups $S_1$, $S_2$ relative to the reflector 2331 and/or the lens portions 2321A, 2321B permits aggregate beam pattern of the lighting apparatus 2300 to be adjusted by adjusting duty cycle of the different emitter groups $S_1$, $S_2$.

In certain embodiments, to a solid state lighting apparatus adapted to operate with alternating current (AC) received from an AC power source, the lighting apparatus including: multiple substrate regions; and multiple sets of one or more solid state light emitters arranged on or supported by the multiple substrate regions, wherein at least first and second sets of the multiple sets of solid state light emitters are configured to be activated and/or deactivated at different times relative to one another during a portion of an AC cycle, wherein the first and second sets of the multiple sets of solid state light emitters comprise different duty cycles; and wherein the lighting apparatus comprises at least one of the following features (i) to (iii): (i) a first substrate region of the multiple substrate regions includes one or more solid state light emitters of the first set of solid state light emitters and includes one or more solid state light emitters of the second set of solid state light emitters; and a second substrate region of the multiple substrate regions is non-coplanar with (and preferably non-parallel to) the first substrate region and includes one or more solid state light emitters of the first set of solid state light emitters and includes one or more solid state light emitters of the second set of solid state light emitters; (ii) at least one first solid state light emitter of the first set of solid state light emitters is arranged on a first substrate region of the multiple substrate regions that is substantially parallel to a first plane, at least one second solid state light emitter of the second set of solid state light emitters is arranged on a second substrate region of the multiple substrate regions that is substantially parallel to a second plane that is non-coplanar with the first plane but oriented less than 30 degrees apart from the first plane, and at least a portion of emissions of the at least one first solid state emitter are arranged to mix or overlap with at least a portion of emissions of the at least one second solid state emitter; and (iii) at least one first solid state light emitter of the first set of solid state light emitters is arranged on a first substrate region of the multiple substrate regions and is arranged to output a first beam centered in a first direction, and at least one second solid state light emitter of the second set of solid state light emitters is arranged on a second substrate region of the multiple substrate regions and is arranged to output a second beam centered in a second direction that is non-parallel to the first direction but oriented less than 30 degrees apart from the first direction. One, two, or three of the foregoing features (i) to (iii) may be present in a single apparatus. In certain embodiments, multiple substrate regions comprise different regions of a substantially continuous substrate. In certain embodiments, a substantially continuous substrate comprises a curved, concave, or convex surface including the different regions. In certain embodiments, multiple substrate regions comprise regions of different substrates. In certain embodiments, a support element may be arranged to support each substrate of the different substrates. In certain embodiments, a reflector may be arranged to reflect emissions of one or more solid state light emitters of the first set of solid state light emitters and arranged to reflect emissions of one or more solid state light emitters of the second set of solid state light emitter. In certain embodiments, a globe, diffuser, or optical element arranged to transmit and/or diffuse emissions of one or more solid state light emitters of the first set of solid state light emitters and arranged to transmit and/or diffuse emissions of one or more solid state light emitters of the second set of solid state light emitter. Such a globe, diffuser, or optical element may be arranged to bound a cavity containing the multiple sets of one or more solid state light emitters, and wherein a plurality of conductors conducting AC power are arranged within the cavity. In certain embodiments, a driving circuit including a rectifier bridge may be arranged within the cavity. In certain embodiments, a lumiphor support element may be spatially segregated from the multiple sets of one or more solid state emitters, and at least one lumiphor supported by the lumiphor support element, wherein the at least one lumiphor is arranged to be stimulated by emissions of at least some solid state light emitters of the multiple sets of solid state light emitters. In certain embodiments, multiple sets of solid state light emitters are configured to operate within 15 percent (%) of a root mean square (RMS) voltage of the AC power source. In certain embodiments, multiple sets of solid state light emitters comprise at least three different sets of solid state light emitters adapted to be activated and/or deactivated at different times relative to one another. In certain embodiments, each set of the multiple sets comprises at least a first solid state light emitter of a first color and at least a second solid state light emitter of a second color that is different than the first color. In certain embodiments, each set of the multiple sets comprises at least two solid state light emitters of a first color. In certain embodiments, the lighting apparatus is devoid of any AC-to-DC converter in electrical communication between the AC power source and the multiple sets of solid state light emitters.

In certain embodiments, as illustrated in FIGS. 24A to 34, solid state lighting apparatuses described herein and/or lighting products described herein may incorporate apparatuses (e.g., light bulbs, replacement bulbs for fluorescent tube-type lighting fixtures, down lights, etc.) comprising non-planar arrangements of LEDs and/or non-coplanar substrate regions (or substrate portions) having LEDs arranged thereon, and/or LED combinations arranged to emit light in non-parallel directions, wherein different LEDs or sets of LEDs are configured to be activated and/or deactivated at different times relative to one another during a portion of an AC cycle. The particular substrate and/or substrate region shape, apparatus shape, configuration, number of LEDs, arrangement of LEDs, placement of LEDs, control scheme, and/or control components (including size and placement thereof) shown in FIGS. 24A to 34 are for purposes of illustration only. A person skilled in the art would recognize upon review of the present disclosure that numerous variants of these and other features are possible.

Figure 24A:
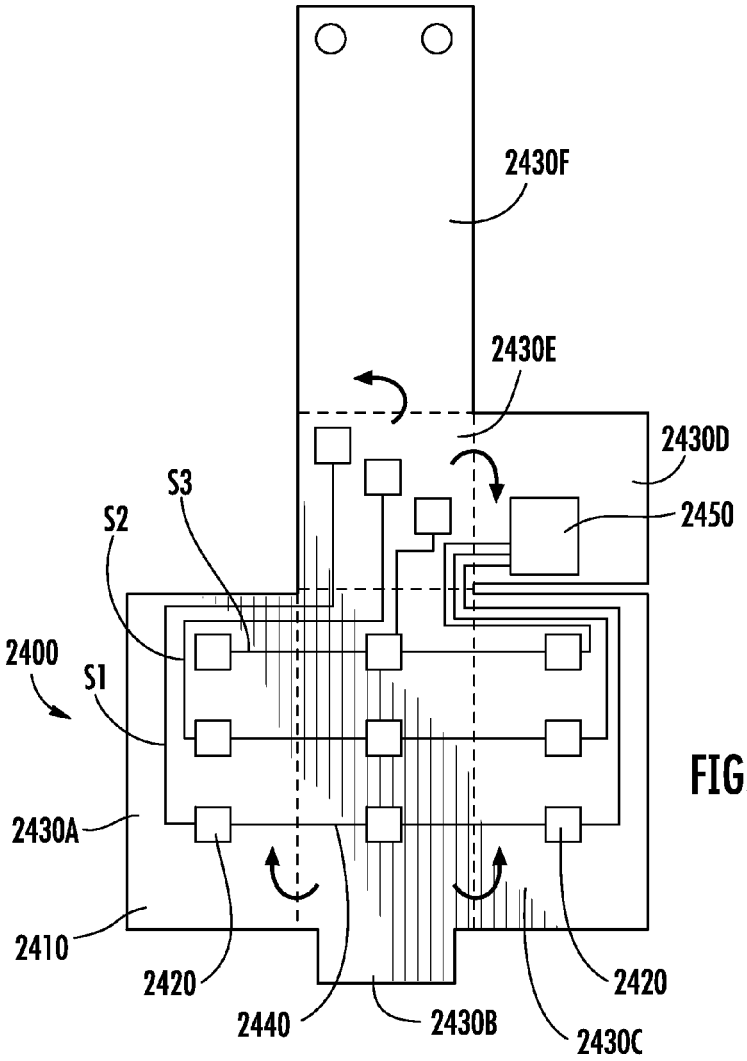
FIG. 24A is a top plan view of a substantially planar substrate, control components, and solid state emitter components of a solid state lighting apparatus, prior to manipulation of the substrate to yield multiple portions or regions arranged along non-parallel planes according to certain embodiments.
Figure 24B:
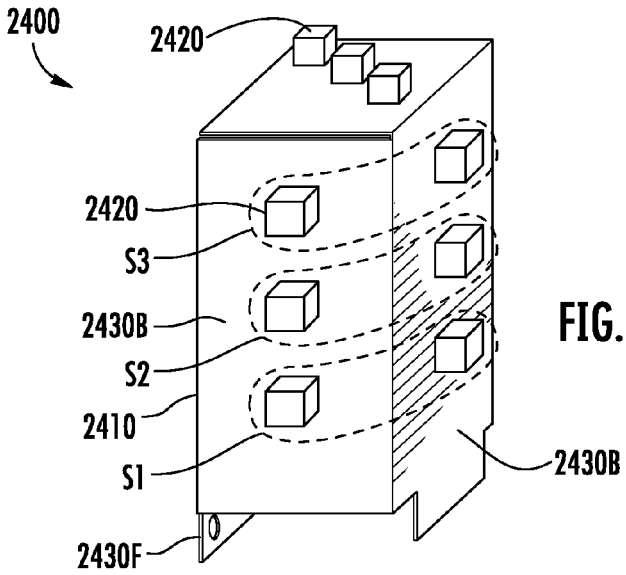
FIG. 24B is a perspective view of a solid state lighting apparatus following manipulation of the substrate of FIG. 24A to yield multiple portions or regions arranged along non-parallel planes according to certain embodiments.
Figure 24C:
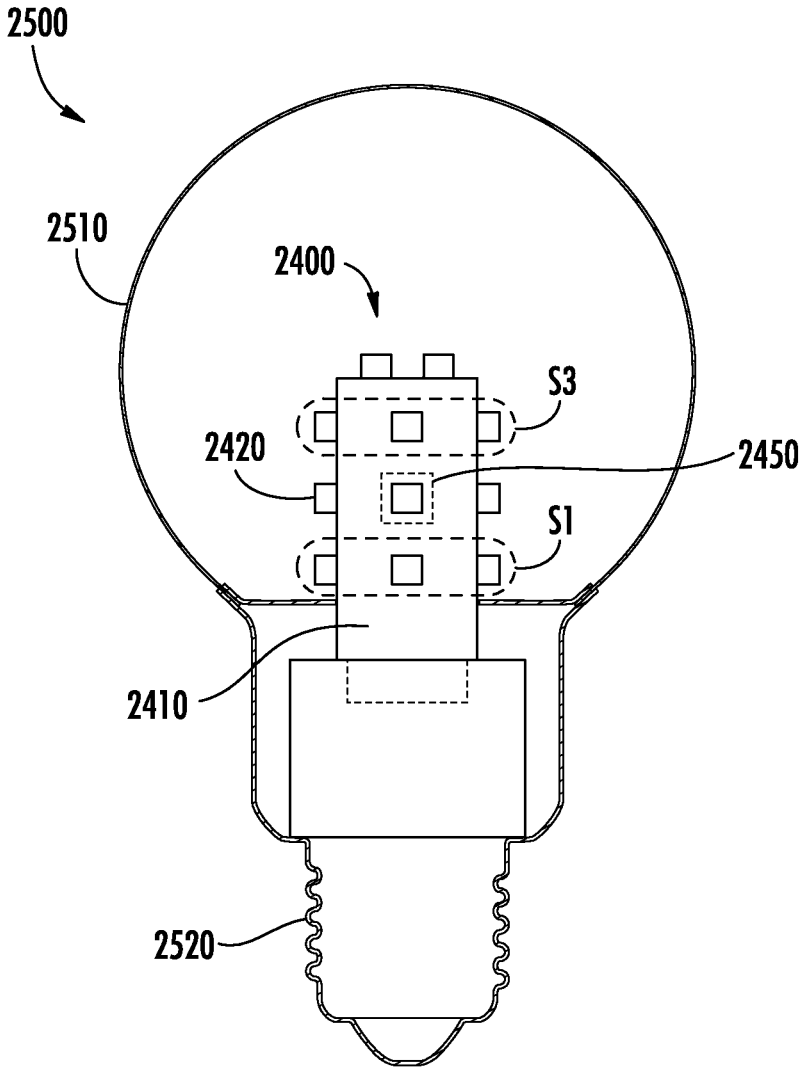
FIG. 24C is a side cross-sectional schematic view of a light bulb including at least one solid state lighting apparatus with multiple portions or regions arranged along non-parallel planes according to certain embodiments.

FIGS. 24A and 24B illustrate a further embodiment of a solid state lighting apparatus, generally designated 2400. As FIG. 24C illustrates, apparatus 2400 can be configured for use within a LED light bulb, generally designated 2500. In certain embodiments, apparatus 2400 includes a substrate 2410 and multiple solid state light emitters 2420 (e.g., LEDs or LED chips) arranged thereon. In certain embodiments, substrate 2410 comprises an initially planar substrate (e.g., FIG. 24A) portions of which may be manipulated (e.g., by flexure, bending, and/or other forming or shaping techniques) to yield multiple portions or regions arranged along non-parallel planes (e.g., such as the configuration shown in FIG. 24B). In certain embodiments, substrate 2410 can comprise a flexible or pliable material, such as a flexible circuit board or a thin metallic substrate, of which portions or regions which may be coated with an insulating material.

In some embodiments, substrate 2410 may be include multiple integrally formed panel portions 2430A to 2430F which may be bendable, flexible, pivotable, or otherwise movable along (or proximate to) the areas indicated in broken lines in FIG. 24A to yield a substrate 2410 including multiple portions or regions arranged along non-parallel planes, as illustrated in FIG. 24B. In certain embodiments, portions of substrate 2410 are bendable in at least some of the directions indicated by the curved arrows shown in FIG. 24A to form the a multi-planar solid state lighting apparatus. Various electrical traces 2440 may be formed in or on one or more surfaces of substrate 2410 or portions thereof, to provide electrical connections for solid state emitters 2420 and related circuitry (e.g., driver and/or control circuit components). In certain embodiments, different groups or sets of solid state emitters may be separately controlled, such as to permit different groups or sets of solid state emitters to be activated and/or deactivated at different times relative to one another during a portion of an AC cycle.

In certain embodiments, at least one control circuit element 2450 (such as, but not limited to, a driver circuit previously described in connection with FIGS. 1-4) can be electrically coupled to emitters 2420 via traces 2440 or other conductors (e.g., traces formed on an opposing surface of substrate 2410 and in electrical communication with the emitters 2420 by way of conductive vias (not shown) extending through the substrate 2410). In certain embodiments, circuit element(s) 2450 may include a rectifier circuit, a current diversion circuit, and/or a current limiter circuit as described previously herein. In certain embodiments, control circuit element(s) 2450 can be directly coupled to emitters 2420 of multiple LED string circuits and can be directly coupled to an AC voltage signal without requiring use of an on-board switched mode power supply. In certain embodiments, control circuit 2450 may be disposed on a substrate portion (e.g., panel) 2430D that can be bent or otherwise folded along an edge thereof such that during use, the electrical components contained thereon will not be outwardly visible, but will rather be disposed below portions of substrate portion 2430E. This may be advantageous as the electrical components may not block, absorb, or otherwise interfere with light emission from apparatus 2400.

In certain embodiments, at least one panel or substrate portion can comprise a heat conduit panel portion 2430F for conductive thermal communication with the solid state emitters 2420 and optionally having mounting elements (e.g., holes or protrusions) arranged therein. Following various planar processing steps (e.g., deposition of insulating material, formation of electrical traces, mounting or addition of control circuit element(s) 2450, and optionally mounting solid state emitters 2420 (since such mounting may be performed after cutting and/or shaping steps), substrate 2410 may be cut, scribed, or otherwise processed or manipulated as necessary (e.g., to form and/or segregate the substrate and panel from adjacent portions of a carrier). Upon bending or other shaping of substrate 2410, the substrate panel portions 2430A-2430F may be arranged in a multi-planar conformation to yield a substantially rigid upright support structure or apparatus with multiple non-coplanar substrate portions arranged as illustrated in FIG. 24B. Preferably, at least some of the non-coplanar substrate portions are arranged along non-parallel (e.g., intersecting planes).

In certain embodiments, multiple sets of solid state light emitters 2420 configured to be activated and/or deactivated at different times relative to one another during a portion of an AC cycle as previously described (see e.g., FIGS. 5A and 5B) are arranged on multiple portions of the substrate 2410. Some substrate (panel) portions, and in some embodiments, each externally accessible panel portion 2430A-2430D, can include multiple solid state emitters 2420 (optionally arranged in one or more rows or other configurations). In certain embodiments, some or all of the externally accessible substrate (panel) portions 2430A-2430D contain solid state emitters 2420 of at least a first set $S_1$, a second set $S_2$, and a third set $S_3$. Any number of emitters of multiple sets $S_N$ (wherein N>1) can be provided per substrate portion 2430A-2430D. In certain embodiments, each set $S_1 \ldots S_N$ can be mutually exclusive and separately controlled via control circuit 2450. In certain embodiments, each set $S_1$ to $S_3$ can have a different duty cycle. Placing solid state emitters of different duty cycles (according to different sets $S_1$ to $S_3$) on a same substrate portion (or, more preferably, on each substrate portion) 2430A-2430B may improve appearance of the aggregated light emissions by reducing perceptible flicker, reducing perceptible variation (with respect to area) in luminous flux, reducing perceptible variation in aggregated output color, and/or improve thermal management by reducing hot spots within the device.

FIG. 24C illustrates a light bulb 2500 incorporating solid state lighting apparatus 2400. Apparatus 2400 can be configured include multiple non-coplanar substrate regions (e.g., panels) upon which multiple solid state light emitters 2420 are mounted. Solid state light emitters 2420 of multiple mutually exclusive sets $S_1$, $S_2$, and $S_3$ can be arranged adjacent each other, with at least one emitter of each sets $S_1$, $S_2$, and $S_3$ preferably arranged on each of multiple non-coplanar panels of apparatus 2400. In certain embodiments, control circuit element(s) 2450 can be concealed from view (e.g., folded under or below panel portion 2430E), and/or portions of substrate 2410 can be bent or folded about portions of control circuit element(s) 2450.

Light bulb 2500 includes a globe, diffuser, and/or other optical element 2510 (e.g., arranged to transmit, mix, and/or diffuse emissions of LEDs of multiple emitter sets $S_1$ to $S_3$) disposed over a base portion 2520. Each LED 2420 may be arranged over an emitter mounting area 2450. In certain embodiments, the globe 2510 may serve as a lumiphor support element that is spatially segregated from the multiple emitter sets $S_1$ to $S_3$ and that supports (e.g., is coated with) at least one lumiphoric material arranged to be stimulated by emissions of at least some solid state light emitters of the multiple emitter sets $S_1$ to $S_3$. Globe portion 2510 may promote color mixing of light emitted by multiple LEDs 2420. Apparatus 2400 can be arranged below globe portion 2510 to enable multi-directional transmission of light through globe portion 2510. In certain embodiments, globe portion 2510 can be faceted and/or textured to produce a desired pattern or directional output of light.

As shown in FIG. 24C, globe portion 2510 (which may constitute a globe, diffuser, and/or an optical element) is arranged to bound a cavity containing emitters 2420. In certain embodiments, a plurality of conductors (e.g., conductive traces and/or wires) conducting AC power are contained or otherwise arranged within the cavity.

Figure 25A:
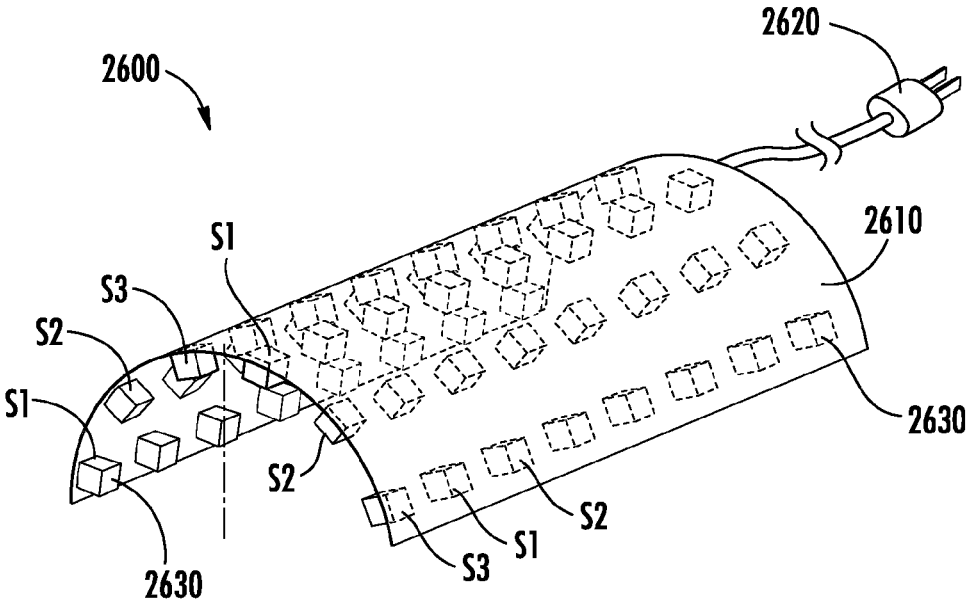
FIG. 25A is a perspective view of a solid state lighting apparatus including multiple emitters arranged along multiple portions of an inwardly-curving inner surface of a non-planar substrate according to certain embodiments.
Figure 25B:
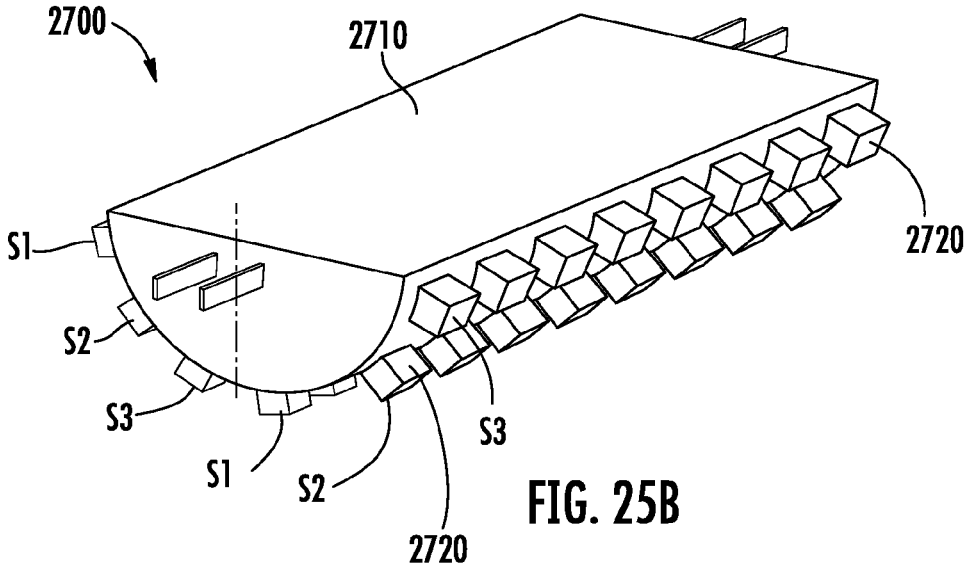
FIG. 25B is a perspective view of a solid state lighting apparatus including multiple emitters arranged along multiple portions of an outwardly-curving outer surface of a non-planar substrate according to certain embodiments.

FIGS. 25A and 25B illustrate embodiments of solid state lighting apparatuses, generally designated 2600 and 2700, respectively, including non-planar substrates, wherein different LEDs or sets of LEDs are configured to be activated and/or deactivated at different times relative to one another during a portion of an AC cycle. In some embodiments, apparatuses 2600 and 2700 can comprise replacement fixtures or replacement bulbs for tube-like lighting structures used in overhead fluorescent-type lighting fixtures. Referring to FIG. 25A, apparatus 2600 can comprise a non-planar substrate 2610. In certain embodiments, substrate 2610 can comprise a substantially semi-circular cross-sectional shape. Apparatus 2600 can be adapted to receive power directly via an AC plug 2620. In other embodiments, apparatus 2600 can receive power via pins or electrically conductive connectors (such as shown in FIG. 25B).

FIG. 25A illustrates multiple LEDs (e.g., a LED array) 2630 arranged along multiple portions of an inwardly-curving inner surface of the non-planar substrate 2610, preferably to provide multi-directional light emission. In certain embodiments, the inner surface of the substrate 2610 comprises a reflector. In certain embodiments, substrate 2610 and/or portions thereof may be substantially convex. In some embodiments, substrate 2610 can comprise one or more symmetrical or asymmetrical curved, rounded, and/or arc portions as indicated on either side of the broken line. Separately controlled sets of LEDs 2630 can be provided on and arranged over substrate 2610. In some embodiments, a first set $S_1$ having LEDs with longest duty cycle can be intermixed with a second set $S_2$ and third set $S_3$ of LEDs 2630 having an intermediate and a shortest duty cycle, respectively. More than or less than three sets of LEDs 2630 can be provided in certain embodiments. Intermixing multiple sets of LEDs 2630 of different duty cycles may reduce perceptible flicker and/or perceptible color variation (with respect to area) in luminous flux. In certain embodiments, each adjacent row of LEDs 2630 arranged on each arc section (e.g., on either side of the broken center line) can include at least one LED 2630 of a different set $S_1$, $S_2$, and $S_3$ having a different duty cycle, such that the light emission will be adequately mixed, and obviate perceptible color variation.

FIG. 25B illustrates multiple LEDs (e.g., a LED array) 2720 arranged along multiple portions of an outwardly-curving outer surface of a non-planar substrate 2710, preferably to provide multi-directional light emission. apparatus 2700 including another embodiment of a non-planar substrate 2710 and/or non-planar arrays of LEDs 2720 disposed over substrate 2710. In certain embodiments, substrate 2710 and/or portions thereof can be substantially semi-circular or substantially convex. Apparatus 2700 can receive power directly from an AC power source via pins disposed proximate the ends of apparatus 2700. In some embodiments, substrate 2710 can comprise one or more symmetrical or asymmetrical curved, rounded, or arc portions as indicated on either side of the vertical broken line. Separately controlled sets of LEDs 2720 can be provided and arranged over substrate 2710. In some embodiments, a first set $S_1$ having LEDs 2720 of a longest duty cycle can be intermixed with a second set $S_2$ and a third set $S_3$ of LEDs 2720 having an intermediate and a shortest duty cycle, respectively. More than or less than three sets of LEDs can be provided. Intermixing LEDs 2720 having varying duty cycles can reduce perceptible flicker and/or color variation during operation. In certain embodiments, each adjacent row of LEDs 2720 arranged on each arc section (e.g., on either side of the broken center line) can include at least one LED chip 2720 of a different set $S_1$, $S_2$, and $S_3$ such that the light emission is adequately mixed and to reduce variation in color during operation of apparatus 2700.

Figure 26A:
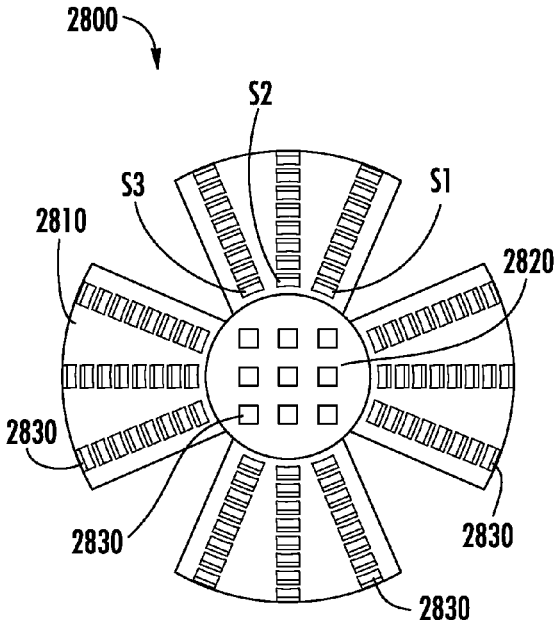
FIG. 26A is a top plan view of a substrate and solid state emitter components of a solid state lighting apparatus, prior to manipulation of the substrate to yield multiple non-coplanar portions or regions.
Figure 26B:
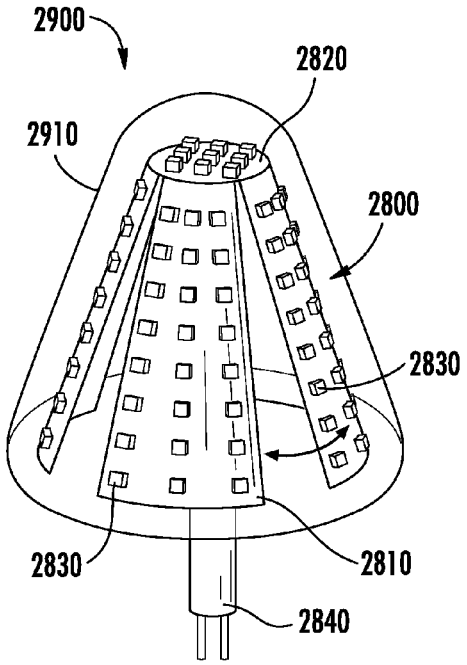
FIG. 26B is a perspective view of a lighting device including the solid state lighting apparatus of FIG. 26A arranged under a cover, globe, or optical element, following manipulation of the substrate of FIG. 26A to yield multiple non-coplanar portions or regions.

FIG. 26A illustrates a substrate 2810 and solid state emitter components 2830 of a solid state lighting apparatus 2800, prior to manipulation of the substrate 2810 to yield multiple non-coplanar portions or regions. FIG. 26B illustrates a lighting device 2900 including the solid state lighting apparatus 2800 of FIG. 26A arranged under a cover, globe, or optical element 2910, following manipulation of the substrate 2810 of FIG. 26A to yield multiple non-coplanar portions or regions. The initially planar substrate 2810 may be manipulated into a structure including multiple non-coplanar portions by bending, flexing, or pivoting portions thereof. In some embodiments, multiple non-coplanar portions of the substrate 2810 may each be curved (e.g., have a curved cross-section). In some embodiments, substrate 2810 can comprise multiple (e.g., peripheral) portions or regions adapted to flex, bend and/or pivot about a centralized portion 2820 or region to form multiple non-planar portions of a substrate. In some embodiments, the peripheral portions can be bent, rotated, or flexed after die attaching LEDs 2830. In some embodiments, peripheral portions of substrate 2810 can be disposed such that outer surfaces upon which LEDs are mounted are disposed at intersecting planes. Thus, an array of LEDs 2830 can be arranged over upper surfaces of substrate 2810 and disposed along multiple intersecting planes.

In certain embodiments, multiple LEDs 2830 can be provided in multiple rows or multiple arrays over each portion of substrate 2810. LEDs 2830 can be arranged in multiple mutually exclusive set $S_1$, $S_2$, and $S_3$ having varying duty cycles. LEDs 2830 of different duty cycles and, therefore, LEDs of different sets $S_1$, $S_2$, and $S_3$ can be provided over each portion of substrate 2810. LEDs 2830 of different sets $S_1$, $S_2$, and $S_3$ can be intermixed over portions of substrate 2810 for improving light emission and for reducing perceptible flicker and/or color variation during turning on and/or off various sets $S_1$, $S_2$, and $S_3$.

As illustrated in FIG. 26B, lighting device 2900 can comprise a globe portion 2910 disposed about apparatus 2800 for transmitting, diffusing, and/or mixing emissions of LEDs 2830 of different sets $S_1$, $S_2$, and $S_3$. As the arrows in FIG. 26B indicate, multiple peripheral portions of substrate 2810 can bend or flex about centralized portion 2820 of substrate for forming multiple non-planar sections, to promote multidirectional emission of light. In certain embodiments, beam shape, direction, and/or size can be varied by positioning peripheral portions at different locations with respect to centralized portion 2820.

Figure 27A:
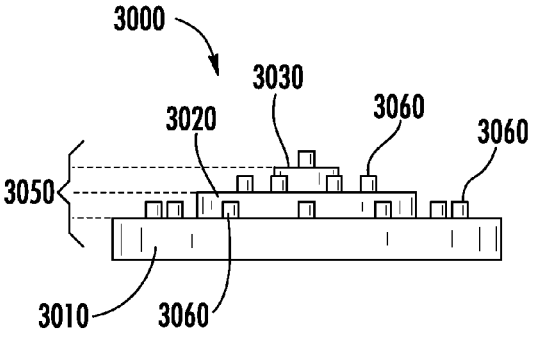
FIGS. 27A and 27B are side and top views, respectively, of solid state emitters arranged on multiple non-coplanar substrates or substrate regions of a solid state lighting apparatus according to certain embodiments.
Figure 27B:
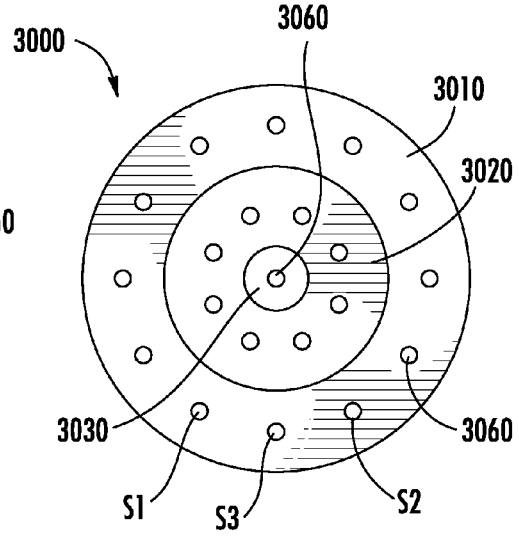

In certain embodiments, apparatus 2800 can comprise a support element 2840 extending below centralized portion 2820 and/or below peripheral portions of substrate 2810, with the support element 2840 optionally being arranged to contain or support at least one driver circuit element (not shown). The support element 2840 or circuit element(s) therein can receive electrical signal or power directly from an AC power source via pins or connectors proximate to the support element 2840. FIGS. 27A and 27B illustrate side and top views, respectively, of a further embodiment of a solid state lighting apparatus 3000 including solid state emitters 3060 arranged on multiple non-coplanar substrates or substrate regions 3010, 3020, 3030, which may be parallel to one another. In certain embodiments, apparatus 3000 can comprise a substrate having multiple, stacked substrate regions or portions which can be separately or integrally formed. For example, apparatus 3000 can include a first portion 3010 disposed over a second portion 3020, and second portion 3020 can be disposed over a third portion 3030. LEDs 3060 can be supported and arranged over each substrate portion 3010, 3020, 3030. In certain embodiments, second and third portions 3010 and 3020, respectively, can be peripherally disposed about third portion 3030. That is, in some embodiments, third portion 3030 can comprise a smaller centralized portion of substrate. In certain embodiments, LEDs 3060 can be arranged over each substrate portion along parallel planes 3050.

As FIG. 27B illustrates, multiple mutually exclusive sets of LEDs $S_1$, $S_2$, and $S_3$ of LEDs can be provided over one or more substrate regions or portions. In certain embodiments, LEDs can be provided over a first, a second, and a third substrate portions 3010, 3020, and 3030, respectively. LEDs 3060 having a longest duty cycle (e.g., set $S_1$) can be provided adjacent LEDs 3060 having a shortest duty cycle (e.g., set $S_3$). This may reduce perceptible flicker and/or color variation associated with apparatus 3000 as LEDs 3060 of different sets cycle on and off.

Figure 28:
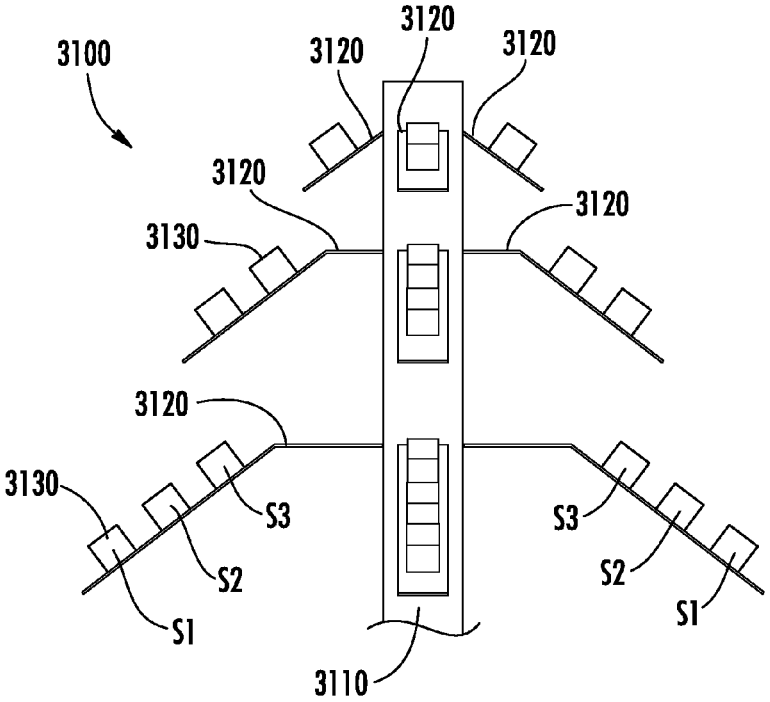
FIG. 28 is a side elevation view of a solid state lighting apparatus including solid state emitters arranged on multiple non-coplanar substrates or substrate regions supported by a common support element according to certain embodiments.

FIG. 28 is a side view of a further embodiment of a solid state lighting apparatus 3100 including solid state emitters 3130 arranged on multiple non-coplanar substrates or substrate regions 3120 supported by (e.g., peripherally extending from) a common (e.g., centralized) support element 3110. In certain embodiments, substrates or substrate regions 3120 can extend about multiple sides of centralized support 3110 (e.g., as indicated, some can extend out of the page), such that apparatus 3100 is adapted to provide multidirectional and/or substantially omnidirectional light emission. In certain embodiments, multiple LEDs 3130 can be provided in non-planar arrangements over substrates or substrate portions 3120. In some embodiments, multiple different sets $S_1$, $S_2$, and $S_3$ of LEDs 3130 can be provided over at least some of the peripheral supports 3120. Various LEDs 3130 from different sets $S_1$, $S_2$, and $S_3$ can be intermixed in non-planar arrangements over peripheral supports 3120 for reducing perceptible flicker and/or color variation as LEDs 3130 of different sets cycle on and off.

Figure 29:
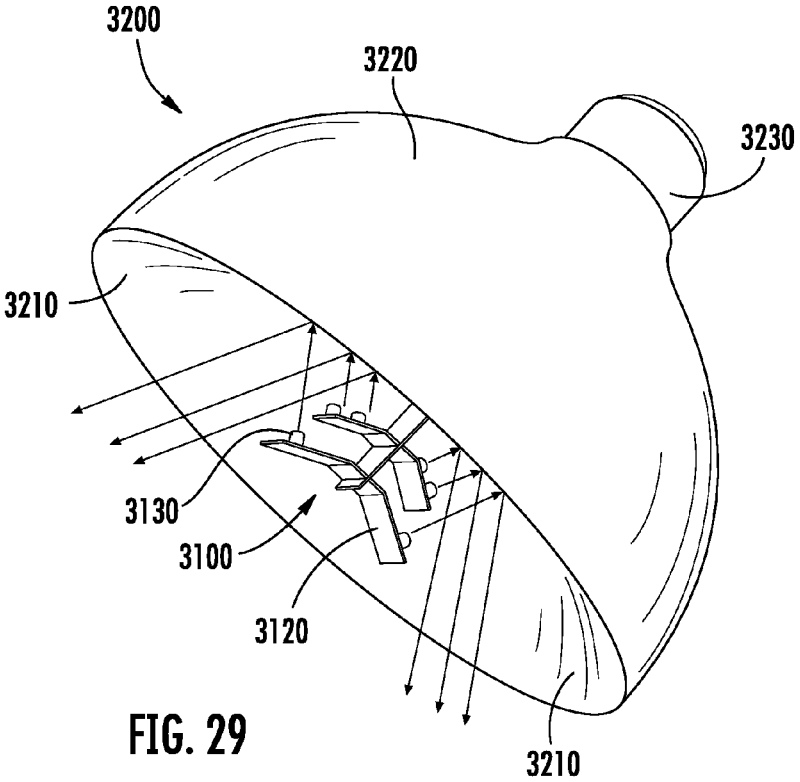
FIG. 29 is a perspective view of a down light incorporating a solid state lighting apparatus including solid state emitters arranged on multiple non-coplanar substrates or substrate regions supported by a common support element according to certain embodiments.

FIG. 29 illustrates a lighting device or fixture arrangeable as a downlight 3200 incorporating lighting apparatus 3100 and the non-planar arrangement of LEDs 3130. Downlight 3200 can include a reflective surface 3210 adapted to reflect and/or scatter light emitted by apparatus 3100. Reflective surface 3210 can be disposed inside a housing 3220. In certain embodiments, housing 3220 can be adapted to encase or enclose reflective surface 3210 and apparatus 3100. Down light 3200 can further comprise a base portion 3230, which may be adapted to connect to an AC power source for providing AC signal directly to apparatus 3100. As FIG. 29 illustrates, apparatus 3100 can be configured to emit light towards the base 3230. The light can then become reflected out of the light emission end via reflective surface 3210.

Figure 30:
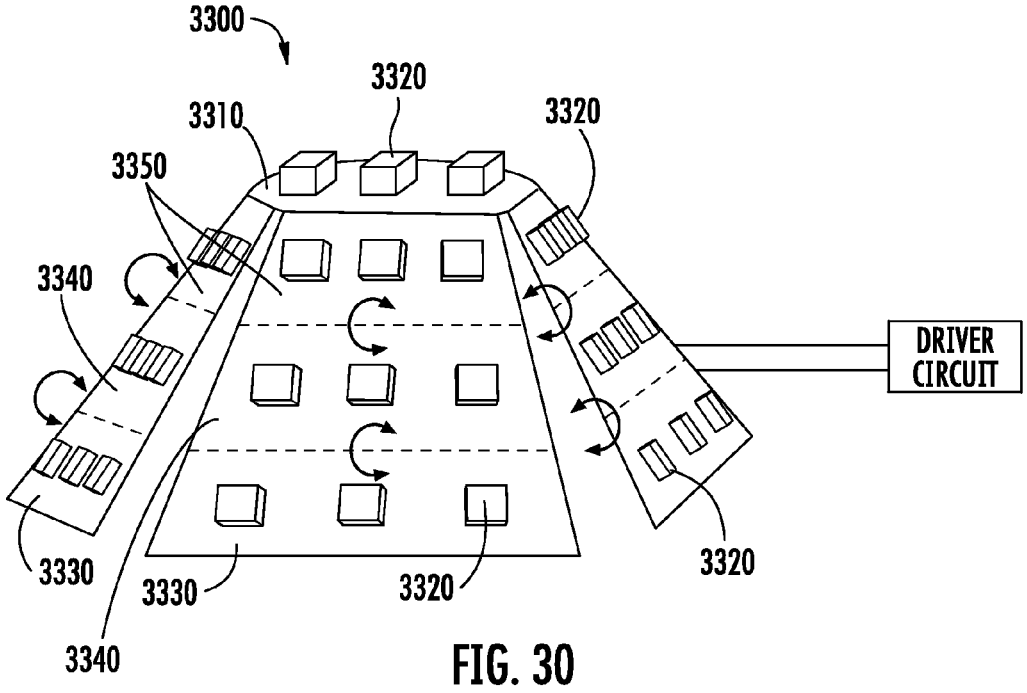
FIG. 30 is a schematic view of a solid state lighting apparatus including solid state emitters arranged on multiple non-coplanar substrate portions or regions, and including at least one control or driver circuit element arranged remotely relative to the substrate portions or regions according to certain embodiments.

FIG. 30 is a perspective side view of a further embodiment of a solid state lighting apparatus 3300. Apparatus 3300 can comprise a substrate including multiple non-coplanar portions. Substrate can comprise a centralized portion 3310 and multiple differently oriented peripheral portions disposed about centralized portion 3310. In certain embodiments, centralized portion 3310 can be angled toward or parallel to a floor (not shown). In certain embodiments, peripheral portions can comprise a first portion 3330, a second portion 3340, and a third portion 3350. As the arrows in FIG. 30 indicate, each of the first, second, and third portions 3330 to 3350 can be adapted to flex, pivot, bend, and/or or rotate with respect to each other (e.g., along broken lines) in order to vary beam size, shape, and/or direction. Multiple LEDs 3320 can be provided over centralized portion 3310 and peripheral portions 3330, 3340, 3350. In certain embodiments, each of the centralized portion 3310 and peripheral portions 3330, 3340, 3350 includes at least one emitter of multiple emitter sets that are configured to be activated and/or deactivated at different times relative to one another during a portion of an AC cycle.

In certain embodiments, apparatus 3300 can comprise at least one remotely located driver circuit element. That is, one or more circuit elements adapted to control apparatus 3300 and/or sets of LEDs 3320 disposed thereon can be disposed at a remote location and away from the substrate 3310 and LEDs 3320 arranged thereon.

Figure 31:
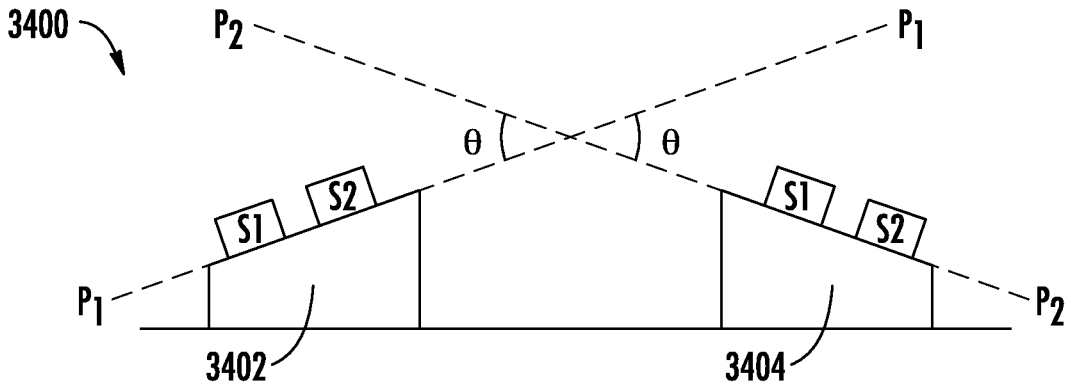
FIG. 31 is a schematic illustration of first and second non-coplanar substrate portions or regions each including solid state emitters of different emitter sets or groups arranged to be activated and/or deactivated at different times according to certain embodiments, wherein the first and second substrate portions or regions are arranged along planes oriented apart from one another by a nonzero angle θ.

FIG. 31 is a schematic illustration of a lighting apparatus 3400 including non-coplanar first and second substrate portions or regions 3402, 3404 each including solid state emitters $S_1$, $S_2$ of different emitter sets or groups arranged to be activated and/or deactivated at different times relative to one another during a portion of an AC cycle. The first substrate portion 3402 is arranged along or parallel to a first plane $P_1$, and the second substrate portion 3404 is arranged along or parallel to a second plane $P_2$, wherein the first and second planes $P_1$, $P_2$ are non-coplanar, non-parallel to one another, and oriented (angled) apart from one another by a nonzero angle $\theta$. In certain embodiments, substrate portions 3402, 3404 are portions of a single substrate; in other embodiments, substrate portions 3402, 3404 are portions of distinct substrates that may be optionally supported by a common support element (not shown).

Figure 32:
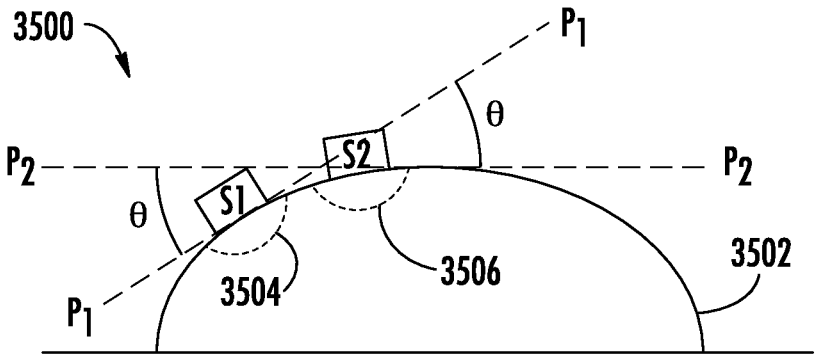
FIG. 32 is a schematic illustration of non-coplanar first and second portions or regions of a curved or convex substrate, with a first solid state emitter supported by the first substrate portion or region, and with a second solid state emitter supported by the second substrate portion or region, wherein the first and second substrate portions or regions are arranged along planes oriented apart from one another by a nonzero angle θ.

FIG. 32 is a schematic illustration of a lighting apparatus 3500 including non-coplanar first and second portions or regions 3504, 3506 of a curved or convex substrate 3502, with a first solid state emitter $S_1$ supported by the first substrate portion or region 3504, and with a second solid state emitter $S_2$ supported by the second substrate portion or region 3506. The first and second substrate portions or regions are arranged along (or parallel to) planes $P_1$, $P_2$ oriented apart from one another by a nonzero angle θ. Preferably, the angle θ is sufficiently small that emissions of first emitter $S_1$ substantially overlap with second emitter $S_2$ in order to reduce perceptible flicker, reduce perceptible variation (with respect to area) in luminous flux, reduce perceptible variation in aggregated output color, and/or improve thermal management by reducing hot spots within the apparatus 3500. In certain embodiments, θ is preferably less than or equal to about 45 degrees, 35 degrees, 30 degrees, 25 degrees, 20 degrees, 15 degrees, 10 degrees, 7.5 degrees, 5 degrees, or 2.5 degrees.

Figure 33:
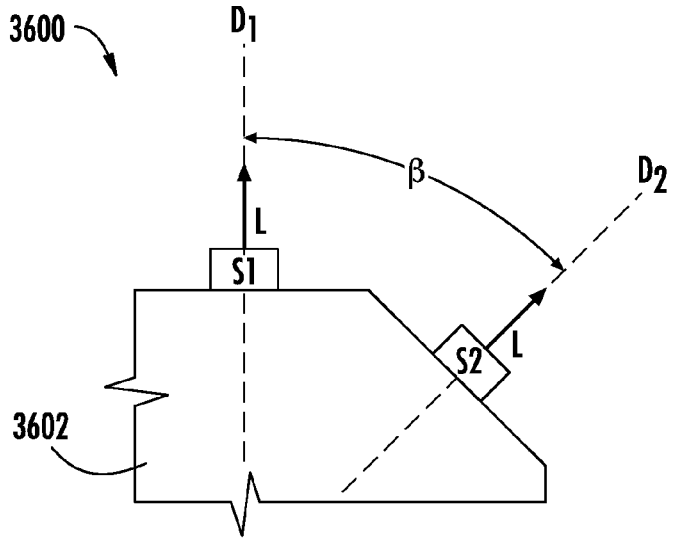
FIG. 33 is a schematic illustration of non-coplanar first and second portions or regions of a substrate, with a first solid state emitter supported by the first substrate portion or region, and with a second solid state emitter supported by the second substrate portion or region, wherein centers of beams emitted by the first and second solid state emitters are separated by a nonzero angle β.

FIG. 33 is a schematic illustration a lighting apparatus 3600 including non-coplanar first and second portions or regions of a substrate, with a first solid state emitter $S_1$ supported by the first substrate portion or region, and with a second solid state emitter $S_2$ supported by the second substrate portion or region, wherein directions of centers of beams $D_1$, $D_2$ emitted by the first and second solid state emitters $S_1$, $S_2$ are separated by a nonzero angle β. Preferably, the angle β is sufficiently small that emissions of first emitter $S_1$ substantially overlap with second emitter $S_2$ in order to reduce perceptible flicker, reduce perceptible variation (with respect to area) in luminous flux, reduce perceptible variation in aggregated output color, and/or improve thermal management by reducing hot spots within the apparatus 3500. In certain embodiments, β is preferably less than or equal to about 45 degrees, 35 degrees, 30 degrees, 25 degrees, 20 degrees, 15 degrees, 10 degrees, 7.5 degrees, 5 degrees, or 2.5 degrees.

Figure 34:
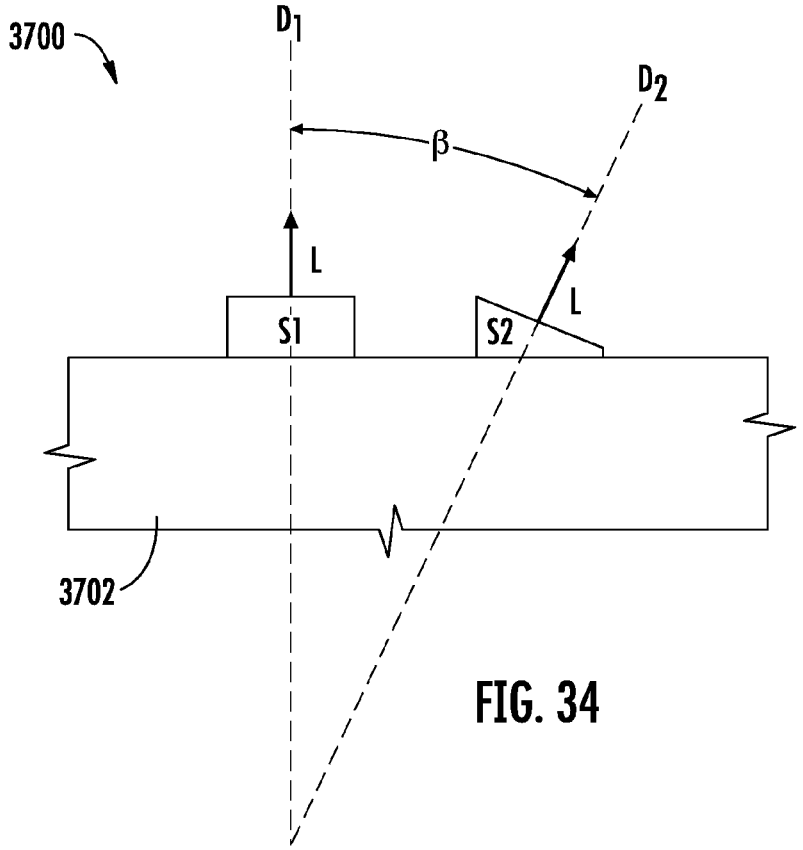
FIG. 34 is a schematic illustration of first and second solid state emitters arranged on a substantially planar substrate, wherein centers of beams emitted by the first and second solid state emitters are separated by a nonzero angle β.

FIG. 34 is a schematic illustration of a lighting apparatus 3700 including first and second solid state emitters $S_1$, $S_2$ arranged on a substantially planar substrate 3702, wherein directions of centers of beams $D_1$, $D_2$ emitted by the first and second solid state emitters $D_1$, $D_2$ are separated by a nonzero angle β. In certain embodiments, second emitter $S_2$ has a primary emissive surface that is non-parallel to and non-coplanar with a primary emissive surface of first emitter $S_1$. Preferably, the angle β is sufficiently small that emissions of first emitter $S_1$ substantially overlap with second emitter $S_2$ in order to reduce perceptible flicker, reduce perceptible variation (with respect to area) in luminous flux, reduce perceptible variation in aggregated output color, and/or improve thermal management by reducing hot spots within the apparatus 3500. In certain embodiments, β is preferably less than or equal to about 45 degrees, 35 degrees, 30 degrees, 25 degrees, 20 degrees, 15 degrees, 10 degrees, 7.5 degrees, 5 degrees, or 2.5 degrees Embodiments as disclosed herein may provide one or more of the following beneficial technical effects: reduced cost of solid state lighting devices; reduced size or volume of solid state lighting devices; reduced perceptibility of flicker of solid state lighting devices operated with AC power; reduced perceptibility of variation in intensity (e.g., with respect to area and/or direction) of light output by solid state lighting devices operated with AC power; reduced perceptibility of variation (e.g., with respect to area and/or direction) in output color and/or output color temperature of light output by solid state lighting devices operated with AC power; improved dissipation of heat (and concomitant improvement of operating life) of solid state lighting devices operated with AC power; improved manufacturability of solid state lighting devices operated with AC power; improved ability to vary color temperature of emissions of solid state lighting devices operated with AC power; improved ability to vary beam size, beam pattern, and/or direction of light output by solid state lighting devices operated with AC power.

While the invention has been has been described herein in reference to specific aspects, features, and illustrative embodiments, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Various combinations and sub-combinations of the structures and features described herein are contemplated and will be apparent to a skilled person having knowledge of this disclosure. Any of the various features and elements as disclosed herein may be combined with one or more other disclosed features and elements unless indicated to the contrary herein. Correspondingly, the invention as hereinafter claimed is intended to be broadly construed and interpreted, as including all such variations, modifications and alternative embodiments, within its scope and including equivalents of the claims.

What is claimed is:

1. A solid state lighting apparatus adapted to operate with alternating current (AC) received from an AC power source, the lighting apparatus comprising:

a substrate; and multiple sets of one or more solid state light emitters arranged on or supported by the substrate, wherein at least first and second sets of the multiple sets of solid state light emitters are configured to be activated and/or deactivated at different times relative to one another during at least a positive portion of an AC cycle, and wherein the first and second sets of the multiple sets of solid state light emitters comprise different duty cycles;

wherein at least one solid state light emitter of the first set of solid state light emitters comprises a largest duty cycle of the different duty cycles and is arranged closer in proximity to at least one solid state light emitter of the second solid state light emitter set comprising a smallest duty cycle of the different duty cycles than in proximity to any other solid state light emitter of the multiple sets of solid state light emitters.

2. The lighting apparatus according to claim 1, wherein the multiple sets of solid state light emitters comprise at least three different sets of solid state light emitters adapted to be activated and/or deactivated at different times relative to one another.

3. The lighting apparatus according to claim 1, wherein the multiple sets of solid state light emitters are configured to operate within 15 percent (%) of a root mean square (RMS) voltage of the AC power source.

4. The lighting apparatus according to claim 1, wherein each set of the multiple sets comprises at least a first solid state light emitter of a first color and at least a second solid state light emitter of a second color that is different than the first color.

5. The lighting apparatus according to claim 1, wherein a set of solid state light emitters having the smallest duty cycle of the multiple sets of solid state light emitters is disposed proximate to a center of the substrate.

6. A solid state lighting apparatus adapted to operate with alternating current (AC) received from an AC power source, the lighting apparatus comprising:

a substrate; and an array of solid state light emitters arranged on or supported by the substrate, wherein the array includes a plurality of solid state light emitter sets each comprising multiple solid state light emitters, wherein at least two different solid state light emitter sets of the plurality of solid state light emitter sets are arranged to be activated and/or deactivated at different times relative to one another during at least a positive portion of an AC cycle;

wherein, within the array of solid state light emitters, at least one solid state light emitter of a first solid state light emitter set is arranged closer to at least one solid state emitter of a second solid state light emitter set than to any other solid state light emitter of the first solid state light emitter set.

7. The lighting apparatus according to claim 6, wherein the plurality of solid state light emitter sets comprises at least two sets having different duty cycles.

8. The lighting apparatus according to claim 6, wherein, for a majority of solid state light emitters of the first solid state light emitter set, each solid state light emitter of the majority of solid state light emitters is arranged closer to at least one solid state light emitter of the second solid state light emitter set than to any other solid state light emitter of the first solid state light emitter set.

9. The lighting apparatus according to claim 7, wherein the different duty cycles comprise a largest duty cycle and a smallest duty cycle, wherein at least a majority of solid state light emitters comprising the smallest duty cycle are arranged in a central region of the substrate, and wherein at least a majority of solid state light emitters comprising the largest duty cycle are arranged in a peripheral region of the substrate.

10. The lighting apparatus according to claim 6, embodied in a lamp, a light bulb, or a lighting fixture.

11. A solid state lighting apparatus adapted to operate with alternating current (AC) received from an AC power source, the lighting apparatus comprising:

an array of solid state light emitters arranged on or supported by a substrate, the array comprising a plurality of mutually exclusive solid state light emitter sets each comprising multiple solid state light emitters, wherein at least two different solid state light emitter sets of the plurality sets are adapted to be activated and/or deactivated at different times relative to one another during a portion of an AC cycle, and wherein the at least two different solid state light emitter sets comprise different duty cycles;

wherein the array comprises multiple solid state light emitters distributed across a central portion of the substrate, and comprises multiple solid state light emitters distributed across a peripheral portion of the substrate; and wherein the central portion comprises more solid state light emitters than the peripheral portion.

12. The lighting apparatus according to claim 11, wherein the central portion of the substrate comprises no more than 50% of a total surface area of one face of the substrate.

13. The lighting apparatus according to claim 11, wherein a first solid state light emitter set of the at least two different solid state light emitter sets comprises a smallest duty cycle of the different duty cycles, a second solid state light emitter set of the at least two different solid state light emitter sets comprises a largest duty cycle of the different duty cycles, at least a majority of solid state light emitters of the first solid state light emitter set is disposed in the central portion of the substrate, and at least a majority of solid state light emitters of the second solid state light emitter set is disposed in the peripheral portion of substrate.

14. The lighting apparatus according to claim 11, wherein the central portion and the peripheral portion in combination comprise at least one of the following: concentric circles, concentric squares, concentric rectangles, or other concentric polygonal shapes of the same type.

15. A lighting apparatus adapted to operate with alternating current (AC) received from an AC power source, the lighting apparatus comprising:

an array of solid state light emitters arranged on or supported by a common substrate and including a plurality of solid state light emitter sets each comprising multiple solid state light emitters, wherein at least two different solid state light emitter sets of the plurality of solid state light emitter sets are arranged to be activated and/or deactivated at different times relative to one another during at least a positive portion of an AC cycle;

wherein the array is distributed across a region of the substrate; and wherein, for each set of the solid state light emitter sets, the multiple solid state light emitters are symmetrically arranged within or along the region.

16. A lighting apparatus according to claim 15 wherein, for each solid state light emitter set, the multiple solid state light emitters are arranged with azimuthal or rotational symmetry within or along the region.

17. The lighting apparatus according to claim 15 wherein, for each solid state light emitter set, the multiple solid state light emitters are arranged with lateral symmetry within or along the region.

18. A lighting apparatus adapted to operate with alternating current (AC) received from an AC power source, the lighting apparatus comprising:

an array of solid state light emitters arranged on or supported by a common substrate and including a plurality of solid state light emitter sets each comprising multiple solid state light emitters, wherein at least two different solid state light emitter sets of the plurality of solid state light emitter sets are arranged to be activated and/or deactivated at different times relative to one another during a portion of an AC cycle;

wherein the lighting apparatus comprises at least one of the following features (a) and (b):

(a) at least one solid state light emitter set of the plurality of solid state light emitter sets is arranged to emit at least one peak wavelength that differs by at least 30 nm from at least one peak wavelength emitted by at least one other solid state light emitter set of the plurality of solid state light emitter sets; and (b) at least one solid state light emitter set of the plurality of solid state light emitter sets is arranged to emit a first peak wavelength and to emit a second peak wavelength that differs from the first peak wavelength by at least 30 nm.

19. The lighting apparatus according to claim 18, comprising at least one solid state light emitter set of the plurality of solid state light emitter sets adapted to emit at least one peak wavelength that differs by at least 30 nm from at least one peak wavelength emitted by at least one other solid state light emitter set of the plurality of solid state light emitter sets.

20. The lighting apparatus according to claim 18, wherein the plurality of solid state light emitter sets comprises (i) a first solid state light emitter set including a plurality of LED chips adapted to generate peak emissions in a blue range and arranged to stimulate at least one phosphor adapted to generate peak emissions in a yellow range or a green range, and (ii) a second solid state light emitter set including a plurality of LED chips adapted to generate peak emissions in an orange range or a red range.

21. The lighting apparatus according to claim 18, comprising at least one solid state light emitter set of the plurality of solid state light emitter sets arranged to emit a first peak wavelength and to emit a second peak wavelength that differs from the first peak wavelength by at least 30 nm.

22. A lighting apparatus adapted to operate with alternating current (AC) received from an AC power source, the lighting apparatus comprising:

an array of solid state light emitters arranged on or supported by a common substrate and including a plurality of solid state light emitter sets each comprising multiple solid state light emitters, wherein at least three different solid state light emitter sets of the plurality of solid state light emitter sets are arranged to be activated and/or deactivated at different times relative to one another during a portion of an AC cycle; and wherein each solid state light emitter set of the at least three different solid state light emitter sets is independently arranged to emit light having x, y color coordinates within four MacAdam step ellipses of a reference point on the blackbody locus of a 1931 CIE Chromaticity Diagram and having a color temperature that differs by at least 400 K relative to a color temperature of each other solid state light emitter set of the at least three different solid state light emitter sets.

23. The lighting apparatus according to claim 22, wherein the at least three different solid state light emitter sets in combination are arranged to emit light having x, y color coordinates within two MacAdam step ellipses of a reference point on the blackbody locus of a 1931 CIE Chromaticity Diagram.

24. The lighting apparatus according to claim 22, comprising a control element arranged to permit adjustment of duty cycle of each solid state light emitter set of the at least three different solid state light emitter sets, and thereby permit adjustment of color temperature.

25. A lighting apparatus adapted to operate with alternating current (AC) received from an AC power source, the lighting apparatus comprising:

an array of solid state light emitters arranged on or supported by a body structure and including a plurality of solid state light emitter sets each comprising multiple solid state light emitters, wherein at least two different solid state light emitter sets of the plurality of solid state light emitter sets are arranged to be activated and/or deactivated at different times relative to one another during at least a positive portion of an AC cycle;

at least one reflector and/or at least one optical element arranged to receive emissions from the plurality of solid state light emitter sets, and arranged to affect a beam pattern generated by the lighting device; and a control element arranged to permit adjustment of duty cycle of each solid state light emitter set of the at least two different solid state light emitter sets, and thereby permit adjustment of said beam pattern.

26. The apparatus according to claim 25, wherein the at least one reflector and/or at least one optical element comprises a first reflector or first reflector portion arranged to receive emissions from a first solid state light emitter set of the plurality of solid state light emitter sets, and comprises a second reflector or second reflector portion arranged to receive emissions from a second solid state light emitter set of the plurality of solid state light emitter sets.

27. The lighting apparatus according to claim 25, wherein the at least one reflector and/or at least one optical element comprises at least one optical element, wherein the at least one optical element comprises a first optical element portion arranged to receive emissions from a first solid state light emitter set, and wherein the at least one optical element comprises a second optical element portion arranged to receive emissions from a second solid state light emitter set.

28. A lighting apparatus adapted to operate with alternating current (AC) received from an AC power source, the lighting apparatus comprising:

a first array of solid state light emitters arranged on or supported by a first substrate and including a first plurality of solid state light emitter sets each comprising multiple solid state light emitters, wherein at least two different solid state light emitter sets of the first plurality of solid state light emitter sets are arranged to be activated and/or deactivated at different times relative to one another during a portion of an AC cycle;

a second array of solid state light emitters arranged on or supported by a second substrate and including a second plurality of solid state light emitter sets each comprising multiple solid state light emitters, wherein at least two different solid state light emitter sets of the second plurality of solid state light emitter sets are arranged to be activated and/or deactivated at different times relative to one another during a portion of an AC cycle; and a support plate comprising a plurality of substrate mounting regions including a first substrate mounting region arranged to receive the first substrate and including a second substrate mounting region arranged to receive the second substrate.

29. The lighting apparatus according to claim 28, wherein the first substrate comprises a first circuit board, and the second substrate comprises a second circuit board.

30. The lighting apparatus according to claim 28, wherein the support plate comprises a heatsink in conductive thermal communication with the first substrate and the second substrate.

31. The lighting apparatus according to claim 28, wherein the support plate comprises a reflector arranged to reflect emissions from at least some emitters of the first array of solid state light emitters, and to reflect emissions from at least some emitters of the second array of solid state light emitters.

32. The lighting apparatus according to claim 28, wherein the first substrate mounting region comprises a first plurality of electrical conductors or contacts arranged in electrical communication with the first substrate and the first array of solid state light emitters, and the second substrate mounting region comprises a second plurality of electrical conductors or contacts arranged in electrical communication with the second substrate and the second array of solid state light emitters.

33. The lighting apparatus according to claim 28, wherein the first substrate mounting region comprises a first socket, and the second substrate mounting region comprises a second socket.

34. A solid state lighting apparatus adapted to operate with alternating current (AC) received from an AC power source, the lighting apparatus comprising:

multiple substrate regions; and multiple sets of one or more solid state light emitters arranged on or supported by the multiple substrate regions, wherein at least first and second sets of the multiple sets of solid state light emitters are configured to be activated and/or deactivated at different times relative to one another during a portion of an AC cycle, and wherein the first and second sets of the multiple sets of solid state light emitters comprise different duty cycles;

wherein the lighting apparatus comprises at least one of the following features (i) to (iii):

(i) a first substrate region of the multiple substrate regions includes one or more solid state light emitters of the first set of solid state light emitters and includes one or more solid state light emitters of the second set of solid state light emitters; and a second substrate region of the multiple substrate regions is non-coplanar with the first substrate region and includes one or more solid state light emitters of the first set of solid state light emitters and includes one or more solid state light emitters of the second set of solid state light emitters;

(ii) at least one first solid state light emitter of the first set of solid state light emitters is arranged on a first substrate region of the multiple substrate regions that is substantially parallel to a first plane, at least one second solid state light emitter of the second set of solid state light emitters is arranged on a second substrate region of the multiple substrate regions that is substantially parallel to a second plane that is non-coplanar with the first plane but oriented less than 30 degrees apart from the first plane, and at least a portion of emissions of the at least one first solid state emitter are arranged to mix or overlap with at least a portion of emissions of the at least one second solid state emitter; and (iii) at least one first solid state light emitter of the first set of solid state light emitters is arranged on a first substrate region of the multiple substrate regions and is arranged to output a first beam centered in a first direction, and at least one second solid state light emitter of the second set of solid state light emitters is arranged on a second substrate region of the multiple substrate regions and is arranged to output a second beam centered in a second direction that is non-parallel to the first direction but oriented less than 30 degrees apart from the first direction.

35. The lighting apparatus according to claim 34, wherein a first substrate region of the multiple substrate regions includes one or more solid state light emitters of the first set of solid state light emitters and includes one or more solid state light emitters of the second set of solid state light emitters; and a second substrate region of the multiple substrate regions is non-coplanar with the first substrate region and includes one or more solid state light emitters of the first set of solid state light emitters and includes one or more solid state light emitters of the second set of solid state light emitters.

36. The lighting apparatus according to claim 35, wherein the second substrate region is non-parallel to the first substrate region.

37. The lighting apparatus according to claim 34, wherein at least one first solid state light emitter of the first set of solid state light emitters is arranged on a first substrate region of the multiple substrate regions that is substantially parallel to a first plane, at least one second solid state light emitter of the second set of solid state light emitters is arranged on a second substrate region of the multiple substrate regions that is substantially parallel to a second plane that is non-coplanar with the first plane but oriented less than 30 degrees apart from the first plane, and at least a portion of emissions of the at least one first solid state emitter are arranged to mix or overlap with at least a portion of emissions of the at least one second solid state emitter.

38. The lighting apparatus according to claim 34, wherein at least one first solid state light emitter of the first set of solid state light emitters is arranged on a first substrate region of the multiple substrate regions and is arranged to output a first beam centered in a first direction, and at least one second solid state light emitter of the second set of solid state light emitters is arranged on a second substrate region of the multiple substrate regions and is arranged to output a second beam centered in a second direction that is non-parallel to the first direction but oriented less than 30 degrees apart from the first direction.

39. The lighting apparatus according to claim 34, wherein the multiple substrate regions comprise different regions of a substantially continuous substrate.

40. The lighting apparatus according to claim 34, wherein the multiple substrate regions comprise regions of different substrates.

41. The lighting apparatus according to claim 34, further comprising a globe, diffuser, or optical element arranged to transmit and/or diffuse emissions of one or more solid state light emitters of the first set of solid state light emitters and arranged to transmit and/or diffuse emissions of one or more solid state light emitters of the second set of solid state light emitter.

42. The lighting apparatus according to claim 41, wherein the globe, diffuser, or optical element is arranged to bound a cavity containing the multiple sets of one or more solid state light emitters, and wherein a plurality of conductors conducting AC power are arranged within the cavity.

43. The lighting apparatus according to claim 34, further comprising a lumiphor support element that is spatially segregated from the multiple sets of one or more solid state light emitters, and at least one lumiphor supported by the lumiphor support element, wherein the at least one lumiphor is arranged to be stimulated by emissions of at least some solid state light emitters of the multiple sets of solid state light emitters.

44. A solid state lighting apparatus adapted to operate with alternating current (AC) received from an AC power source, the lighting apparatus comprising:

a substrate; and multiple sets of solid state light emitters, each including multiple solid state light emitters, arranged on or supported by the substrate, wherein at least first and second sets of the multiple sets of solid state light emitters are configured to be activated and/or deactivated at different times relative to one another during at least a positive portion of an AC cycle, and wherein the at least first and second sets of the multiple sets of solid state light emitters comprise different duty cycles;

wherein the lighting apparatus comprises at least one of the following features (i) and (ii):

(i) the first set of solid state light emitters comprises a largest duty cycle of the different duty cycles and consists of a greater number of solid state light emitters than any other set of the multiple sets of solid state light emitters; and (ii) the second set of solid state light emitters comprises a smallest duty cycle of the different duty cycles and consists of a smaller number of solid state light emitters of the multiple sets of solid state light emitters.

45. The lighting apparatus according to claim 44, wherein the multiple sets of solid state light emitters includes a third set of solid state light emitters.

* * * * *